US007342390B2

(12) United States Patent
Tachibana et al.

(10) Patent No.: US 7,342,390 B2
(45) Date of Patent: Mar. 11, 2008

(54) REFERENCE VOLTAGE GENERATION CIRCUIT

(75) Inventors: Suguru Tachibana, Kawasaki (JP); Kenta Aruga, Kawasaki (JP); Tatsuo Kato, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 11/589,139

(22) Filed: Oct. 30, 2006

(65) Prior Publication Data

US 2007/0252573 A1 Nov. 1, 2007

(30) Foreign Application Priority Data

May 1, 2006 (JP) ..... 2006-127970

(51) Int. Cl.
*G05F 3/16* (2006.01)

(52) U.S. Cl. ..... 323/316; 323/313

(58) Field of Classification Search ..... 323/312, 323/313, 314, 315, 316, 317; 327/539, 540, 327/541

See application file for complete search history.

(56) References Cited

U.S. PATENT DOCUMENTS

| | | | |
|---|---|---|---|
| 5,325,045 A | 6/1994 | Sundby | |
| 6,147,548 A | 11/2000 | Doyle | |
| 6,181,121 B1 | 1/2001 | Kirkland et al. | |
| 6,366,071 B1 | 4/2002 | Yu | |
| 6,462,612 B1 | 10/2002 | Roh et al. | |
| 6,489,835 B1 | 12/2002 | Yu et al. | |
| 6,501,256 B1 * | 12/2002 | Jaussi et al. | 323/315 |
| 6,563,371 B2 | 5/2003 | Buckley, III et al. | |
| 6,590,372 B1 | 7/2003 | Wiles, Jr. | |
| 6,812,684 B1 | 11/2004 | Leifhelm et al. | |
| 6,853,164 B1 | 2/2005 | Prinz et al. | |

FOREIGN PATENT DOCUMENTS

| | | |
|---|---|---|
| JP | 09-260589 | 10/1997 |
| JP | 10-508401 | 8/1998 |
| JP | 10-260746 | 9/1998 |

(Continued)

OTHER PUBLICATIONS

Ming-Chan Weng et al. "*Low Cost CMOS On-Chip and Remote Temperature Sensors*", IEICE Trans. Electron., Apr. 2001, pp. 451-459, vol. E84-C, No. 4.

(Continued)

*Primary Examiner*—Jessica Han
(74) *Attorney, Agent, or Firm*—Arent Fox LLP

(57) ABSTRACT

A reference voltage generation circuit has transistors generating a PTAT current that increases in proportion to temperature, a transistor generating a CTAT current that decreases in proportion to temperature, a first variable resistor adjusting an output voltage, a transistor supplying the PTAT current to the first variable resistor via a first switch, a transistor supplying the CTAT current to the first variable resistor via a second switch, and a second variable resistor adjusting the CTAT current. The first switch is on in first and third operation modes and off in a second operation mode. The second switch is on in the first and second operation modes and off in the third operation mode. Switching the operation modes realizes independently outputting a PTAT voltage or a CTAT voltage. Independently adjusting the voltages makes it possible to correct output reference voltage of the reference voltage generation circuit accurately at low cost.

12 Claims, 37 Drawing Sheets

FOREIGN PATENT DOCUMENTS

| | | |
|---|---|---|
| JP | 11-134048 | 5/1999 |
| JP | 11-143564 | 5/1999 |
| JP | 2000-089844 | 3/2000 |
| JP | 2001-217393 | 8/2001 |
| JP | 2004-341877 | 12/2004 |
| WO | 96/14613 | 5/1996 |

OTHER PUBLICATIONS

Yen-Shyung Shyu et al, "*A 0.99 μA Operating Current Li-Ion Battery Protection IC*", IEICE Trans. Electron, May 2002, pp. 1211-1215, vol. E85-C, No. 5.

Fabiano Fruett et al, "*Minimization of the Mechanical-Stress-Induced Inaccuracy in Bandgap Voltage References*", IEEE Journal of Solid-State Circuits, Jul. 2003, pp. 1288-1291, vol. 38, No. 7.

Anton Bakker et al, "*Micropower CMOS Temperature Sensor with Digital Output*", IEEE Journal of Sold-State Circuits, Jul. 1996, pp. 933-937, vol. 31, No. 7.

Anton Bakker et al, "*A CMOS Nested-Chopper Instrumentation Amplifier with 100-nV Offset*", IEE Journal of Solid-State Circuits, Dec. 2000, pp. 1877-1883, vol. 35, No. 12.

Gerald C. M. Meijer et al, "*Temperature Sensors and Voltage References Implemented in CMOS Technology*", IEEE Sensors Journal, Oct. 2001, pp. 225-234, vol. 1, No. 3.

Rudy J. Van De Plassche, "*Dynamic Element Matching for High-Accuracy Monolithic D/A Converters*", IEEE Journal of Solid-State Circuits, Dec. 1976, pp. 795-800, vol. SC-11, No. 6.

Vijaya G. Ceekala et al. "*A Method for Reducing the Effects of Random Mismatches in CMOS Bandgap References*", ISSCC Digest of Technical Papers, Feb. 2002, pp. 23.7.

Piero Malcovati et al, "Curvature-Compensated BiCOMS Bandgap with 1-V Supply Voltage", IEEE Journal of Solid-State Circuits, Jul. 2001, pp. 1076-1081, vol. 36, No. 7.

* cited by examiner

Prior Art

Prior Art

Prior Art

Prior Art

Prior Art

| | DFQ2(n) | DFQ1(n) | DFQ0(n) | DFQ2(n+1) | DFQ1(n+1) | DFQ0(n+1) |
|---|---|---|---|---|---|---|
| 0 | 0 | 0 | 0 | 0 | 0 | 1 |
| 1 | 0 | 0 | 1 | 0 | 1 | 0 |
| 2 | 0 | 1 | 0 | 0 | 1 | 1 |
| 3 | 0 | 1 | 1 | 1 | 0 | 0 |
| 4 | 1 | 0 | 0 | 1 | 0 | 1 |
| 5 | 1 | 0 | 1 | 0 | 0 | 0 |
| 6 | 1 | 1 | 0 | 0 | 0 | 1 |
| 7 | 1 | 1 | 1 | 0 | 0 | 0 |

Fig.23

| | DFQ3(n) | DFQ2(n) | DFQ1(n) | DFQ0(n) | DFQ3(n+1) | DFQ2(n+1) | DFQ1(n+1) | DFQ0(n+1) |
|---|---|---|---|---|---|---|---|---|
| 0 | 0 | 0 | 0 | 0 | 0 | 0 | 0 | 1 |
| 1 | 0 | 0 | 0 | 1 | 0 | 0 | 1 | 0 |
| 2 | 0 | 0 | 1 | 0 | 0 | 0 | 1 | 1 |
| 3 | 0 | 0 | 1 | 1 | 0 | 1 | 0 | 0 |
| 4 | 0 | 1 | 0 | 0 | 0 | 1 | 0 | 1 |
| 5 | 0 | 1 | 0 | 1 | 0 | 1 | 1 | 0 |
| 6 | 0 | 1 | 1 | 0 | 0 | 1 | 1 | 1 |
| 7 | 0 | 1 | 1 | 1 | 1 | 0 | 0 | 0 |
| 8 | 1 | 0 | 0 | 0 | 1 | 0 | 0 | 1 |
| 9 | 1 | 0 | 0 | 1 | 1 | 0 | 1 | 0 |
| 10 | 1 | 0 | 1 | 0 | 1 | 0 | 1 | 1 |
| 11 | 1 | 0 | 1 | 1 | 0 | 0 | 0 | 0 |
| 12 | 1 | 1 | 0 | 0 | 0 | 0 | 0 | 1 |
| 13 | 1 | 1 | 0 | 1 | 0 | 0 | 0 | 0 |
| 14 | 1 | 1 | 1 | 0 | 0 | 0 | 0 | 1 |
| 15 | 1 | 1 | 1 | 1 | 0 | 0 | 0 | 0 |

Fig.28

REFERENCE VOLTAGE GENERATION CIRCUIT

CROSS REFERENCE TO RELATED APPLICATION

This application is based upon and claims the benefit of priority from Japanese Patent Application No. 2006-127970, filed on May 1, 2006, the entire contents of which are incorporated herein by reference.

BACKGROUND OF THE INVENTION

1. Field of the Invention

The present invention relates to a reference voltage generation circuit that outputs a reference voltage which does not depend on temperature.

2. Description of the Related Art

A reference voltage generation circuit called a bandgap circuit is generally in wide use for providing a reference voltage dependent neither on temperature nor on a power-supply voltage. For example, the bandgap circuit adds a voltage of a forward-biased pn junction and a PTAT (Proportional To Absolute Temperature) voltage that is proportional to absolute temperature (T). It is known that the voltage of the forward-biased pn junction, if approximated by a linear expression, exhibits negative linear dependency on absolute temperature (hereinafter, also referred to as CTAT (Complementary To Absolute Temperature). Therefore, adding the voltage of the forward-biased pn junction and a proper PTAT voltage results in the reference voltage not dependent on temperature. As a bandgap circuit of this type, various kinds of circuits have been devised and put into practical use (for example, see FIG. 5 in M. C. Weng et al., "Low Cost CMOS On-Chip and Remote Temperature Sensors", IEICE Transactions on Electronics, Vol. E84-C, No. 4, pp. 451-459, April 2001, and FIG. 1 of U.S. Pat. No. 6,462,612 B1).

FIG. 1 shows an example of a typical bandgap circuit. The bandgap circuit in FIG. 1 includes pnp bipolar transistors Q1, Q2 (hereinafter, the bipolar transistors are also referred to as BJT), resistors R1*a*, R2*a*, R3*a* (resistance values thereof are also denoted by R1*a*, R2*a*, R3*a*), and an operational amplifier AMP1*a*. GND is a GND voltage, BGROUT is an output reference voltage, and NODE1, IMa, and IPa are internal nodes. Values accompanying the resistors are examples of the resistance values. Numerals (×1, ×10) accompanying the BJTQ1, Q2 represent an example of a relative area ratio of the BJT Q1, Q2.

A base-emitter voltage of a transistor or a forward voltage Vbe of a pn junction is given by the expression (1).

$$Vbe=Veg-a\cdot T \tag{1}$$

Here, Veg is a bandgap voltage of silicon, T is absolute temperature, a is a temperature coefficient of the forward voltage Vbe. A value of a depends on a bias current of the pn junction. However, in a practical field, the value of a is known to be about 2 mV/° C. Further, the bandgap voltage Veg is about 1.2 V.

The relation of an emitter current IE of a BJT and the forward voltage Vbe is given by the expression (2). Here, IS is a constant proportional to an emitter area of a transistor, q is a charge of an electron, and k is a Boltzmann constant.

$$IE=IS\cdot\exp\{q\cdot Vbe/(k\cdot T)\} \tag{2}$$

When a voltage gain of the operational amplifier AMP1*a* is sufficiently large, voltages of the inputs IMa and IPa of the operational amplifier AMP1*a* are equal owing to negative feedback by the operational amplifier AMP1*a*. If a ratio of the resistance values of the resistors R1*a*, R2*a* is, for example, 1:10 (100k:1M) as shown in FIG. 1, a ratio of magnitudes of currents flowing to the BJTQ1, Q2 is 10:1. If the current flowing through the BJTQ2 is I, the current flowing through the BJTQ1 is I×10. I×10 and I written under the BJTQ1, Q2 in FIG. 1 represent the relative relation between the currents flowing through the BJTQ1, Q2. If an emitter area ratio of the BJTQ1, Q2 is 1:10, a ratio of IS for the BJTQ1, Q2 in the expression (2) is 1:10. ×1, ×10 accompanying the BJTQ1, Q2 represent the relative relation of the emitter areas thereof.

Emitter currents of the BJTQ1, Q2 are given by the expressions (3), (4) respectively based on the expression (2), where Vbe1 is a base-emitter voltage of the BJTQ1 and Vbe2 is a base-emitter voltage of the BJTQ2. Performing the division of the both sides of the expressions (3), (4) gives the expression (5).

$$I\times 10=IS\cdot\exp\{q\cdot Vbe1/(k\cdot T)\} \tag{3}$$

$$I=IS\times 10\cdot\exp\{q\cdot Vbe2/(k\cdot T)\} \tag{4}$$

$$100=\exp\{q\cdot Vbe1/(k\cdot T)-q\cdot Vbe2/(k\cdot T)\} \tag{5}$$

A difference ΔVbe (ΔVbe=Vbe1−Vbe2) between the base-emitter voltages of the BJTQ1, Q2 is given by the expression (6).

$$\Delta Vbe=(k\cdot T/q)\cdot\ln(100) \tag{6}$$

The difference ΔVbe between the base-emitter voltages of the BJTQ1, Q2 is expressed by the expression (6), by using "ln(100)" and "(k·T/q)", "ln(100)" being a logarithm of a ratio of current densities of the BJTQ1, Q2, and "(k·T/q)" being a thermal voltage. This voltage ΔVbe is equal to a voltage across both ends of the resistor R3*a*, so that a current of ΔVbe/R3*a* flows through the resistors R2*a*, R3*a*. Therefore, a voltage VR2*a* across both ends of the resistor R2*a* is given by the expression (7).

$$VR2a=\Delta Vbe\cdot R2a/R3a \tag{7}$$

A voltage of the node IMa is equal to the forward voltage Vbe1 being a voltage of the node IPa, and therefore, an output reference voltage BGROUT is given by the expression (8).

$$BGROUT=Vbe1+\Delta Vbe\cdot R2a/R3a \tag{8}$$

The forward voltage Vbe1 of the pn junction decreases as temperature rises, that is, it has negative temperature dependency (see the expression (1)). On the other hand, the difference ΔVbe between the base-emitter voltages of the BJTQ1, Q2 increases in proportion to temperature (see the expression (6)). Therefore, if a constant is properly selected, the output reference voltage BGROUT has a value not dependent on temperature. The output reference voltage BGROUT at this time is about 1.2 V corresponding to the bandgap voltage of silicon.

The bandgap circuit shown in FIG. 1 is advantageous in that the reference voltage can be generated with a relatively simple circuit. However, in an actual integrated circuit, due to element variance, input voltages of an operational amplifier are not completely the same (this voltage difference between the inputs is called an offset voltage). The offset voltage depends on each operational amplifier. However, a typical offset voltage is known to be about +10 mV~about −10 mV. Therefore, the output reference voltage BGROUT is influenced by the offset voltage of the operational amplifier (AMP1*a* in FIG. 1) included in the bandgap circuit. That is, depending on the offset voltage of the operational amplifier included in the bandgap circuit, achieved accuracy of the output reference voltage BGROUT becomes low.

FIG. 2 shows an influence of the offset voltage of the operational amplifier in the circuit shown in FIG. 1. The same reference symbols are used to designate the same elements as the elements described in FIG. 1, and detailed description thereof will be omitted. A bandgap circuit in FIG. 2 includes an ideal operational amplifier IAMP1 in place of the operational amplifier AMP1*a* in FIG. 1. Further, an offset voltage VOFF (a value of the offset voltage VOFF is also denoted by VOFF) corresponding to the offset voltage of the operational amplifier AMP1*a* is added to one input side of the ideal operational amplifier IAMP1. IIM in FIG. 2 is an input terminal on the one side of the ideal operational amplifier IAMP1.

If the offset voltage of the ideal operational amplifier IAMP1 is 0 mV, the offset voltage VOFF of the operational amplifier influences the output reference voltage BGROUT in the following manner. In the ideal circuit in FIG. 1, the voltages of the node IMa and the node IPa are equal. On the other hand, in an actual circuit, voltages of the input IIM and a node IPa of the ideal operational amplifier IAMP1 are equal. Therefore, a voltage of a node IMa is the sum of the voltage of the node IPa and the offset voltage VOFF. The voltage of the node IMa, which is denoted by VIMa, is given by the expression (9).

$$VIMa=Vbe1+VOFF \tag{9}$$

From the expression (9), a voltage VR3*a* applied to a resistor R3*a* in FIG. 2 is given by the expression (10).

$$VR3a=\Delta Vbe+VOFF \tag{10}$$

From the expression (10), a voltage VR2*a* across both ends of a resistor R2*a* is given by the expression (11).

$$VR2a=(\Delta Vbe+VOFF)\cdot R2a/R3a \tag{11}$$

From the expression (11), the output reference voltage BGROUT is given by the expression (12).

$$BGROUT=Vbe1+VOFF+(\Delta Vbe+VOFF)\cdot R2a/R3a \tag{12}$$

In the example in FIG. 2, a resistance ratio R2*a*/R3*a* is "5", and therefore, the output reference voltage BGROUT is the sum of an ideal value and the offset voltage multiplied by six.

In order to reduce the influence of the offset voltage VOFF, in the examples in FIG. 1 and FIG. 2, the area of the BJTQ2 is made ten times as large as the area of the BJTQ1, and the current flowing through the BJTQ1 is made ten times as large as the current flowing through the BJTQ2. Consequently, the difference ΔVbe between the base-emitter voltages of the BJTQ1, Q2 is about 120 mV, for example, when T=300K (see the expression (6)). Thus, the difference ΔVbe between the base-emitter voltages of the BJTQ1, Q2 has a large value relative to the offset voltage VOFF. However, also in this case, the offset voltage VOFF influences the output reference voltage BGROUT. For example, with T=300K, Vbe1=600 mV, and R2*a*/R3*a*=5, the output reference voltage BGROUT is about 1200 mV (see the expression (6) and the expression (8)). At this time, a voltage six times (1+R2*a*/R3*a*) as high as the offset voltage VOFF is added in the output reference voltage BGROUT (see the expression (12)). The value of the output reference voltage BGROUT shown in FIG. 2 indicates the influence of this offset voltage.

To eliminate the influence of the offset voltage VOFF, there has been proposed a bandgap circuit (Chopper-stabilized BGR) adopting a chopper circuit (for example, FIG. 2 of U.S. Pat. No. 6,462,612B1, Japanese Unexamined Patent Application Publication No. Hei 11-143564, FIG. 6 in M. C. Weng et al., "Low Cost CMOS On-Chip and Remote Temperature Sensors", IEICE Transactions on Electronics, Vol. E84-C, No. 4, pp. 451-459, April 2001, FIG. 3 in Y. S. Shyu et al., "A 0.99 μA Operating Current Li-ion Battery Protection IC", IEICE Transactions on Electronics, Vol. E85-C, No. 5, pp. 1211-1215, May 2002, FIG. 4 in F. Fruett et al., "Minimization of the Mechanical-Stress-Induced Inaccuracy in Bandgap Voltage References", IEEE Journal of Solid-State Circuits, Vol. 38, No. 7, pp. 1288-1291, July 2003, and FIG. 3 in A. Bakker et al., "Micropower CMOS Temperature Sensor with Digital Output, "IEEE journal of Solid-State Circuits, Vol. 31, No. 7, pp. 933-937, July 1996).

FIG. 3(*a*) and FIG. 3(*b*) show an operational principle of a conventional chopper-stabilized bandgap circuit. The same reference symbols are used to designate the same elements as the elements described in FIG. 2, and detailed description thereof will be omitted. A bandgap circuit in FIG. 3(*a*) is structured such that switches SW1*a*, SW2*a*, SW3*a*, SW4*a* and a low-pass filter LPF are added to the bandgap circuit in FIG. 2. An ideal operational amplifier IAMP2 is an ideal operational amplifier circuit, a reference voltage BGROUT is an output reference voltage, an output REFOUT is an output of the low-pass filter LPF, VOFF is an offset voltage, and NODE1, IMa, IPa, NODE2, and NODE3 are internal nodes. Signal names ϕ1, ϕ2 accompanying the switches SW1*a*-SW4*a* indicate periods during which the respective switches are on. The switches SW2*a*, SW3*a* are on during periods in which ϕ1 is H (High level) (hereinafter also referred to as ϕ1 periods), and the switches SW1*a*, SW4*a* are on during periods in which ϕ2 is H (hereinafter, also referred to as ϕ2 periods). FIG. 3(*b*) shows the relation between the timings of the signals ϕ1, ϕ2 and the output reference voltage BGROUT.

The bandgap circuit in FIG. 3(*a*) operates similarly to the bandgap circuit in FIG. 2 during the periods in which ϕ1 is H (ϕ1 period). As described in FIG. 2, for example, the sum of the ideal bandgap output and the offset voltage VOFF multiplied by 6 is outputted as the output reference voltage BGROUT. The output reference voltage BGROUT at this time is, for example, ideal value IDL (1200 mV)+6×VOFF. In the bandgap circuit in FIG. 3(*a*), by the switches SW1*a*-SW4*a*, the connection of nodes IMa, IPa to the nodes NODE2 and NODE3 is interchanged. That is, in the ϕ1 periods, the node IMa is connected to the node NODE2 and the node IPa is connected to the node NODE3, and in the ϕ2 periods, the node IMa is connected to the node NODE3 and the node IPa is connected to the node NODE2. Further, the ideal operational amplifier IAMP2 operates in such a manner that an input from a − input terminal of the ideal operational amplifier IAMP2 is defined as a − input in the ϕ1 periods and as a + input in the ϕ2 periods. Similarly, the ideal operational amplifier IAMP2 operates in such a manner that a + input of the ideal operational amplifier IAMP2 is defined as a + input in the ϕ1 periods and as a − input in the ϕ2 periods. Consequently, negative feedback by the ideal operational amplifier IAMP2 is realized also in the ϕ2 periods. Therefore, the output reference voltage BGROUT has a value of ideal value IDL (1200 mV)−6×VOFF in the ϕ2 periods. Consequently, the output reference voltage BGROUT in the ϕ1 periods has a value of ideal value IDL(1200 mV)+6×VOFF, and that in the ϕ2 periods has a value of ideal value IDL(1200 mV)−6×VOFF (FIG. 3(*b*)).

Further, the output reference voltage BGROUT that changes in synchronization with the signals ϕ1, ϕ2 is inputted to the low-pass filter LPF. The output REFOUT of the low-pass filter LPF becomes a reference voltage not including an error ascribable to the offset voltage VOFF. Specifically, in the bandgap circuit in FIG. 3(*a*), the error ascribable to the offset is converted into an AC component by using the signals ϕ1, ϕ2, and an error component is removed by the low-pass filter LPF. Consequently, the chopper-stabilized bandgap circuit outputs an ideal reference voltage.

FIG. 4 shows an example of a concrete circuit configuration of the chopper-stabilized bandgap circuit. The same reference symbols are used to designate the same elements as the elements described in FIG. 3(*a*) and FIG. 3(*b*), and detailed description thereof will be omitted. In the bandgap circuit in FIG. 4, an operational amplifier circuit operating as a chopper amplifier includes nMOS transistors NM1*a*, NM2*a*, NM3*a*, pMOS transistors PM1*a*, PM2*a*, PM3*a*, PM4*a*, and switches SW1*a*-SW8*a*. In FIG. 4, VDD is a power-supply voltage, a bias voltage PBIAS1*a* is a bias voltage, and nodes NODE1, IMa, IPa, NODE2, NODE3, ND1, ND2, NG1, NG2 are internal nodes. Signal names ϕ1, ϕ2 accompanying the switches SW1*a*-SW8*a* indicate periods during which the respective switches are on. The switches SW2*a*, SW3*a*, SW5*a*, SW7*a* are on during periods in which ϕ1 is H, and the switches SW1*a*, SW4*a*, SW6*a*, SW8*a* are on during periods in which ϕ2 is H.

By the switches SW1*a*-SW4*a*, one of gates of the transistors PM2*a* and PM3*a* is connected to the node IMa and the other gate is connected to the node IPa. For example, in the ϕ1 periods, the gate of the transistor PM2*a* is connected to the node IMa and the gate of the transistor PM3*a* is connected to the node IPa. Further, since the switch SW5*a* is on, the transistor NM1*a* becomes a load of diode-connection. Further, since the switch SW7*a* is on, a gate of the transistor NM3*a* is connected to the node ND2. In the ϕ2 periods, the gate of the transistor PM3*a* is connected to the node IMa. Further, since the switches SW6*a*, SW8*a* are on, the transistor NM2*a* becomes a load of diode-connection, and the gate of the transistor NM3*a* is connected to the node ND1. Therefore, both in the ϕ1 periods and the ϕ2 periods, negative-feedback loop is formed. The + input and the − input of the operational amplifier including the transistors PM2*a*, PM3*a* and the transistors NM1*a*, NM2*a* are interchanged in the ϕ1 periods and the ϕ2 periods. Consequently, offset voltages of the operational amplifier in the ϕ1 periods and the ϕ2 periods have values substantially equal to each other with opposite signs. Therefore, on average, the offset voltage does not occur.

The bandgap circuit adopting the chopper circuit shown in FIG. 3(*a*) and FIG. 4 reduces an error of the output reference voltage BGROUT ascribable to the offset voltage of the operational amplifier.

In FIG. 4, the configuration example in which the chopper circuit is adopted as a standard 2-stage amplifier is shown. Besides, also known is a bandgap circuit adopting a chopper circuit as a folded cascode circuit (for example, FIG. 4 in F. Fruett et al., "Minimization of the Mechanical-Stress-Induced Inaccuracy in Bandgap Voltage References, "IEEE journal of Solid-State Circuits, Vol. 38, No. 7, pp. 1288-1291, July 2003, and FIG. 11 in A. Bakker et al., "A CMOS Nested-Chopper Instrumentation Amplifier with 100-nV Offset", IEEE Journal of Solid-State Circuits, Vol. 35, No. 12, pp. 1877-1883, December 2000).

FIG. 5(*a*) to FIG. 5(*c*) show an example of a circuit adopting a chopper circuit as a folded cascode circuit. The folded cascode circuit in FIG. 5(*a*) includes nMOS transistors NM4*a*, NM5*a*, NM6*a*, NM7*a*, pMOS transistors PM5*a*, PM6*a*, PM7*a*, PM8*a*, PM9*a*, PM10*a*, PM11*a*, and chopper part circuits CHS1, CHS2, CHS3. In FIG. 5(*a*), VDD is a power-supply voltage, GND is a GND voltage, input nodes IN1, IN2 are input terminals of the amplifier, an output node OUT is an output terminal of the amplifier, nodes ND3, ND4, PG1 are internal nodes, bias voltages PBIAS2*a*, PBIAS3*a* are bias voltages of the pMOS transistors, bias voltages NBIAS1*a*, NBIAS2*a* are bias voltages of the nMOS transistors. FIG. 5(*b*) shows a configuration of the chopper part circuits CHS1-CHS3. Each of the chopper part circuits CHS1-CHS3 includes switches SWC1, SWC2, SWC3, SWC4. Signals ϕ1, ϕ2 accompanying the switches SWC1-SWC4 indicate periods during which the respective switches are on. Each of the switches is on during periods in which the corresponding signal is H and is off during periods in which the corresponding signal is L (Low level). FIG. 5(*c*) shows an example of timings of the signals ϕ1, ϕ2.

The chopper part circuits CHS1-CHS3 are circuits that select whether two signals are to be transmitted straight or in an intersecting manner (by interchanging the signals). That is, in periods in which the signals are transmitted straight (the periods in which the signal ϕ1 is H), a node NODEC1 and a node NODEC3 are connected, and a node NODEC2 and a node NODEC4 are connected. In periods in which the signals are transmitted in the intersecting manner (the periods in which the signal ϕ2 is H), the node NODEC1 and the node NODEC4 are connected and the node NODEC2 and the node NODEC3 are connected. The chopper part circuits CHS1-CHS3 interchange the relation of all the signals in the periods in which the signals are transmitted straight and in the periods in which the signals are transmitted in the intersecting manner. Therefore, the folded cascode circuit in FIG. 5(*a*) operates with the same polarity in the periods in which the signals are transmitted straight and in the periods in which the signals are transmitted in the intersecting manner.

In the above, a description is made on a design of the conventional circuit contrived to reduce the influence that the offset voltage of the operational amplifier gives to the output voltage of the bandgap circuit. But the output voltage of the bandgap circuit is influenced not only by the offset voltage of the operational amplifier but also by an error in resistors or in the base-emitter voltages Vbe of pnp bipolar transistors. In order to reduce the error in the resistors or in the base-emitter voltages Vbe of the pnp bipolar transistors, trimming has been generally performed (for example, FIG. 2 in Japanese Unexamined Patent Application Publication No. 2001-217393, FIG. 3 in Japanese Unexamined Patent Application Publication No. Hei 10-260746, FIG. 5 in National Publication No. Hei 10-508401, FIG. 1 in Japanese Unexamined Patent Application Publication No. Hei 9-260589, FIG. 1 in Japanese Unexamined Patent Application Publication No. 2004-341877, FIG. 9 of U.S. Pat. No. 6,590,372B1, and FIG. 4 of U.S. Pat. No. 6,812,684B1). For example, as a method of resistor trimming, there has been known a method of adjusting the total resistance value by parallel-connecting sets of a resistor and a fuse connected in series and cutting the fuses by a laser or the like (for example, FIG. 6 in G. C. M. Meijer et al., "Temperature Sensors and Voltage References Implemented in CMOS Technology", IEEE Sensors Journal, Vol, 1, No. 3, pp. 225-234, October 2001). Further, as a method called Zener zapping, there has been known a method in which sets of a resistor and a Zener device connected in parallel are connected in series and the Zener devices are broken in order to lower the resistance of the Zener devices, thereby adjusting the total resistance value.

FIG. 6 shows an example of a bandgap circuit adopting a circuit for trimming the area of transistors. The same reference symbols are used to designate the same elements as the elements described in FIG. 1, and detailed description thereof will be omitted. The bandgap circuit in FIG. 6 is structured such that the resistor R1*a* and the operational amplifier AMP1*a* are removed from the bandgap circuit in FIG. 1 and an operational amplifier AMP2*a*, pMOS transistors PM12*a*, PM13*a*, transistors Q2*a*, Q2*b*, Q2*c*, and switches SW10*a*, SW11*a*, SW12*a* are added thereto.

In order to generate a bandgap voltage, a PTAT voltage generated based on a difference ΔVbe between base-emitter voltages of BJTQ1, Q2 is added to a base-emitter voltage Vbe1 of the BJTQ1, as described by the expression (8). However, in an actual integrated circuit, a value of the base-emitter voltage Vbe itself of a transistor varies due to fluctuation in manufacturing conditions. The difference ΔVbe between Vbe of pnp bipolar transistors also varies due to fluctuation in manufacturing conditions. However, this variance is smaller than the variance in the absolute value of the base-emitter voltage Vbe of a transistor. Due to these variances, the bandgap voltage expressed by the expression (8) deviates from a design value. In order to reduce an error of the output voltage of the bandgap circuit due to these variances, the total area of the BJTQ2, Q2*a*, Q2*b*, Q2*c* is adjusted. For example, after the manufacturing, in order to adjust the PTAT voltage, the total area of the BJTQ2*a*, Q2*b*, Q2*c* that are connected in parallel to the BJTQ2 is adjusted by the switches SW10*a*-SW12*a*. Consequently, it is possible to adjust the output voltage of the bandgap circuit.

Further, in a bandgap circuit using MOS transistors, a value of an output voltage is also influenced by matching of the MOS transistors. As a method of improving the matching of the MOS transistors, dynamic element matching has been known (for example, FIG. 9 in G. C. M. Meijer et al., "Temperature Sensors and Voltage References Implemented in CMOS Technology", IEEE Sensors journal, Vol. 1, No. 3, pp. 225-234, October 2001, FIG. 2 in RJ. Van De Plassche, "Dynamic Element Matching for High-Accuracy Monolithic D/A Converters", IEEE Journal of Solid-State Circuits, Vol. SC-11, No. 6, pp. 795-800, December 1976, and V. G. Ceekala et al., "A Method for Reducing the Effects of Random Mismatches in CMOS Bandgap References", ISSCC Digest of Technical Papers, pp. 23. 7, Feb. 2002).

FIG. 7(*a*) and FIG. 7(*b*) show an operational principle of a dynamic element matching circuit. The circuit in FIG. 7(*a*) includes PMOS transistors PM14*a*, PM15*a*, PM16*a* and switches SW13*a*-SW21*a*. VDD is a power-supply voltage, a bias voltage PBIAS4*a* is a bias voltage supplied commonly to gates of the transistors PM14*a*-PM16*a*, nodes NODE4-NODE9 are node names given for description, currents I1, I2, I3 are currents flowing through the nodes NODE7, NODE8, NODE9 respectively. Signals ϕ1*a*, ϕ2*a*, ϕ3*a* accompanying the switches SW13*a*-SW21*a* indicate periods in which the respective switches are on. The switches SW13*a*-SW2*a* are on during periods in which the respective signals ϕ1*a*, ϕ2*a*, ϕ3*a* are H, and are off during periods in which the respective signals ϕ1*a*, ϕ2*a*, ϕ3*a* are L. FIG. 7(*b*) shows the relation between the signals ϕ1*a*, ϕ2*a*, ϕ3*a* and the currents I1, I2, I3.

The principle of the dynamic element matching will be described by using FIG. 7(*a*) and FIG. 7(*b*). Ideally, currents of the transistors PM14*a*, PM15*a*, PM16*a* are equal when the transistors PM14*a*, PM15*a*, PM16*a* are made equal in a ratio W/L of a gate width W and a gate length L. However, in an actual integrated circuit, due to manufacturing variance, a threshold voltage Vth differs depending on each element. Therefore, even if MOS transistors are designed so as to be equal in the ratio W/L of the gate width W and the gate length L, current values thereof are not equal to one another. The dynamic element matching makes the values of the three currents I1, I2, I3 equivalently equal to one another by switching the transistors PM14*a*, PM15*a*, PM16*a* at equal time intervals. This signifies that, by time-averaging the currents, average currents of different values of currents can be equated".

A description will be given on assumption that, for example, a current value of the transistor PM14*a* is 1.10, a current value of the transistor PM15*a* is 1.05, and a current value of the transistor PM16*a* is 0.85. When the signal ϕ1 is H, a value of the current I1 is the current value of the transistor PM14*a*, a value of the current I2 is the current value of the transistor PM15*a*, and a value of the current I3 is the current value of the transistor PM16*a*. When the signal ϕ2 is H, the value of the current I1 is the current value of the transistor PM15*a*, the value of the current I2 is the current value of the transistor PM16*a*, and the value of the current I3 is the current value of the transistor PM14*a*. When the signal ϕ3 is H, the value of the current I1 is the current value of the transistor PM16*a*, the value of the current I2 is the current value of the transistor PM14*a*, and the value of the current I3 is the current value of the transistor PM15*a*. Consequently, the current I1 exhibits a current waveform such that the current value thereof changes at equal time intervals in order of 1.10 (the current of the transistor PM14*a*), 1.05 (the current of the transistor PM15*a*), and 0.85 (the current of the transistor PM16*a*). Therefore, the average current of the current I1 comes to have an average value of the currents of the transistors PM14*a*, PM15*a*, PM16*a*. Likewise, the average current of each of the currents I2, I3 also comes to have the average value of the currents of the transistors PM14*a*, PM15*a*, PM16*a*. In this manner, even current sources (the transistors PM14*a*, PM15*a*, PM16*a*) whose current values are not completely the same are used, the averages of currents (the currents I1, I2, I3) flowing through branches thereof can be made equal to one another.

FIG. 8 shows another example of a typical bandgap circuit. In FIG. 1, the most standard circuit configuration is shown, but various configurations have been proposed as a configuration realizing the bandgap circuit (for example, U.S. Pat. No. 6,563,371B2, U.S. Pat. No. 6,489,835B1, U.S. Pat. No. 6,853,164B1, U.S. Pat. No. 6,366,071B1, U.S. Pat. No. 6,181,121B1, U.S. Pat. No. 6,147,548, U.S. Pat. No. 5,325,045, Japanese Patent Publication No. 3420536, and Japanese Unexamined Patent Application Publication No. Hei 11-134048). The circuit in FIG. 8 is one example among them. The same reference symbols are used to designate the same elements as the elements described in FIG. 6, and detailed description thereof will be omitted.

The bandgap circuit in FIG. 8 is structured such that the resistor R2*a*, the switches SW10*a*-SW12*a*, and the pnp transistors Q2*a*, Q2*b*, Q2*c* are removed from the bandgap circuit in FIG. 6 and operational amplifiers AMP3*a*, AMP4*a*, resistors R4*a*, R5*a* (resistance values thereof are also denoted by R4*a*, R5*a*), and pMOS transistors PM17*a*-PM20*a* are added thereto. Nodes AMPOUT1*a*, AMPOUT2*a*, AMPOUT3*a*, NODE10, and NODE11 are internal nodes. A size (area) ratio of BJTQ1, Q2 in FIG. 8 is, for example, 1:10.

The operation of the circuit in FIG. 8 will be described on assumption that the transistors PM12*a*, PM13*a*, and PM17*a* are equal in a ratio W/L of a gate width Wand a gate length L and currents with the same value flow therethrough. Owing to negative feedback by an operational amplifier AMP2*a*, a voltage of the node AMPOUT1*a* is determined to a voltage that causes voltages of a node IMa and a node IPa to be equal to each other. Since the currents with the same value flow through the transistors PM12*a* and PM13*a*, a voltage across both ends of a resistor R3*a* is given by the expression (13).

$$\Delta Vbe=(k\cdot T/q)\cdot\ln(10) \quad (13)$$

That is, currents proportional to absolute temperature (PTAT currents) flow through the transistors PM12*a*, PM13*a*. Since a current of the transistor PM17*a* is also equal to the currents of the transistors PM12*a*, PM13*a*, a PTAT current flows also through the transistor PM17*a*.

Owing to negative feedback by the operational amplifier AMP3*a*, a voltage of the node AMPOUT2*a* is determined to a voltage that causes voltages of the node IPa and the node NODE10 to be equal to each other. Since the voltage of the node IPa is a base-emitter voltage Vbe1 of the BJTQ1, a voltage applied to the resistor R4*a* is also equal to the voltage Vbe1. Therefore, a current flowing through the transistor PM18*a* and the resistor R4*a* is Vbe1/R4*a*. Since the voltage Vbe1 has negative linear dependency on absolute temperature (CTAT: Complementary To Absolute Temperature), the current flowing through the transistor PM18*a* and the resistor R4*a* is also a CTAT current.

Here, it is assumed that the transistors PM18*a*, PM19*a* are equal in size, and currents equal to each other flow through the transistors PM18*a*, PM19*a*. The PTAT current flows through the transistor PM17*a*, while the CTAT current flows through the transistor PM19*a*. Consequently, a current equal to the sum of the PTAT current and the CTAT current flows to the resistor R5*a*. At a properly set ratio of the PTAT current and the CTAT current, the current resulting from the addition of the PTAT current and the CTAT current is not dependent on temperature. This current not dependent on temperature is converted to a voltage by the resistor R5*a*. Consequently, an output reference voltage BGROUT not dependent on temperature can be obtained.

Further, it is generally known that even with the same gate-source voltage, if drain voltages are different, drain currents do not have the same value due to, for example, a channel length modulation effect. The operational amplifier AMP4*a* and the transistor PM20*a* are intended for solving this current mismatch. Owing to a negative-feedback operation of the operational amplifier AMP4*a*, voltages of the node NODE11 and the node IPa are equal to each other. Accordingly, drain voltages of the transistors PM17*a*, PM12*a*, and PM13*a* are equal to one another. Likewise, drain voltages of the transistors PM18*a*, PM19*a* are also equal to the voltage of the node IPa. Therefore, the current mismatch among the transistors PM17*a*, PM12*a*, and PM13*a* and the current mismatch between the transistors PM18*a* and PM19*a* are solved.

As has been described hitherto, the circuit configuration of the bandgap circuit, namely, the reference voltage generation circuit, and the method for realizing the same are wide ranging.

The reference voltage generation circuit adopting the conventional chopper circuit or dynamic element matching circuit reduces the influence that the offset voltage of the operational amplifier and matching of the MOS transistors give to the output reference voltage. However, there is a problem that an error in the output reference voltage ascribable to variance in the resistors and the base-emitter voltages Vbe of the bipolar transistors is not solved. Moreover, the reference voltage generation circuit adopting the conventional trimming circuit can correct the error in the output reference voltage ascribable to variance in the resistors or the base-emitter voltages Vbe of the bipolar transistors. For example, it is possible to correct the output reference voltage by adjusting ΔVbe·R2*a*/R3*a* (PTAT voltage) in the expression (8) and the forward voltage Vbe1 of the pn junction or the CTAT voltage to desired values. However, with the conventional circuit configuration, it is not possible to independently measure the PTAT voltage or the CTAT voltage. In a case where the adjustment is thus made based on one output reference voltage resulting from the addition of two voltages, namely, the PTAT voltage and the CTAT voltage, measurement and adjustment are repeated under many temperatures until the values approximates expected values. Therefore, accurate correction of the output reference voltage in a short test time (namely, at low cost) is difficult. Further, the conventional resistor trimming circuit or the like has a special Zener diode, and it is necessary to apply a high voltage to break the Zener diode. Therefore, the conventional resistor trimming circuit cannot be applied in typical and low-cost CMOS processes.

SUMMARY OF THE INVENTION

It is an object of the present invention to provide a circuit for accurately correcting an output reference voltage of a reference voltage generation circuit at low cost.

The reference voltage generation circuit of the present invention includes a PTAT current generation unit having a first current source and a first transistor connected in series between a first power-supply line and a second power-supply line; and a second current source, a first resistor, and a second transistor connected in series between the first power-supply line and the second power-supply line. The PTAT current generation unit further has a first operational amplifier circuit having inputs connected to the first resistance node and the emitter of the first transistor respectively, and an output connected to control terminals of the first, second, and third current sources, in order to equate a voltage of a first resistance node being a connection node of the second current source and the first resistor, and a voltage of an emitter of the first transistor. Bases and collectors of the first and second transistors are connected to the second power-supply line. The second transistor operates with a current density different from a current density of the first transistor.

The reference voltage generation circuit of the present invention also includes a CTAT current generation unit having a fourth current source and a second variable resistor connected in series between the first power-supply line and the second power-supply line. The CTAT current generation unit further has a second operational amplifier circuit having inputs connected to the second resistance node and the emitter of the first transistor respectively, and an output connected to control terminals of the fourth and fifth current sources in order to equate a voltage of a second resistance node being a connection node of the fourth current source and the second variable resistor, and the voltage of the emitter of the first transistor.

The reference voltage generation circuit of the present invention also includes a current addition unit having the third current source, a first switch, and a first variable resistor connected in series between the first power-supply line and the second power-supply line. The current addition unit further has the fifth current source and a second switch connected in series between an output node, which is a connection node of the first switch and the first variable resistor, and the first power-supply line.

Moreover, the first switch is on in a first operation mode and a third operation mode and is off in a second operation mode. The second switch is on in the first operation mode and the second operation mode and is off in the third operation Mode. Consequently, the current flowing to the first variable resistor is a current equal to the sum of a PTAT current and a CTAT current in the first operation mode, the CTAT current in the second operation mode, and the PTAT current in the third operation mode. Therefore, switching the operation modes makes it possible to measure a PTAT voltage or a CTAT voltage independently. This accordingly enables the PTAT voltage or the CTAT voltage to be corrected independently by adjusting values of the first and second variable resistors. As a result, the use of the circuit of the present invention can achieve accurate correction of an output reference voltage of the reference voltage generation circuit at low cost.

BRIEF DESCRIPTION OF THE DRAWINGS

The nature, principle, and utility of the invention will become more apparent from the following detailed description when read in conjunction with the accompanying drawings in which like parts are designated by identical reference numbers, in which:

FIG. 23 is an explanatory chart showing truth values of a counter circuit in the circuit in FIG. 22;

FIG. 28 is an explanatory chart showing truth values of a counter circuit in the circuit generating control signals in FIG. 27;

DESCRIPTION OF THE PREFERRED EMBODIMENTS

Hereinafter, embodiments of the present invention will be described by using the drawings.

Figure 9A:
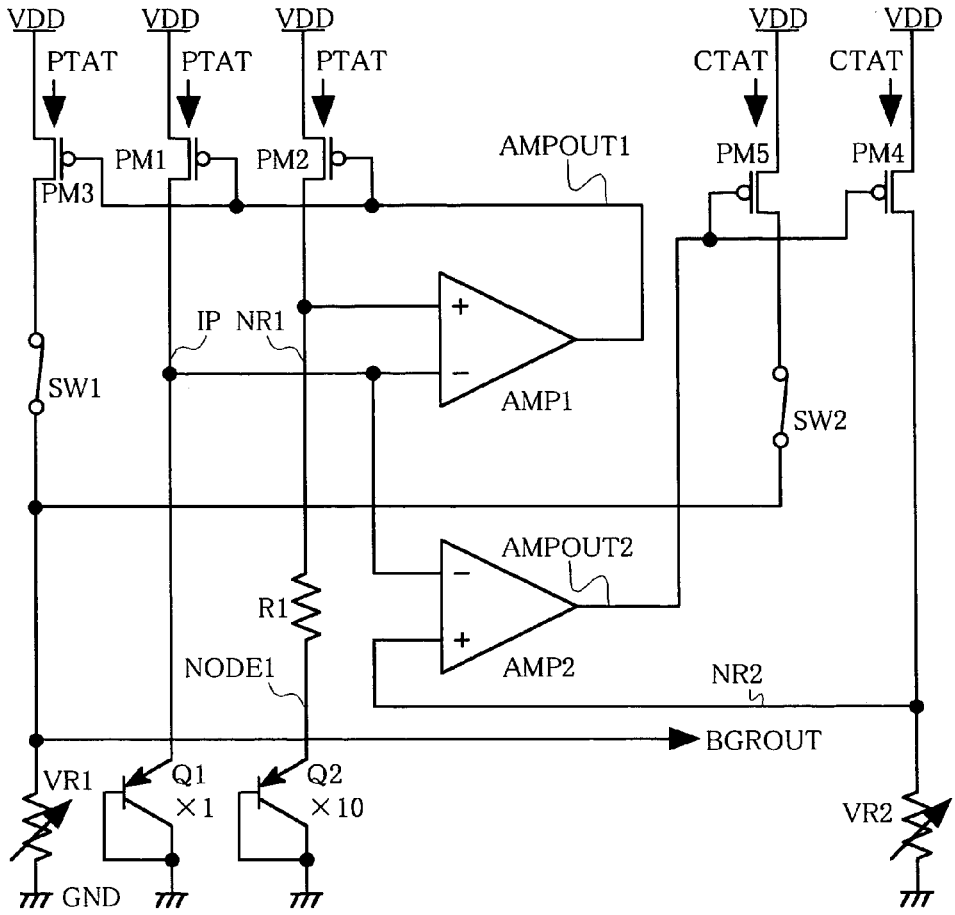
FIG. 9(*a*) and FIG. 9(*b*) are a circuit diagram and so on showing a first embodiment of a reference voltage generation circuit of the present invention.
Figure 9B:
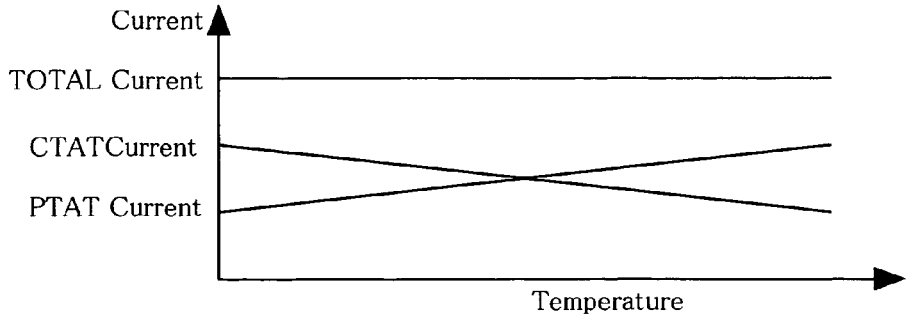

FIG. 9(*a*) and FIG. 9(*b*) show a first embodiment of the present invention. A reference voltage generation circuit has pMOS transistors PM1-PM5, pnp bipolar transistors Q1, Q2 (hereinafter, also referred to simply as Q1, Q2), a resistor R1 (a resistance value thereof will be also denoted by R1), variable resistors VR1, VR2 (resistance values thereof will be also denoted by VR1, VR2), operational amplifiers AMP1, AMP2, and switches SW1 and SW2. Sources of the transistors PM1-PM3 are connected to a VDD being a first power-supply line, gates thereof are connected to an output of the operational amplifier AMP1, and drains thereof are connected to a node IP being an emitter of the transistor Q1, the resistor R1, and the switch SW1 respectively. Sources of the transistors PM4 and PM5 are connected to the VDD, gates thereof are connected to an output of the operational amplifier AMP2, and drains thereof are connected to the variable resistor VR2 and the switch SW2 respectively. The operational amplifier AMP1 has a + input connected to a node NR1 being a connection node of the transistor PM2 and the resistor R1, and a − input connected to the node IP. The operational amplifier AMP2 has a + input connected to a node NR2 being a connection node of the transistor PM4 and the variable resistor VR2, and a − input connected to the node IP. One-side terminals of the variable resistors VR1, VR2 and bases and collectors of the transistors Q1, Q2 are grounded to a GND being a second power-supply line. The switches SW1 and SW2 are connected to the variable resistor VR1. A connection node of the switches SW1 and SW2 and the variable resistor VR1 is connected to an output terminal BGROUT. The transistor Q2 operates with a current density different from a current density of the transistor Q1 and an emitter thereof is connected to the resistor R1. The numerals (×1, ×10) accompanying the transistors Q1 and Q2 represent an example of a relative area ratio of the transistors Q1 and Q2. Further, in FIG. 9(*a*), the arrows with PTAT represent PTAT (Proportional To Absolute Temperature) currents that increase in proportion to absolute temperature, and the arrows with CTAT represent CTAT (Complementary To Absolute Temperature) currents that decrease in proportion to absolute temperature. FIG. 9(*b*) shows the correlation of the PTAT current, the CTAT current, and a TOTAL current being the sum of the PTAT current and the CTAT current vs. temperature.

In the first embodiment, the transistors PM1-PM3 are equal in a ratio W/L of a gate width W and a gate length L. Further, the operation of the reference voltage generation circuit in FIG. 9(*a*) will be described on assumption that the transistors PM4, PM5 are equal in a ratio W/L of a gate width W and a gate length L.

The operational amplifier AMP1 constitutes a negative-feedback circuit in order to make voltages of the node NR1 and the node IP equal to each other. Therefore, a voltage of an output AMPOUT1 of the operational amplifier AMP1 is determined to be a voltage causing the voltages of the node NR1 and the node IP to be equal to each other. For example, if an area ratio of the transistors Q1, Q2 is 1:10, the current densities of the transistors Q1, Q2 are different. Accordingly, a difference ΔVbe between base-emitter voltages of the transistor Q1, Q2 is given across both ends of the resistor R1. Therefore, the PTAT current that increases in proportion to the absolute temperature flows through the transistor PM2. Further, since the respective gates of the transistors PM1-PM3 are connected commonly to the node AMPOUT1, currents of the transistors PM1, PM3 are equal to the PTAT current flowing through the transistor PM2.

The operational amplifier AMP2 constitutes a negative-feedback circuit in order to make voltages of the node NR2 and the node IP equal to each other. Therefore, a voltage of an output AMPOUT2 of the operational amplifier AMP2 is determined to a voltage causing the voltages of the node NR2 and the node IP to be equal to each other. Since the voltage of the node IP is higher than the GND by the base-emitter voltage Vbe1 of the transistor Q1, the voltage of the node NR2 also is equal to the base-emitter voltage Vbe1 of the transistor Q1. Since the voltage of the node NR2 is the voltage Vbe1, the current flowing through the transistor PM4 is Vbe1/VR2. Therefore, the current flowing through the transistor PM4 becomes the CTAT current that decreases in proportion to the absolute temperature. Further, since the respective gates of the transistors PM4, PM5 are connected commonly to the node AMPOUT2, the current of the transistor PM5 is equal to the CTAT current flowing through the transistor PM4.

Here, during periods in which the switches SW1, SW2 are on (first operation mode), a current equal to the sum of the PTAT current and the CTAT current which are the currents of the respective transistors PM3 and PM5 flows to the variable resistor VR1. By properly adjusting a ratio of the PTAT current having positive dependency on the absolute temperature and the CTAT current having negative dependency on the absolute temperature, the total current flowing to the variable resistor VR1 comes to have no dependency on the temperature (FIG. 9(*b*)). The current flowing to the variable resistor VR1 is converted to a voltage and the resultant voltage is outputted as the reference voltage BGROUT of the reference voltage generation circuit from an output BGROUT. Since the total current flowing to the variable resistor VR1 has no dependency on temperature, the reference voltage BGROUT is a reference voltage having no dependency on temperature.

During periods in which the switch SW1 is off and the switch SW2 is on (second operation mode), only the CTAT current having negative dependency on the absolute temperature flows to the variable resistor VR1. Accordingly, a CTAT voltage resulting from the conversion of the CTAT current into a voltage is outputted to the output BGROUT. This CTAT voltage is adjusted by the variable resistor VR2. A deviation of the CTAT voltage is caused because a resistance value of the variable resistor VR2, a resistance value of the variable resistor VR1, and the base-emitter voltage Vbe1 of the transistor Q1 deviate from respective design values. For example, in a case where the base-emitter voltage Vbe1 of the transistor Q1 is higher than the design value, by making the variable resistor VR2 larger, it is possible to make the CTAT voltage approximate the design value. Further, in order to adjust the PTAT voltage to a desired value, the value of the variable resistor VR1 is determined. In a case where the value of the variable resistor VR1 is larger than the design value, a value of the variable resistor VR2 is increased to reduce the CTAT current. Consequently, the CTAT voltage is adjusted to a desired voltage.

During periods in which the switch SW1 is on and the switch SW2 is off (third operation mode), only the PTAT current having positive dependency on the absolute temperature flows to the variable resistor VR1. Consequently, a PTAT voltage resulting from the conversion of the PTAT current to a voltage is outputted to the output BGROUT. This PTAT voltage is adjusted by the variable resistor VR1. A deviation of the PTAT voltage is caused because the difference between the base-emitter voltages Vbe of the transistors Q1, Q2, the resistance value of the resistor R1, and the resistance value of the variable resistor VR1 deviate from respective design values. Further, a deviation of a characteristic due to a recombination current of the transistors Q1, Q2 and the like also causes the deviation of the PTAT voltage. For example, in a case of a characteristic such that the base-emitter voltages Vbe are not equal even if the transistors Q1 and Q2 are operated with the same current density, the voltage of the resistor R1 is increased (or decreased) by a voltage corresponding to the difference between the base-emitter voltages Vbe. Accordingly, the PTAT currents flowing to the transistors Q1 and Q2, that is, the PTAT currents flowing through the transistors PM1-PM3 deviate from design values. Even in such a case, by adjusting the variable resistor VR1, it is possible to adjust the PTAT voltage to a desired value. Even if the resistance value of the resistor R1 deviates from the design value, it is possible to adjust the PTAT voltage to a desired value by adjusting the variable resistor VR1. The major deviation of the PTAT voltage described above can be adjusted by the variable resistor VR1.

Figure 10:
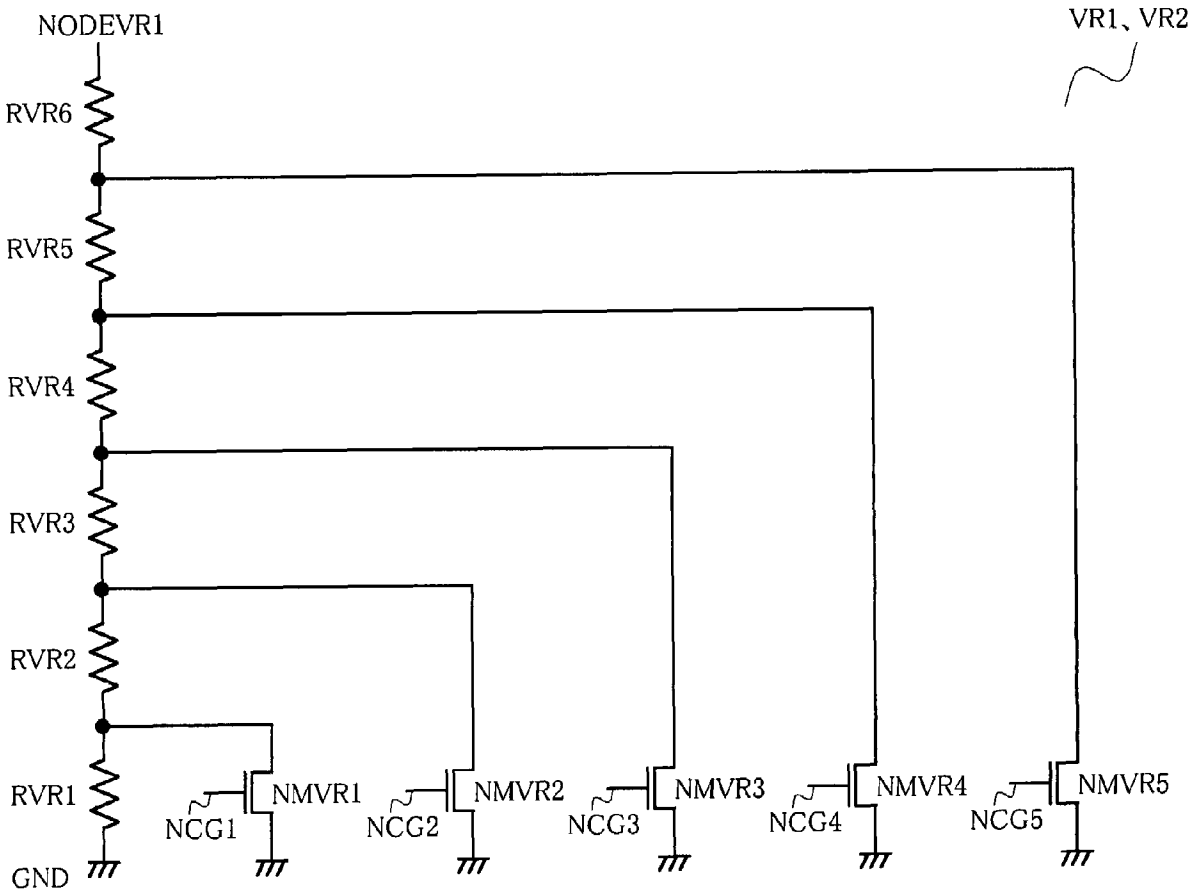
FIG. 10 is a circuit diagram of variable resistors VR1, VR2 in FIG. 9(*a*)

FIG. 10 shows an example of the variable resistors VR1 and VR2 in FIG. 9(*a*). Each of the variable resistors VR1 and VR2 has resistors RVR1-RVR6 and nMOS transistors NMVR1-NMVR5. The resistors RVR1-RVR6 are connected in series between a node NODEVR1 and the GND. Further, drains of the transistors NMVR1-NMVR5 are connected to connection nodes of the resistors RVR1-RVR6 respectively. Sources of the transistors NMVR1-NMVR5 are connected to the GND, and gates thereof are connected to terminals NCG1-NCG5 respectively. Since the sources of the transistors NMVR1-NMVR5 are connected to the GND, gate-source voltages of the transistors NMVR1-NMVR5 can be made high. Accordingly, on-resistances of the transistors NMVR1-NMVR5 can be reduced. Or, when the on-resistance is constant, areas of the transistors NMVR1-NMVR5 are smaller than an area of an nMOS transistor whose source is not connected to the GND.

By controlling the terminals NCG1-NCG5, the resistance value between the node NODEVR1 and the GND can be made variable. For example, when the transistors NMVR1-NMVR5 are off, resistors between the node NODEVR1 and the GND are serial resistors consisting of the resistors RVR1-RVR6. When the transistor NMVR2 is on and the transistor NMVR3-NMVR5 are off, resistors between the node NODEVR1 and the GND are serial resistors consisting of the resistors RVR3-RVR6.

In the entire circuit configuration of the reference voltage generation circuit of this embodiment, one-side ends of the variable resistors VR1 and VR2 are connected to the GND. This makes it possible to configure a variable resistor circuit by the nMOS transistors whose sources are grounded to the GND. Since the gate-source voltages of the nMOS transistors can be made high, the on-resistances of the nMOS transistors can be reduced. Or, when the on-resistance is constant, the areas of the nMOS transistors are smaller than areas of nMOS transistors whose sources are not connected to the GND. Therefore, by variable resistor circuits (the variable resistors VR1 and VR2) with a small area, the reference voltage BGROUT can be adjusted.

In the first embodiment described above, it is possible to output the PTAT voltage or the CTAT voltage directly from the output BGROUT by switching the operation modes. For example, the PTAT voltage and the CTAT voltage necessary for minimizing the temperature dependency of the reference voltage BGROUT at a given temperature (for example, room temperature 27° C.) can be found in advance through simulation or the like. Based on the comparison between the PTAT voltage found through the simulation or the like and a measured PTAT voltage, the PTAT voltage can be adjusted by the variable resistor VR1 so as to eliminate a difference between the both. Likewise, the CTAT voltage can also be adjusted by the variable resistor VR2. For example, in a case where two voltages (the PTAT voltage and the CTAT voltage) are adjusted based on only one voltage (a voltage equal to the sum of the PTAT voltage and the CTAT voltage), measurement and adjustment are repeated under many temperatures until values approximate to expected values are obtained. However, in the first embodiment, since the PTAT voltage and the CTAT voltage can be independently measured and adjusted, there is no need to repeat the measurement and adjustment under many temperatures. Further, the variable resistors VR1 and VR2 are realized by the nMOS transistors with a small area. Therefore, it is possible to accurately correct the output reference voltage of the reference voltage generation circuit at low cost.

Figure 11:
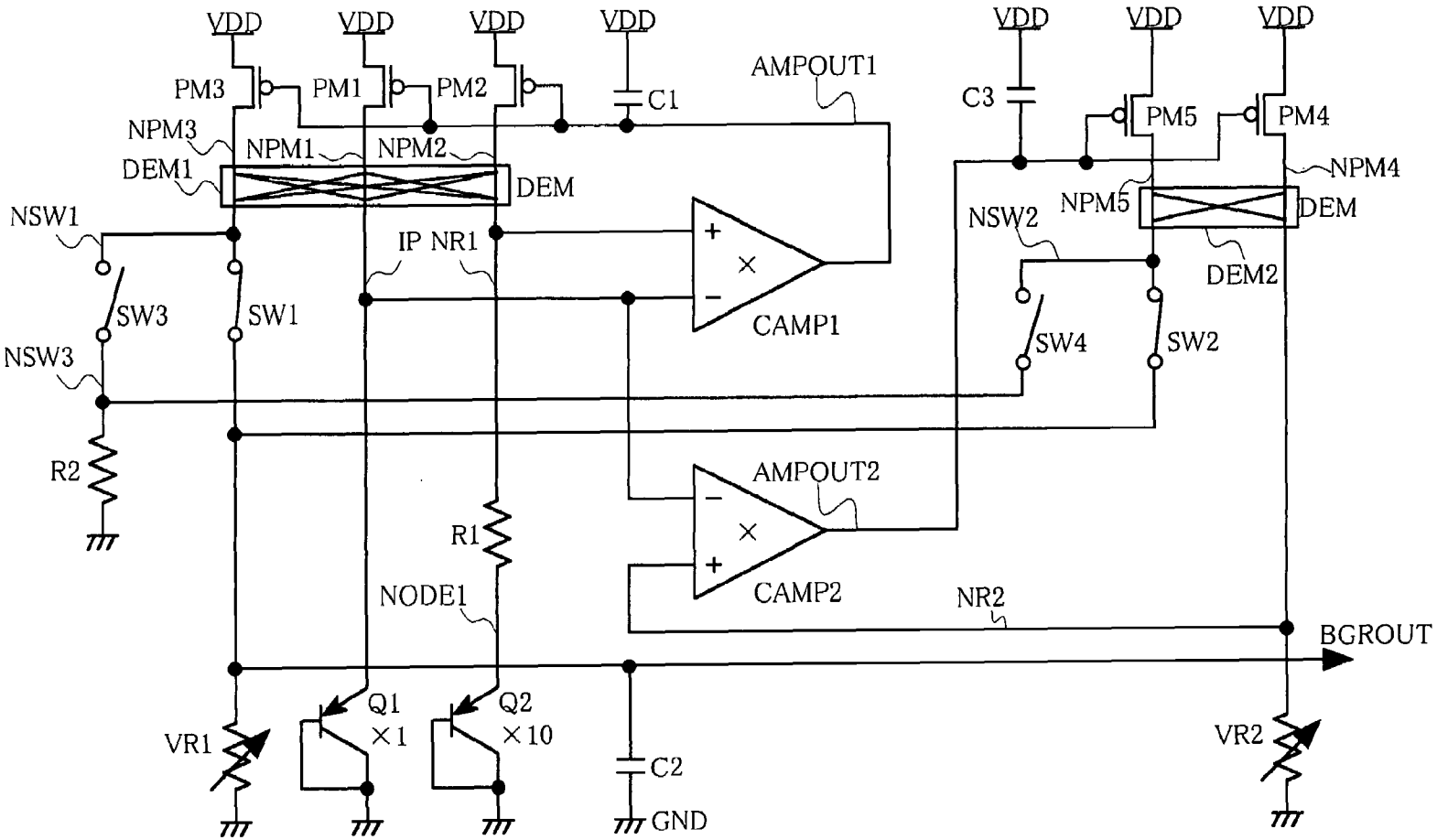
FIG. 11 is a circuit diagram showing a second embodiment of the reference voltage generation circuit of the present invention.

FIG. 11 shows a second embodiment of the present invention. The same reference symbols are used to designate the same elements as the elements described in the first embodiment, and detailed description thereof will be omitted. A reference voltage generation circuit of this embodiment is structured such that a resistor R2, switches SW3, SW4, capacitors C1-C3, and dynamic element matching circuits DEM1, DEM2 are added to the reference voltage generation circuit of the first embodiment. The operational amplifiers AMP1 and AMP2 of the first embodiment are replaced by chopper amplifiers CAMP1 and CAMP2. Nodes NPM1-NPM5 are internal nodes. The switch SW3 and the resistor R2 are connected in series between a node NSW1 and a GND, the node NSW1 being a connection node of the dynamic element matching circuit DEM1 and a switch SW1. The switch SW3 is off when the switch SW1 is on, and is on when the switch SW1 is off. The switch SW4 is connected between a node NSW2 and a node NSW3, the node NSW2 being a connection node of the dynamic element matching circuit DEM2 and a switch SW2. The node NSW3 is a connection node of the switch SW3 and the resistor R2. Further, the switch SW4 is off when the switch SW2 is on, and is on when the switch SW2 is off.

Figure 7A:
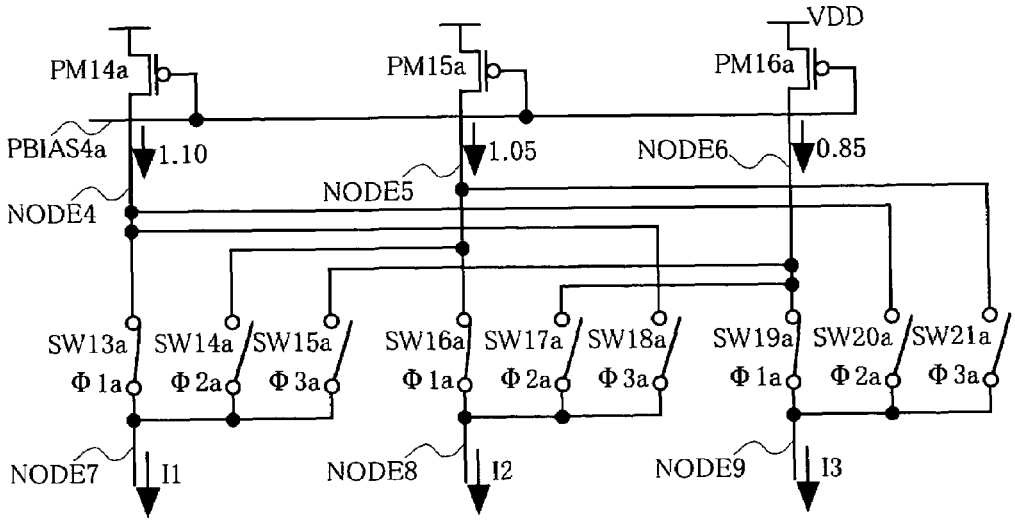
FIG. 7(*a*) and FIG. 7(*b*) are explanatory diagrams of an operational principle of a dynamic element matching circuit.
Figure 7B:
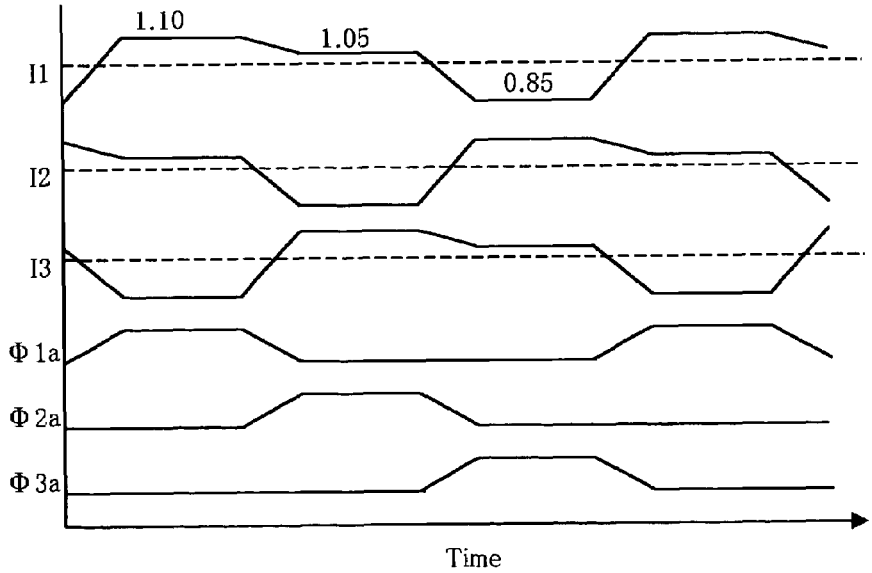
Figure 8:
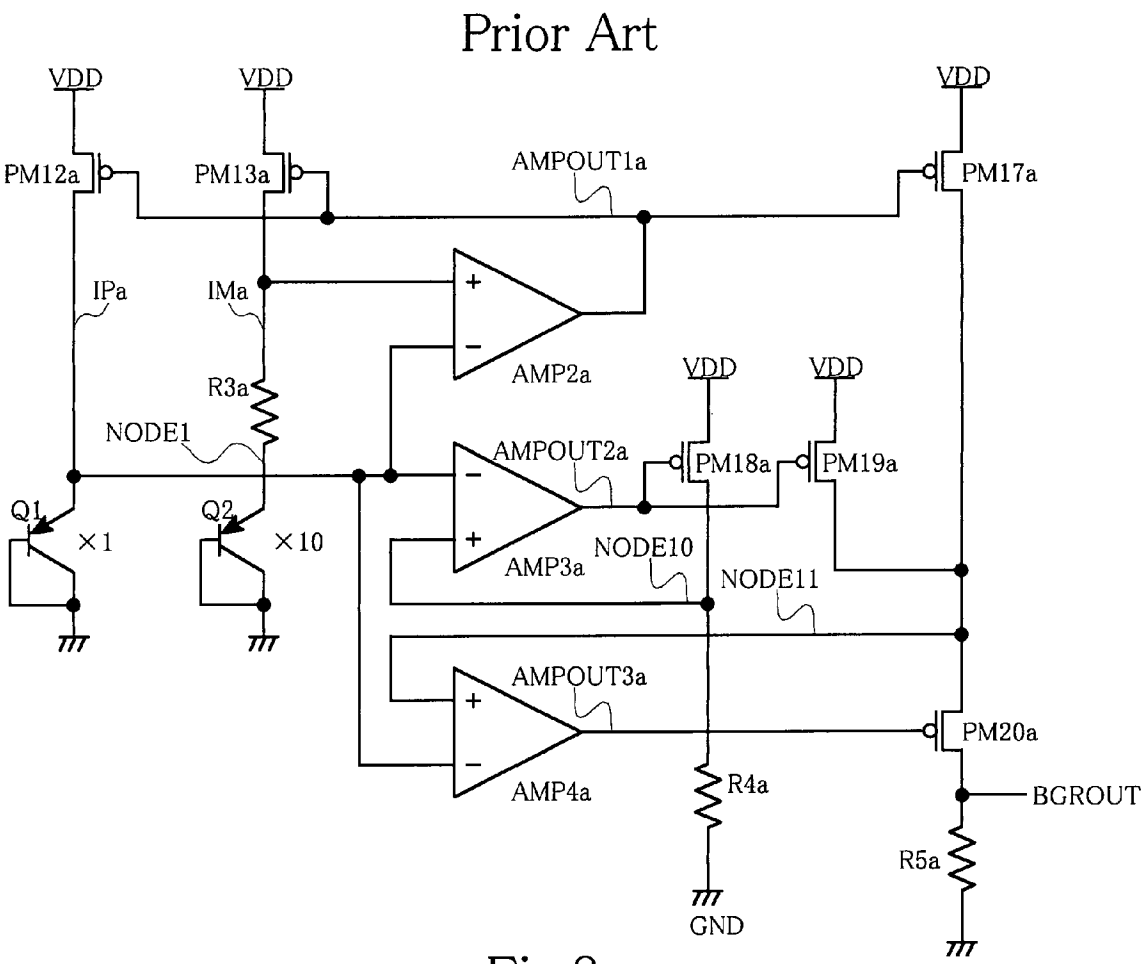
FIG. 8 is another circuit diagram of a typical bandgap circuit.
Figure 12A:
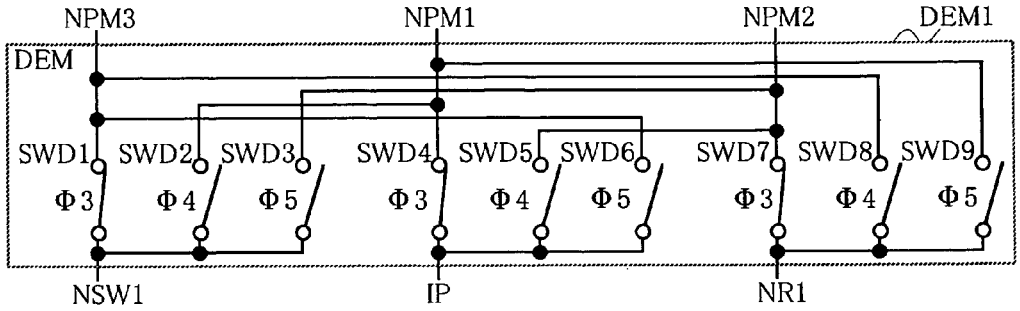
FIG. 12 (*a*) and FIG. 12(*b*) are a circuit diagram and so on of a dynamic element matching circuit DEM1.
Figure 12B:
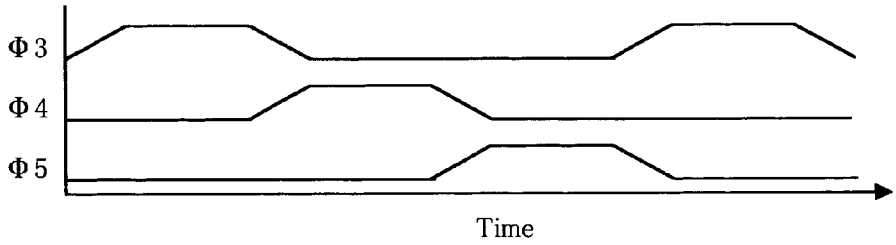

FIG. 12(*a*) shows an example of the dynamic element matching circuit DEM1 in FIG. 11. The dynamic element matching circuit DEM1 has switches SWD1-SWD9. Signals $\phi 3$, $\phi 4$, $\phi 5$ accompanying the switches SWD1-SWD9 indicate periods in which the respective switches are on. The switches SWD1-SWD9 are on during periods in which the respective signals are H, and are off during periods in which the respective signals are L. FIG. 12(*b*) shows a timing example of the signals $\phi 3$, $\phi 4$, $\phi 5$. As shown in FIG. 12(*b*), the signals $\phi 3$, $\phi 4$, $\phi 5$ are controlled so that one of these signals is H and the others are L. The operational principle of the dynamic element matching circuit is previously described in FIG. 7(*a*) and FIG. 7(*b*), and therefore detailed description thereof will be omitted.

Ideally, currents flowing through transistors PM1, PM2 and PM3 are equal even without using the dynamic element matching circuit. However, in an actual integrated circuit, due to manufacturing variance and the like, a threshold voltage Vth slightly differs depending on each element. Consequently, even if the transistors PM1, PM2, and PM3 are designed so as to be equal in a ratio W/L of a gate width W and a gate length L, current values of the transistors PM1, PM2, and PM3 do not become completely equal. In order to make average values of the currents flowing through the respective transistors PM1, PM2, and PM3 equal to one another, the reference voltage generation circuit of this embodiment has the dynamic element matching circuit DEM1. The currents of the transistors PM1, PM2, and PM3 flow to transistors Q1, Q2 and a variable resistor VR1 respectively via the dynamic element matching circuit DEM1. Therefore, the average values of the currents flowing to the transistors Q1, Q2 and the current flowing to the variable resistor VR1 via the switch SW1 become equal. Consequently, a PTAT voltage adjusted by the variable resistor VR1 becomes highly accurate.

For example, assuming a case where the dynamic element matching circuit DEM1 is not provided and the currents of the transistors PM1, PM2, PM3 flow directly to the variable resistor VR1 and the transistors Q1, Q2, a problem in this case will be clarified. Suppose that the currents of the transistors PM1, PM2, PM3 are not completely equal to one another due to manufacturing variance, and this is caused by, for example, a difference in the threshold voltage Vth among the transistors PM1, PM2, PM3. Suppose that a resistance value of the variable resistor VR1 is adjusted so that the PTAT voltage has a desired value at a given temperature, for example, room temperature. However, the currents of the transistors PM1, PM2, PM3 are not equal and the degree of the mismatch is subject to change in accordance with temperature change. The reason is that, if, for example, a cause of the mismatch of the currents lies in the difference in the threshold voltage Vth, a degree of change of the values of the currents under high temperature from that under room temperature differ due to the difference in the threshold voltage Vth. Moreover, even if the cause of the mismatch of the currents is, for example, the threshold voltage Vth, the difference itself in the threshold voltage Vth possibly changes depending on temperature. That is, even if the resistance value of the variable resistor VR1 is adjusted while the currents of the transistors PM1, PM2, PM3 are not equal, it cannot be expected in principle that the PTAT voltage comes to have a desired value in a wide temperature range. Further, as the cause itself of the current mismatch, there are many possible causes such as differences in channel length L, threshold voltage Vth, and channel width W, and it is practically impossible to adjust the PTAT voltage by predicting temperature characteristics thereof. After all, it is necessary to repeat measurement and adjustment under many temperatures, which is also cost-disadvantageous.

In this embodiment, the average values of the currents flowing to the transistors Q1, Q2 and the variable resistors VR1 are made equal by the dynamic element matching circuit DEM1. Consequently, even when the PTAT voltage is adjusted by adjusting the variable resistor VR1 at a given temperature, the PTAT voltage comes to have a value approximate to the design value in a wide temperature range. Therefore, the number of the measurement temperatures for the adjustment can be decreased, resulting in reduced cost for the adjustment.

Figure 13A:
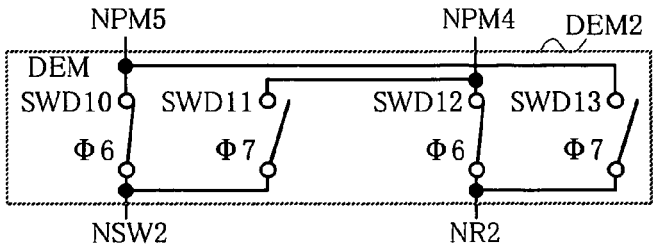
FIG. 13(*a*) and FIG. 13(*b*) are a circuit diagrams and so on of a dynamic element matching circuit DEM2.
Figure 13B:
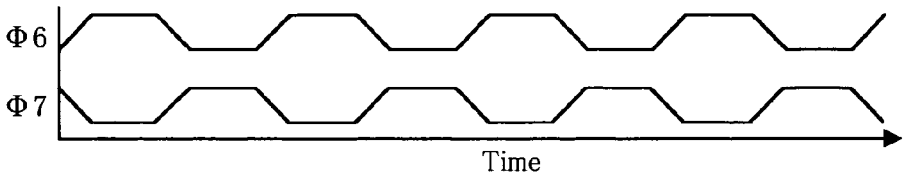

FIG. 13(*a*) shows an example of the dynamic element matching circuit DEM2 in FIG. 11. The dynamic element matching circuit DEM2 has switches SWD10-SWD13. Signals ϕ6, ϕ7 accompanying the switches SWD10-SWD13 indicate periods in which the respective switches are on. The switches are on during periods in which the respective signals are H, and are off during periods in which the respective signals are L. FIG. 13(*b*) shows a timing example of the signals ϕ6, ϕ7. As shown in FIG. 13(*b*), the signals ϕ6, ϕ7 are controlled so that one of these signals is H and the other signals is L. The dynamic element matching circuit DEM2 operates similarly to the dynamic element matching circuit DEM1. Therefore, average values of a current flowing to the variable resistor VR2 and a current flowing to the variable resistor VR1 via the switch SW2 are equal to each other. Consequently, even when a CTAT voltage is adjusted by adjusting the variable resistor VR2 at a given temperature, the CTAT voltage comes to have a value approximate to a design value in a wide temperature range. Therefore, it is possible to decrease the number of the measurement temperatures for the adjustment, resulting in reduced cost for the adjustment.

Figure 5A:
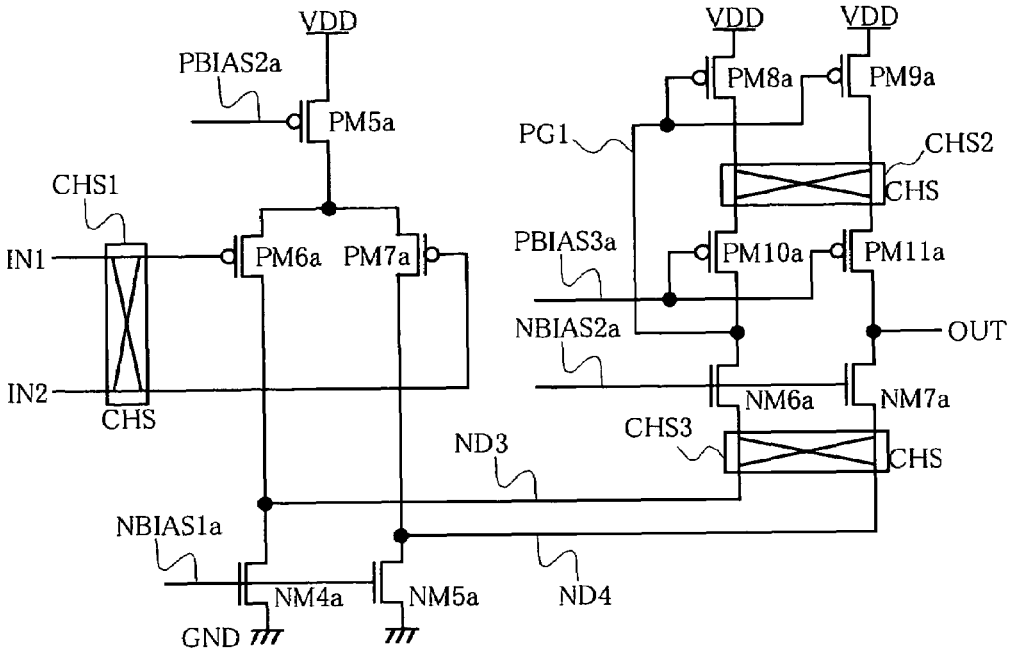
FIG. 5(*a*) to FIG. 5(*c*) are a circuit diagram and so on of a circuit adopting a chopper circuit as a folded cascode circuit.
Figure 5B:
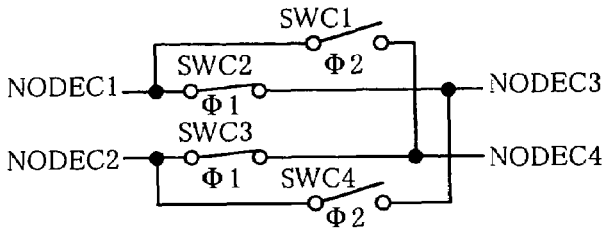
Figure 5C:
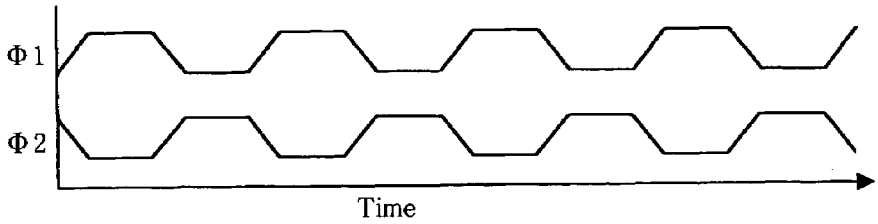
Figure 6:
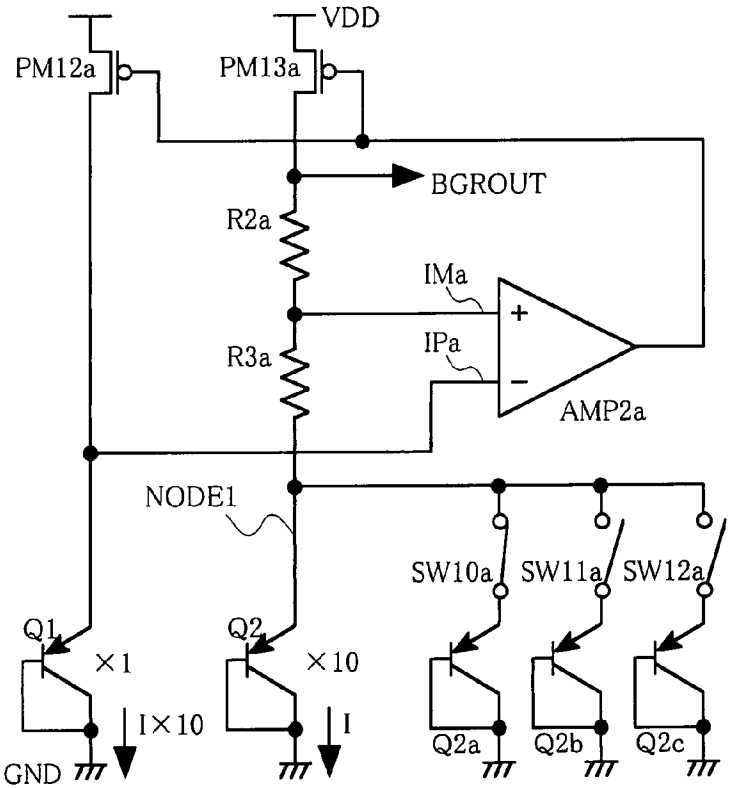
FIG. 6 is a circuit diagram showing a bandgap circuit adopting a trimming circuit.

Each of the chopper amplifiers CAMP1 and CMAP2 is constituted of, for example, a circuit adopting a chopper circuit as the aforesaid folded cascode circuit shown in FIG. 5(*a*). The operational principle is previously described in FIG. 5, and therefore detailed description will be omitted.

The chopper amplifier CAMP1 converts an offset voltage of the chopper amplifier CAMP1 to an AC signal and adds it to an ideal value which is a value when there is no offset voltage, and outputs the resultant to a node AMPOUT1. The offset voltage, which has been converted to the AC, included in the output of the chopper amplifier CAMP1 is removed by a low-pass filter LPF constituted of the capacitor C1. Consequently, the control over the node AMPOUT1 is equivalent to control by an ideal amplifier without any offset. Therefore, even with no offset voltage of the operational amplifier (the chopper amplifier CAMP1), the PTAT current can be prevented from deviating from a design value. For example, in a case where an influence that the offset voltage of the operational amplifier gives to the PTAT current is large, temperature dependency of the PTAT voltage is influenced by temperature dependency of the offset voltage. Therefore, if the temperature dependency of the PTAT voltage is expressed by a liner expression, a large error occurs. Therefore, in a case where the PTAT voltage is made to approximate the design value by adjusting the variable resistor VR1 at a given temperature, the PTAT voltage approximates the design value only in a narrow temperature range. However, in this embodiment, as described above, the chopper amplifier CAMP1 inhibits the influence that the offset voltage of the operational amplifier gives to the PTAT current. Therefore, when the PTAT voltage is made to approximate the design value by adjusting the variable resistor VR1 at a given temperature, the PTAT voltage comes to have a value approximate to the design value in a wide temperature range.

The chopper amplifier 2 and the capacitor C3 also work in a similar manner. Therefore, the CTAT current is prevented from deviating from the design value due to the influence of the offset voltage of the operational amplifier (the chopper amplifier CAMP2). Consequently, in a case where the CTAT voltage is made to approximate the design value by adjusting the variable resistor VR2 at a given temperature, the CTAT voltage comes to have a value approximate to the design value in a wide temperature range. Since the adjusted PTAT voltage and CTAT voltage come to have the values approximate to the design values in a wide temperature range, it is possible to adjust a reference voltage BGROUT only by the adjustment at one temperature. This realizes reduced cost for the adjustment.

The operation of the switch SW3 will be described. When the switch SW1 turns off, the switch SW3 turns on, so that average currents of the transistors PM1, PM2, and PM3 flow to the resistor R2. For example, in a case where only the switch SW1 is turned off (in a case where the switch SW3 is not provided or in a case where the switch SW3 is also off), a drain current of a pMOS transistor (one of the PM1, PM2, and PM3) not connected to the transistor Q1 and the resistor R1 is 0. Therefore, a drain voltage of the pMOS transistor (one of the PM1, PM2, and PM3) not connected to the transistor Q1 and the resistor R1 increases up to a VDD. Next, when the connection of the dynamic element matching circuit DEM1 changes to switch the pMOS transistor for supplying a current to the resistor R1, there occurs a state where the current flowing to the transistor Q1 or the resistor R1 becomes different from a desired value. This is because, when the drain voltage of the PMOS transistor (one of the PM1, PM2, and PM3) not connected to the resistor R1 rises up to the VDD and then a current flows at the time of the switchover by the dynamic element matching circuit DEM1, a discharge current of parasitic capacitance flows in addition to a current determined by the node AMPOUT1, the discharge current of the parasitic capacitance occurring when the voltage of the drain of the pMOS transistor (one of the PM1, PM2, PM3) lowers from the VDD to, for example, a voltage of an emitter of the transistor Q1. In the reference voltage generation circuit of this embodiment, when the CTAT voltage is outputted, the switch SW1 is turned off and at the same time the switch SW3 is turned on. Consequently, the current of the pMOS transistor (one of the PM1, PM2, and PM3) not connected to the transistor Q1 and the resistor R1 flows to the resistor R2. Since the current of the PMOS transistor (one of the PM1, PM2, and PM3) not connected to the transistor Q1 and the resistor R1 flows to the resistor R2, it is possible to prevent the drain voltage of the PMOS transistor (one of the PM1, PM2, and PM3) not connected to the transistor Q1 and the resistor R1 from rising up to the VDD. Even when the connection of the transistors PM1, PM2, PM3 is changed by the next switching by the dynamic element matching circuit DEM1, the voltages of the nodes NPM1, NPM2, NPM3 do not greatly change, so that the influence that the current accompanying the voltage change of these nodes gives to the currents flowing to the transistor Q1, the resistor R1, and the transistor Q2 can be minimized. Therefore, by turning off the switch SW1 and turning on the switch SW3, it is also possible to supply the transistor Q1, the resistor R1, and the transistor Q2 with substantially the same currents as those at the actual usage time (when the SW1 is on and the SW3 is off). By supplying the transistor Q1 with substantially the same current as that at the actual usage time, the voltage of the node IP when the switch SW1 is off and the switch SW3 is on can be made equal to the voltage of the node IP at the actual usage time. Since the voltage of the node IP can be kept equal to the voltage at the actual usage time, the currents flowing through transistors PM5, PM4 become also equal to the currents at the actual usage time, and by supplying these currents to the variable resistor VR1, it is possible to take out a CTAT voltage component to the output BGROUT. It is possible to prevent currents and voltages of the respective parts from changing from those at the actual usage time due to turning off of the switch SW1, so that the CTAT voltage can be adjusted with high accuracy.

The switch SW4 functions similarly to the switch SW3. Since the function of the switch SW4 is similar to that of the switch SW3, detailed description thereof will be omitted. When the switch SW2 turns off, the switch SW4 turn on, and therefore, average currents of the transistors PM4, PM5 flow to the resistor R2. Consequently, voltages of the nodes NPM4, NPM5 do not greatly change from those when the switch SW2 is on, so that it is possible to inhibit a change of the voltage of the node AMPOUT2 due to the turning off of the switch SW2. Since the voltage of the node AMPOUT2 does not change, it is possible to minimize an effect given to the change of the voltage of the node IP through an input capacitance of the chopper amplifier CAMP2, and the same PTAT current as that flowing at the actual usage time flows to the variable resistor VR1. That is, by turning off the switch SW2 and turning on the switch SW4, it is possible to adjust the PTAT voltage with high accuracy.

The capacitor C2 works as the low-pass filter LPF for removing AC components that cannot be completely removed by the capacitors C1 and C3. The AC components are mainly of the following three kinds. The AC components of a first kind are those generated when the offset voltages are converted by the chopper amplifiers CAMP1 and CAMP2. The AC components of a second kind are those generated when the currents of the transistors PM1-PM3 are averaged by the dynamic element matching circuit DEM1. The AC components of a third kind are those generated when the currents of the transistors PM4 and PM5 are averaged by the dynamic element matching circuit DEM2. Thus, the low-pass filter LPF constituted of the capacitor C2 is necessary in order to attenuate the AC components that are generated in the dynamic matching circuits DEM1 and DEM2. Consequently, the AC components of the output reference voltage BGROUT are removed.

Further, in order to fully remove the AC components that are generated when the offset voltages are converted by the chopper amplifiers CAMP1 and CAMP2, capacitance values of the capacitors C1 and C3 have to be large. The most typical method for realizing these capacitors is to utilize a gate capacitance of a MOS transistor. In a recent integrated circuit, MOS transistors different in withstand voltage and power-supply voltage are often integrated on the same chip. In a typical example, in a digital circuit part, a power-supply voltage is 1.8 V and in an analog circuit part, a power-supply voltage is 3.3 V. Therefore, the reference voltage generation circuit of this embodiment is often constituted of MOS transistors for 3.3 V power supply. In a MOS transistor for a circuit with a high power-supply voltage, a gate oxide is thick and a gate capacitance per unit area is small. Therefore, in a case where a capacitor with a large capacitance value is constituted of a MOS transistor for a circuit for a high power-supply voltage, its area becomes large. Therefore, in the reference voltage generation circuit of this embodiment, the capacitors C1 and C3 are realized by MOS transistors for 1.8 V power supply whose capacitance per unit area is large. Similarly, the capacitor C2 is also realized by a MOS transistor for 1.8 V power supply.

In a case where the dynamic element matching circuit DEM1 is controlled so that currents constantly flow to the transistors Q1 and Q2, the voltage of the node AMPOUT1 is determined to a voltage that is lower than the VDD by about the threshold voltage Vth (absolute value) of the pMOS transistor. Therefore, the voltage given to the capacitor C1 is a voltage of about 1 V instead of 3.3 V. Similarly, in a case where the dynamic element matching circuit DEM2 is controlled so that a current constantly flows to the variable resistor VR2, a voltage of the node AMPOUT2 is determined to a voltage that is lower than the VDD by about the threshold voltage Vth (absolute value) of the pMOS transistor. Therefore, a voltage given to the capacitor C3 is also a voltage of about 1 V instead of 3.3 V.

In the second embodiment described above, the influence of the offset voltage of the operational amplifier and the influence of mismatch of the MOS transistors working as current sources which are ascribable to manufacturing variance are reduced by using the dynamic element matching circuits DEM1, DEM2 and the chopper amplifiers CAMP1 and CAMP2. Consequently, the adjustment of the PTAT voltage and the CTAT voltage by the variable resistors VR1 and VR2 become more effective. That is, even by the adjustment at a given temperature, the PTAT voltage and the CTAT voltage can be accurately adjusted to design values in a wide temperature range. Further, by the switches SW3 and SW4, it is possible to control the PTAT current and the CTAT current flowing to the variable resistor VR1 so that the PTAT current and the CTAT current at the voltage adjustment time become equal to those at the actual usage time when the reference voltage is actually outputted. Consequently, it is possible to reduce an error in the adjustment of the PTAT voltage and the CTAT voltage. Therefore, the accurate adjustment of the output reference voltage is enabled at low cost.

Figure 14:
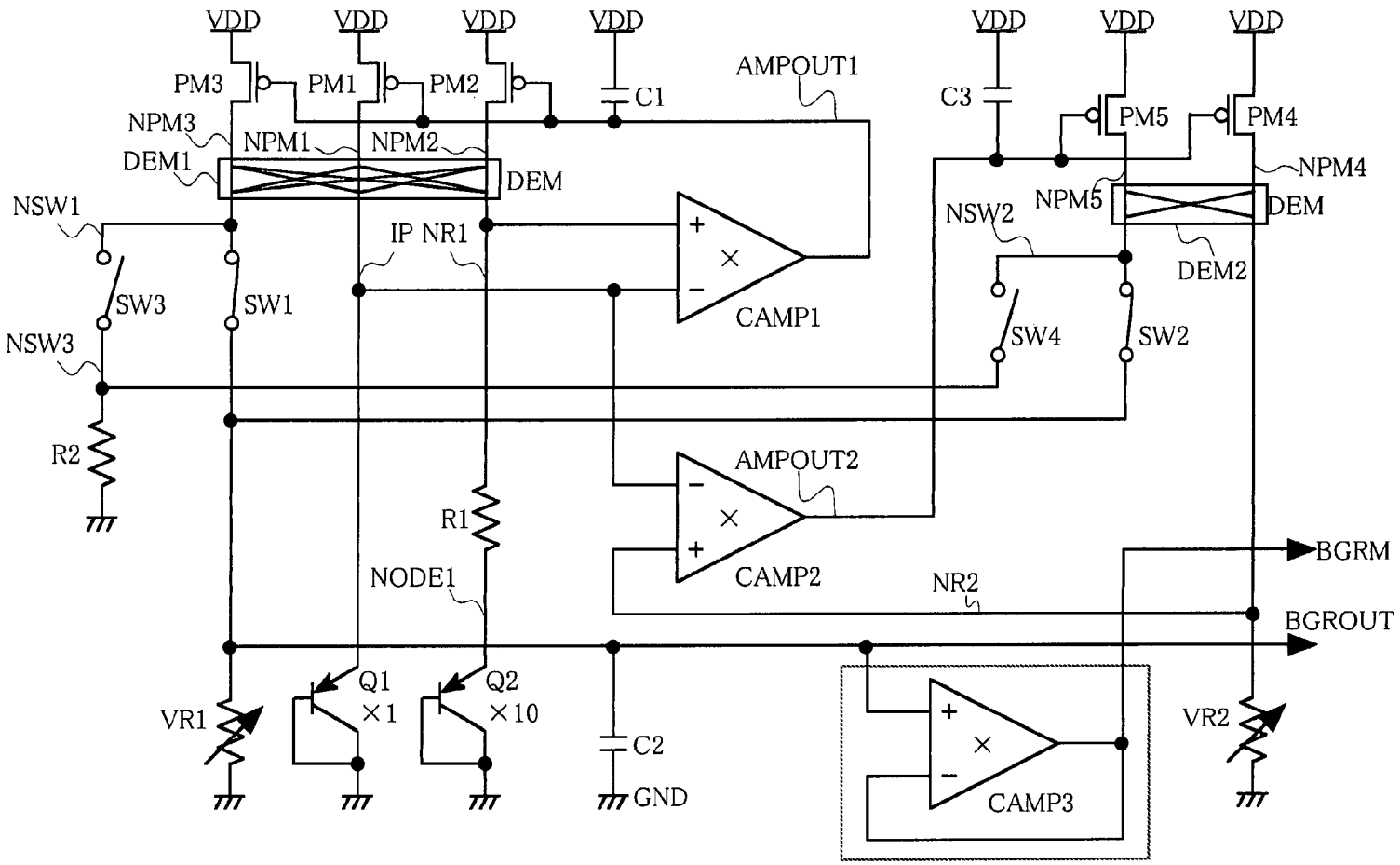
FIG. 14 is a circuit diagram showing a third embodiment of the reference voltage generation circuit of the present invention.

FIG. 14 shows a third embodiment of the present invention. The same reference symbols are used to designate the same elements as the elements described in the second embodiment, and detailed description thereof will be omitted. A reference voltage generation circuit of this embodiment is structured such that a buffer amplifier CAMP3 is added to the reference voltage generation circuit of the second embodiment. A + input of the buffer amplifier CAMP3 is connected to an output BGROUT and a − input and an output thereof are connected to a terminal BGRM. Consequently, the buffer amplifier CAMP3 works as a buffer amplifier of a reference voltage BGROUT. The terminal BGRM is a terminal for measurement of the reference voltage BGROUT, a PTAT voltage, and a CTAT voltage.

If the reference voltage generation circuit is designed to be small in total power consumption, an output impedance of the reference voltage BGROUT becomes high. In a case where the PTAT voltage or the CTAT voltage is measured, it is sometimes difficult to measure it stably if the output impedance of the reference voltage BGROUT is high. For example, in a case where an input impedance of a measurement device is low, a voltage of the reference voltage BGROUT is influenced by the input impedance of the measurement device. The buffer amplifier CAMP3 transmits the voltage of the reference voltage BGROUT to the terminal BGRM. Further, in the buffer amplifier CAMP3, the impedance of the inputs is high and the impedance of the output is low. Consequently, even in a case where the input impedance of the measurement device is low, the voltage of the terminal BGRM is not influenced by the input impedance of the measurement device. Therefore, the voltage of the reference voltage BGROUT is measured via the terminal BGRM. Further, the buffer amplifier CAMP3 needs to be operated only when the PTAT voltage, the CTAT voltage, and the reference voltage BGROUT are measured. That is, even if an operating current of the buffer amplifier CAMP3 is made large to lower an output impedance of the terminal BGRM, it is not necessary to increase a current at a normal operation time.

Figure 4:
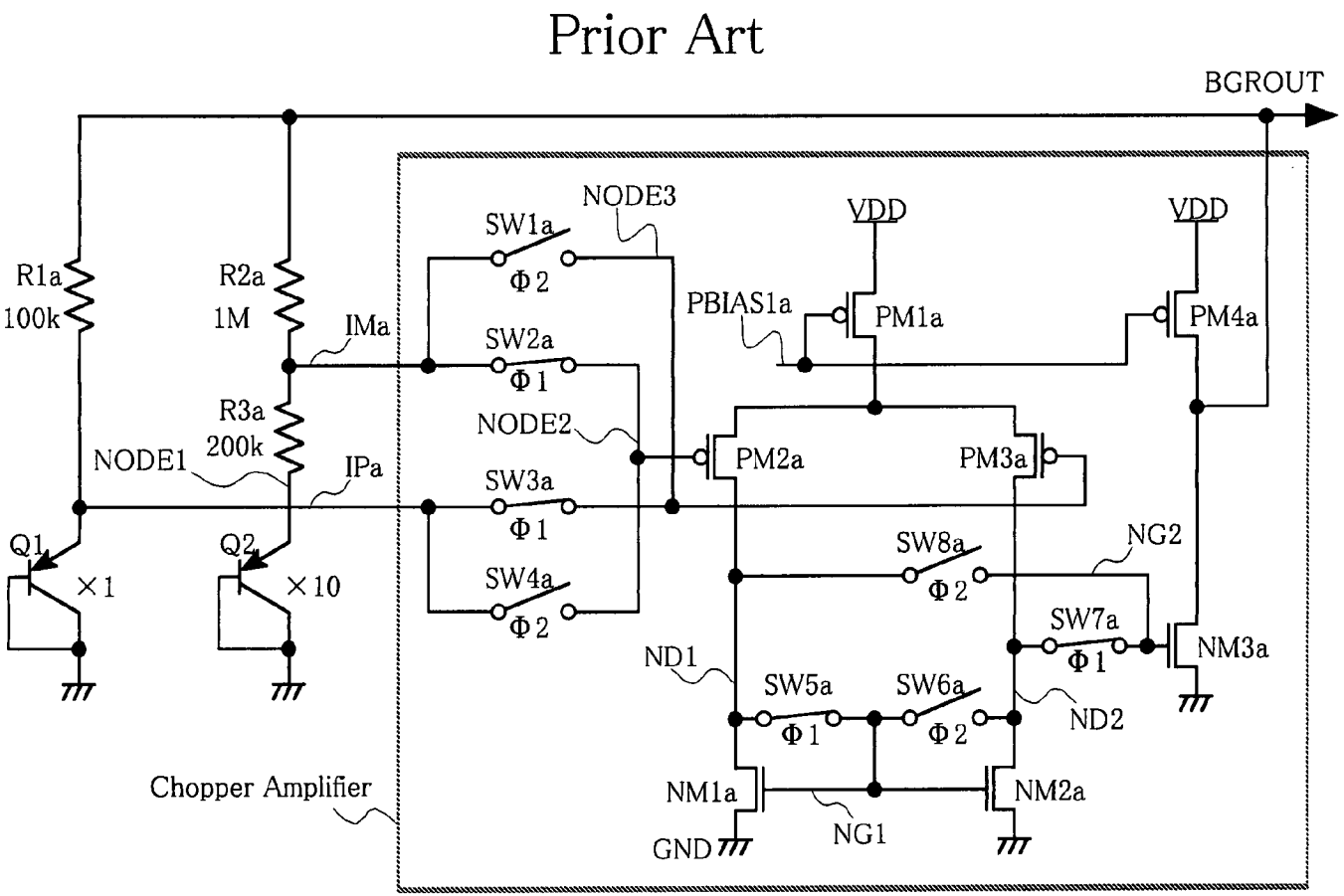
FIG. 4 is a concrete circuit diagram of the chopper-stabilized bandgap circuit.

Further, in order to minimize an influence of an offset voltage of the buffer amplifier CAMP3 on the measurement result, the buffer amplifier CAMP3 may be a chopper amplifier (for example, the above-described chopper amplifier in FIG. 4).

The third embodiment described above has the buffer amplifier CAMP3. Consequently, even when the output impedance of the reference voltage BGROUT of the reference voltage generation circuit is high, it is possible to measure the PTAT voltage and the CTAT voltage stably. Therefore, it is possible to adjust the output reference voltage accurately at low cost.

Figure 15:
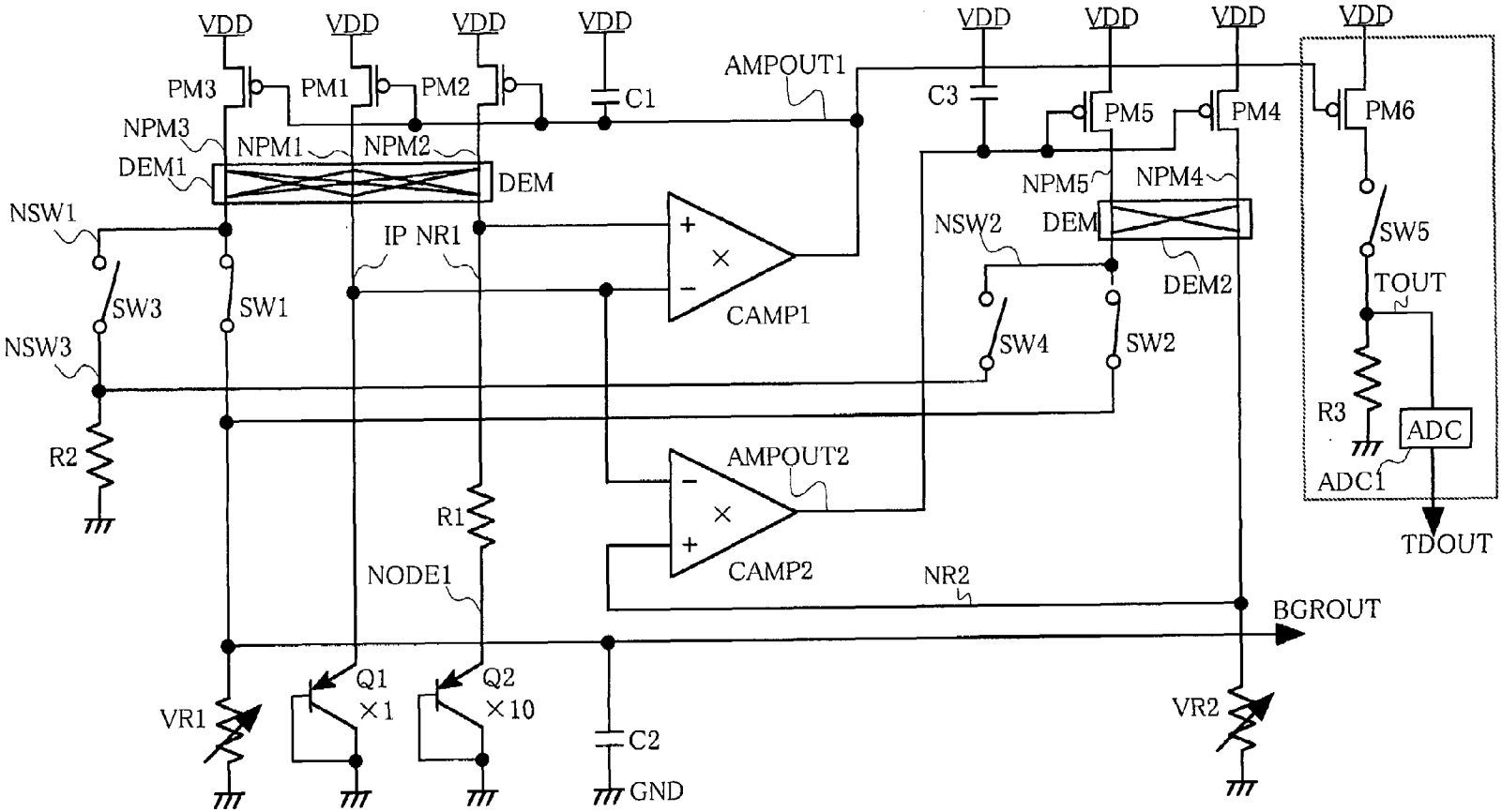
FIG. 15 is a circuit diagram showing a fourth embodiment of the reference voltage generation circuit of the present invention.

FIG. 15 shows a fourth embodiment of the present invention. The same reference symbols are used to designate the same elements as the elements described in the second embodiment, and detailed description thereof will be omitted. A reference voltage generation circuit of this embodiment is structured such that a transistor PM6, a switch SW5, a resistor R3, and an AD converter ADC1 are added to the reference voltage generation circuit of the second embodiment. The transistor PM6, the switch SW5, and the resistor R3 are connected in series between a VDD and a GND. An input of the AD converter ADC1 is connected to a node TOUT which is a connection node of the resistor R3 and the switch SW5. Further, an output of the AD converter ADC1 is connected to a terminal TDOUT. Since a voltage of a node AMPOUT1 is inputted to a gate of the transistor PM6, the transistor PM6 supplies a PTAT current to the resistor R3. Consequently, a voltage of the node TOUT becomes a PTAT voltage. The AD converter ADC1 AD-converts the voltage of the node TOUT to output the resultant to the terminal TDOUT.

Figure 1:
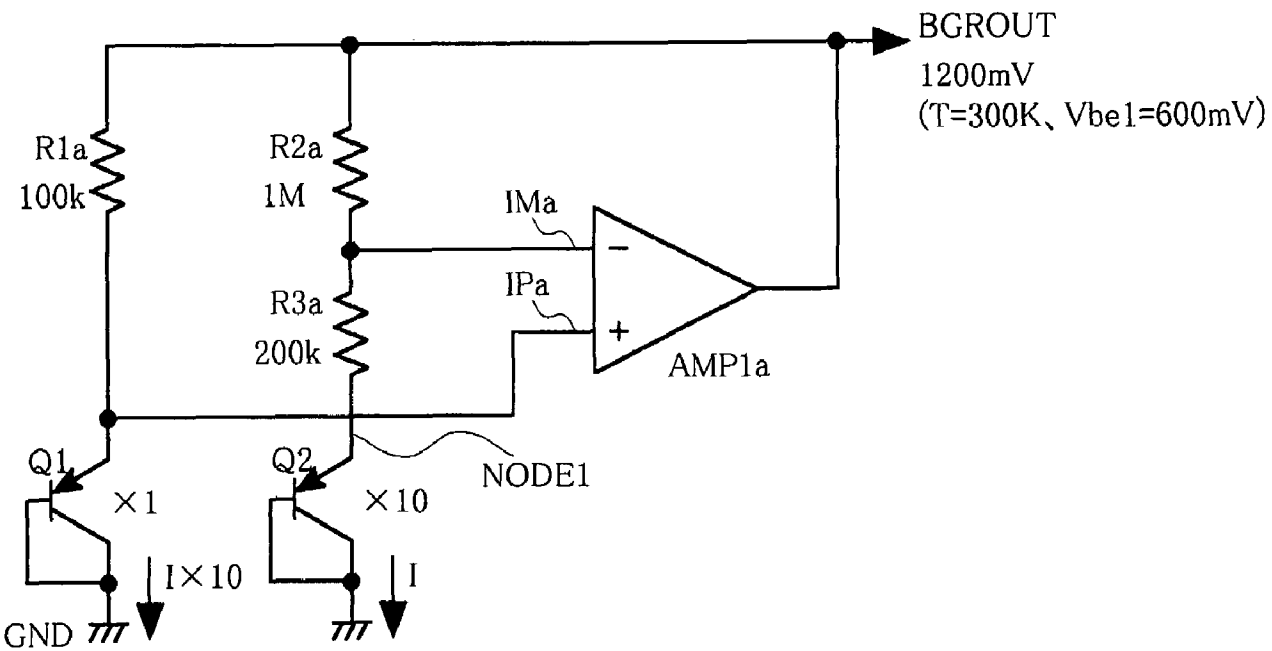
FIG. 1 is a circuit diagram of a typical bandgap circuit.
Figure 2:
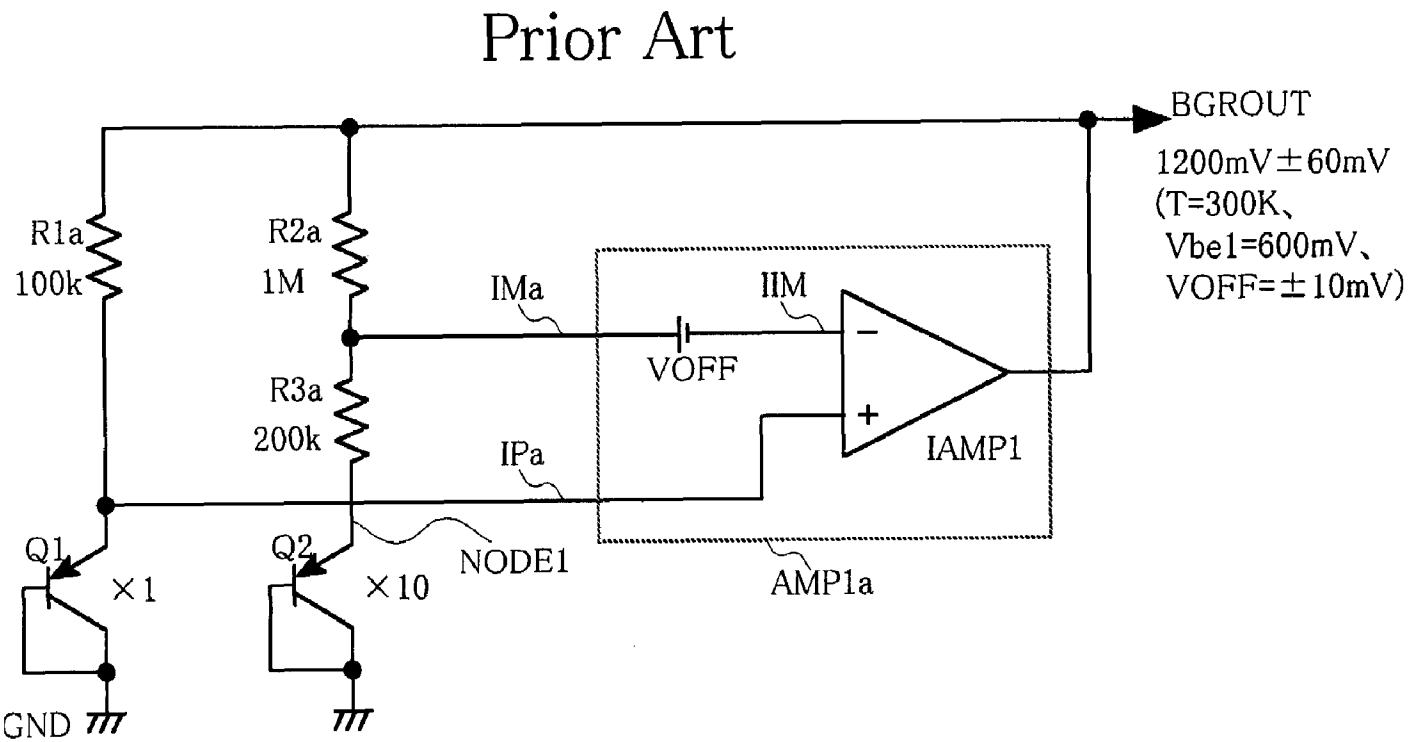
FIG. 2 is an explanatory diagram of an influence of an offset of an operational amplifier.
Figure 3A:
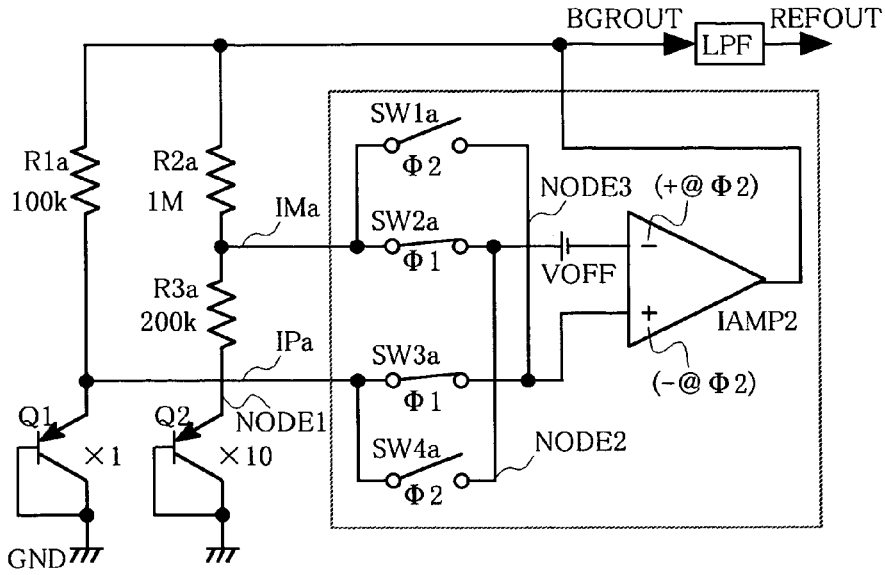
FIG. 3(*a*) and FIG. 3(*b*) are explanatory diagrams of an operational principle of a chopper-stabilized bandgap circuit.
Figure 3B:
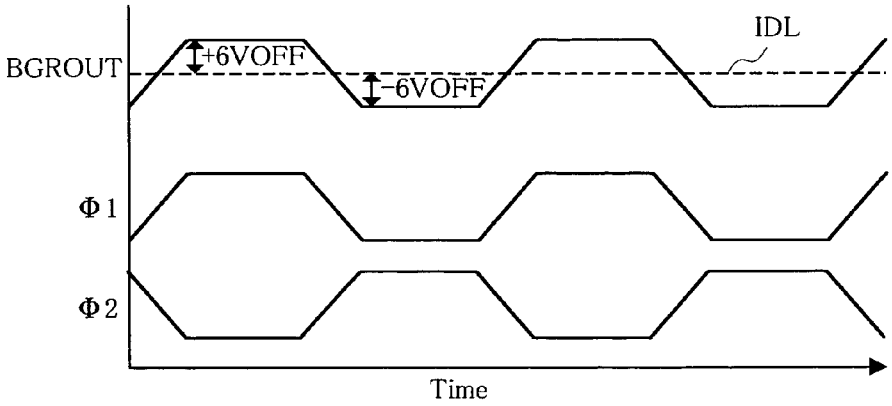

The reference voltage generation circuit shown in FIG. 15 is utilized to effectively solve temperature dependency of a reference voltage (portion presenting temperature dependency of higher order) of the reference voltage generation circuit other than the temperature dependency that can be expressed by a linear expression. The correlation between a reference voltage BGROUT of the circuit in FIG. 15 and temperature exhibits, for example, a characteristic shown in FIG. 32 to be described later. In FIG. 1 showing the conventional circuit, the temperature dependency of the forward voltage Vbe of the pn junction is described as negative linear dependency on temperature. However, to be more accurate, the forward voltage Vbe of the pn junction includes a portion having the temperature dependency that can be expressed by the linear expression and the portion exhibiting the temperature dependency of higher order (for example, P. Malcovati et al., "Curvature-Compensated BiCOMS Bandgap with 1-V Supply Voltage", IEEE Journal of Solid-State Circuits, Vol. 36, No. 7, pp. 1076-1081, July 2001).

In the most typical reference voltage generation circuit, the temperature dependency of the forward voltage Vbe of the pn junction is approximated by the linear expression and a PTAT voltage is added so as to cancel out the temperature dependency. Hereinafter, the reference voltage generation circuit designed on the basis of such a concept will be also called a linear bandgap circuit or a linear BGR. The actual correlation between the forward voltage Vbe of the pn junction and temperature has nonlinearity. Therefore, in the linear bandgap circuit, the temperature dependency of the reference voltage does not exactly become 0. For example, in a case where a reduction in the forward voltage Vbe of the pn junction at high temperature is larger than that when it is approximated by the linear expression, the reference voltage of the linear bandgap circuit often exhibits a characteristic of rising during a period in which temperature rises from low to a certain temperature, reaches the maximum value at the certain temperature, and drops in accordance with temperature rise (for example, FIG. 32 to be described later).

Figure 32:
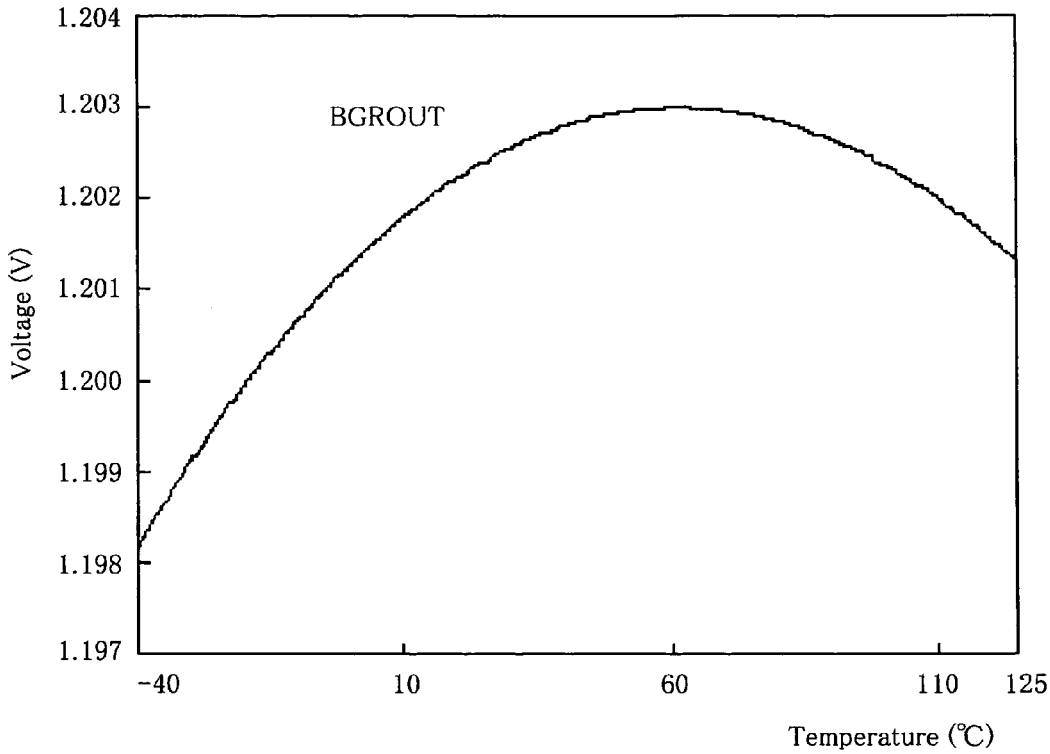
FIG. 32 is an explanatory chart of the correlation between a reference voltage BGROUT of the reference voltage generation circuit of the eighth embodiment and temperature.

Here, in a case where the temperature characteristic as shown in FIG. 32 is realized with good reproducibility, it is possible to estimate a value of the reference voltage by detecting the temperature. For example, suppose that the reference voltage becomes 1.202 V at 10° C. as in the characteristic in FIG. 32 by adjusting variable resistors VR1 and VR2 of the reference voltage generation circuit. In this case, if a temperature detecting means is provided, it is found that the reference voltage BGROUT is, for example, 1.203 V when the temperature is 60° C. and 1.198V when the temperature is −40° C.

For example, in a case where the reference voltage BGROUT is intended for use as a reference voltage of an AD conversion circuit, even when the same signal is AD-converted, the AD conversion result becomes different if the reference voltage changes. However, if it is found how much the reference voltage differs from (is larger or is smaller than) a reference voltage, for example, at room temperature, it is possible to correct the AD conversion result based on information on the difference. By this correction, for example, the AD conversion result can be digitally corrected. Specifically, the AD conversion result in a case where a 0.6 V signal is AD-converted with the reference voltage being 1.200 V is different from the AD conversion result when the 0.6 V signal is AD-converted with the reference voltage being 1.202 V. However, if it is known that the reference voltage is 1.202 V, the result of the AD conversion of the 0.6 V signal with the reference voltage being 1.2 V can be derived by a digital operation from the AD conversion result obtained when the 0.6 V signal is converted with the reference voltage being 1.202 V. In order to detect temperature, the reference voltage generation circuit of this embodiment has, in addition to the linear bandgap circuit, the resistor R3 generating the PTAT voltage and the AD converter ADC1 AD-converting this voltage to output temperature information.

For example, the reference voltage BGROUT of the reference voltage generation circuit of this embodiment exhibits the characteristic as shown in FIG. 32 in a case where the forward voltage Vbe of the pn junction has non-linear temperature dependency. Suppose that the PTAT voltage is 600 mV at 300K (27° C.), 466 mV at 233K (−40° C.), and 796 mV at 398K (125° C.). Suppose that this PTAT voltage is AD-converted based on the reference voltage BGROUT (bandgap voltage). A change of the PTAT voltage with temperature change is large and a change of the reference voltage BGROUT with the temperature change is relatively small (about 10 mV even if estimated on the high side (FIG. 32)). Therefore, the result of the AD conversion of the PTAT voltage with the output BGROUT being the reference voltage is the same as the result of the AD conversion of the PTAT voltage based on the reference voltage that does not change with temperature at all. That is, even if the PTAT voltage of the node TOUT is AD-converted based on the output BGROUT and temperature is detected, it is possible to detect the temperature with accuracy high enough to practically cause no problem. Actually, the circuit is more easily configured when both of the PTAT voltage and the reference voltage BGROUT are increased about twofold. Another possible modification is that by processing the PTAT voltage, the sum of the PTAT voltage and the offset voltage, for example, a voltage that is 0 V at −60° C. and 2 V at 150° C. and thus is proportional to temperature is AD-converted. Based on information on the detected temperature, a value of the output BGROUT is found from, for example, the characteristic in FIG. 32. Consequently, it is possible to correct a characteristic (for example, the AD conversion result) of a circuit that uses the output BGROUT.

The fourth embodiment described above has a PTAT voltage generation circuit for temperature detection (the transistor PM6 and the resistor R3) and the AD converter ADC1 for AD-converting the PTATvoltage and outputting the temperature information. Consequently, it is possible to provide a means and a method for estimating the value of the reference voltage BGROUT from the temperature characteristic and correcting the operation result, the AD conversion result, and the like of a circuit based on the output BGROUT by, for example, a digital operation. In this embodiment, there is no need to control the reference voltage more than necessary so that an absolute value thereof itself does not change with temperature, that is, it is not necessary to complicate the circuit. Therefore, the same effects as those obtained by the correction of the temperature dependency of the output reference voltage can be obtained at low cost.

Figure 16:
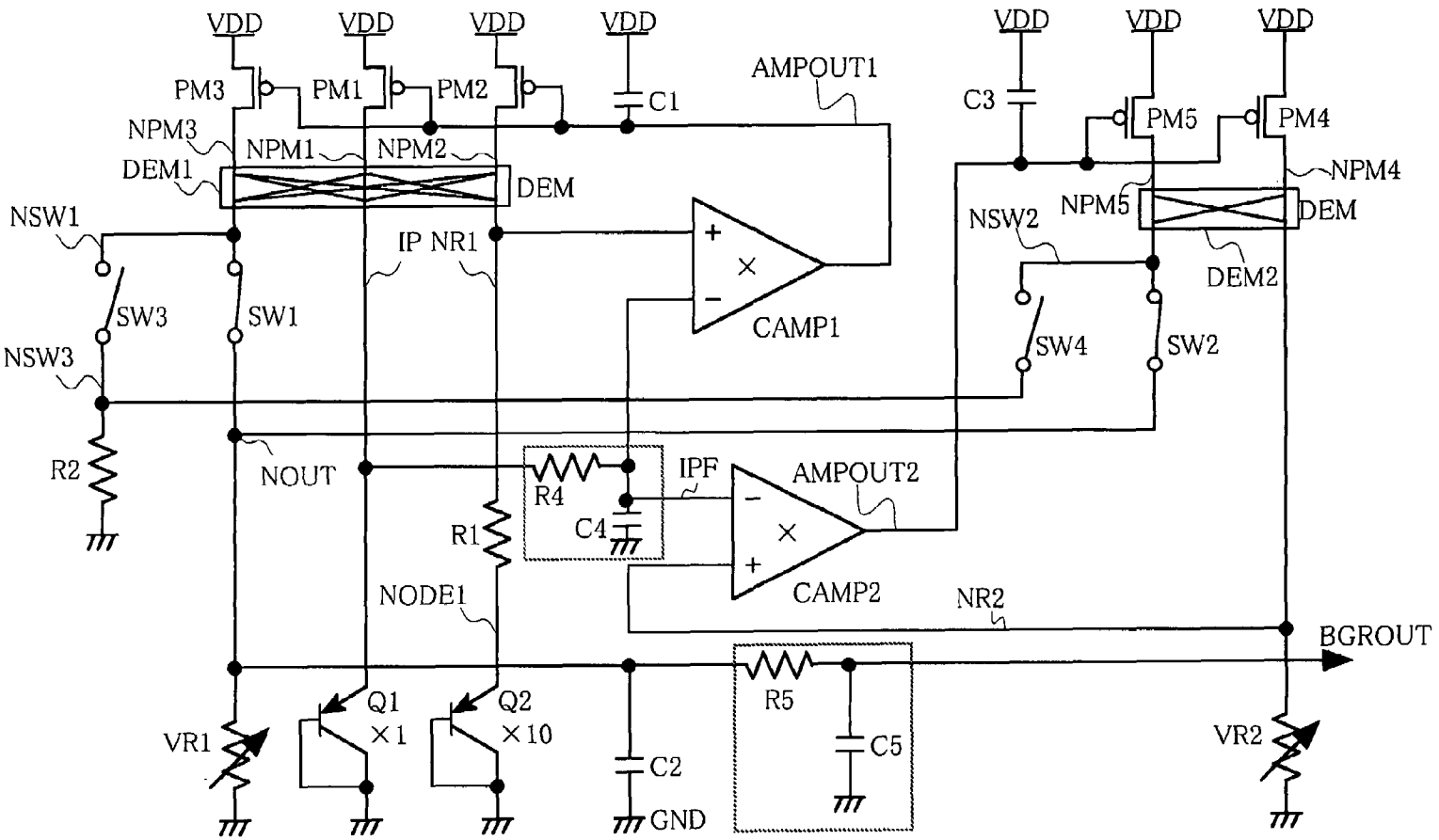
FIG. 16 is a circuit diagram showing a fifth embodiment of the reference voltage generation circuit of the present invention.

FIG. 16 shows a fifth embodiment of the present invention. The same reference symbols are used to designate the same elements as the elements described in the second embodiment, and detailed description thereof will be omitted. A reference voltage generation circuit of this embodiment is structured such that resistors R4, R5 and capacitors C4 and C5 are added to the reference voltage generation circuit of the second embodiment. The resistor R4 and the capacitor C4 work as a filter for removing AC components of signals to be inputted to chopper amplifiers CAMP1 and CAMP2. The filter constituted of the resistor R4 and the capacitor C4 is disposed between a node IPF being a − input of the chopper amplifier CAMP2 and a node IP. Further, the capacitors C2, C5 and the resistor R5 work as a filter for removing AC components of an output BGROUT. The filter constituted of the capacitors C2, C5 and the resistor R5 is disposed between a node NOUT, which is a connection node of switches SW1 and SW2 and a variable resistor VR1, and an output BGROUT.

The filter constituted of the capacitors C2, C5 and the resistor R5 works as a filter of higher order than a filter constituted only by the capacitor C2. Therefore, the filter constituted of the capacitors C2, C5 and the resistor R5 can effectively remove the AC components of the output BGROUT. At the node IP, AC components ascribable to chopper control of the chopper amplifiers CAMP1 and CAMP2 and AC components ascribable to a dynamic element matching circuit DEM1 also appear. If these AC components are inputted directly to the chopper amplifier CAMP2, AC components of a CTAT current are sometimes increased. Therefore, by providing the capacitor in the node IP, the AC components to be inputted to the chopper amplifier CAMP2 are removed. This embodiment has, at an input of the chopper amplifier CAMP2, the filter constituted of the resistor R4 and the capacitor C4. Therefore, the AC components of the CTAT current are attenuated.

The fifth embodiment described above has the filter constituted of the resistor R4 and the capacitor C4 between a transistor Q1 and the input of the chopper amplifier CAMP2. Further, the reference voltage BGROUT is outputted via the filter constituted of the capacitors C2, C5 and the resistor R5. Therefore, it is possible to effectively attenuate the AC components of the CTAT current and the AC components of the reference voltage BGROUT.

Figure 17:
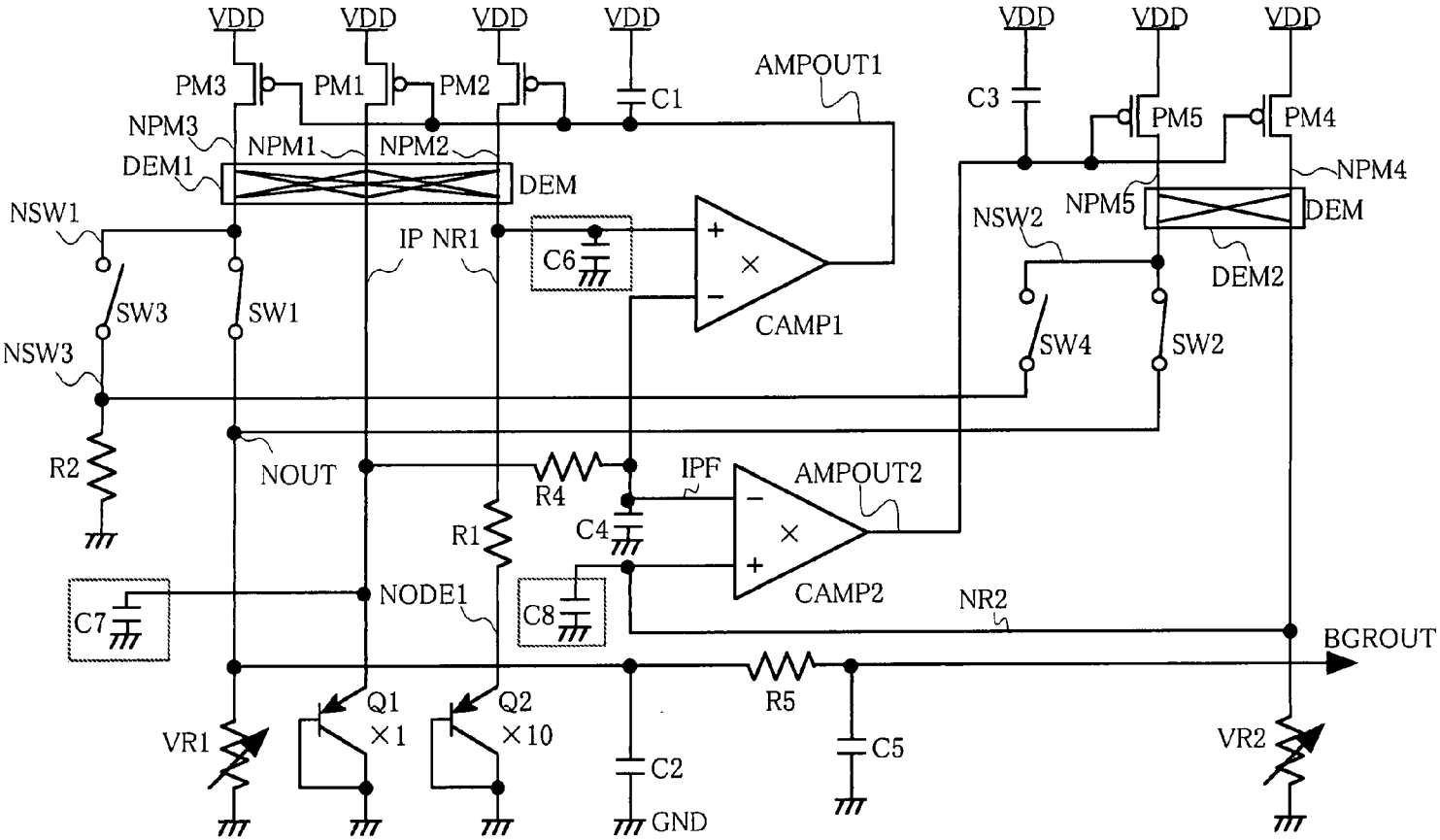
FIG. 17 is a circuit diagram showing a sixth embodiment of the reference voltage generation circuit of the present invention.

FIG. 17 shows a sixth embodiment of the present invention. The same reference symbols are used to designate the same elements as the elements described in the fifth embodiment, and detailed description thereof will be omitted. A reference voltage generation circuit of this embodiment is structured such that capacitors C6, C7, and C8 are added to the reference voltage generation circuit of the fifth embodiment.

Chopper amplifiers CAMP1 and CAMP2 have switches in input portions as shown in, for example, FIG. 5(*a*) described above. For example, if the switches are constituted of MOS transistors, charges are injected into input terminals from gates in accordance with the switching by the switches. If voltages of + and − input terminals are equal and the MOS transistors constituting the switches are completely the same in the chopper amplifier, the charges injected to the + input and the charges injected to the − input are equal. However, as shown in the waveforms in FIG. 30 to be described later, voltages of nodes IP and NR1 are not completely equal. Further, the MOS transistors constituting the switches do not become completely the same due to manufacturing variance. That is, parasitic capacitances of the MOS transistors are not equal, either. Therefore, for example, the charges injected from the switches of the input portions of the chopper amplifier are different between the + input and the − input, which will be a cause of an offset. For example, in order to reduce this offset, there is a method of inhibiting a change of the voltages of the nodes IP and NR1 in a transitional period to thereby reduce the voltage difference betweem the nodes IP and NR1.

The capacitors C4, C6, C7, and C8 prevent input voltages from greatly deviating from an ideal state due to the charges injected from the switches. Consequently, the influence of the charges injected from the switches can be alleviated. Further, the capacitor C7 also works as a capacitor for phase compensation. The chopper amplifier CAMP1 constitutes a negative-feedback loop. Therefore, the characteristic of the loop is designed so that the circuit does not become unstable due to negative feedback. Capacitors C1 and C3 working as low-pass filters make a time constant of a dominant pole large. For example, in a case where the folded cascode circuit shown in FIG. 5(*a*) is used, a pole made by the capacitors C1 and C3 has normally the lowest frequency. In many cases, a phase characteristic is improved by dropping a high-frequency gain at the pole of this portion and by inhibiting fluctuation of the node IP by the capacitor C7.

In the sixth embodiment described above, the capacitors C4, C6, C7, and C8 can reduce the influence of the charges from the switches. Further, stability of the negative feedback can be ensured by the capacitors C1, C3, and C7. Therefore, it is possible to reduce an error newly generated by the use of the chopper amplifier and to improve stability of the loop.

Figure 18:
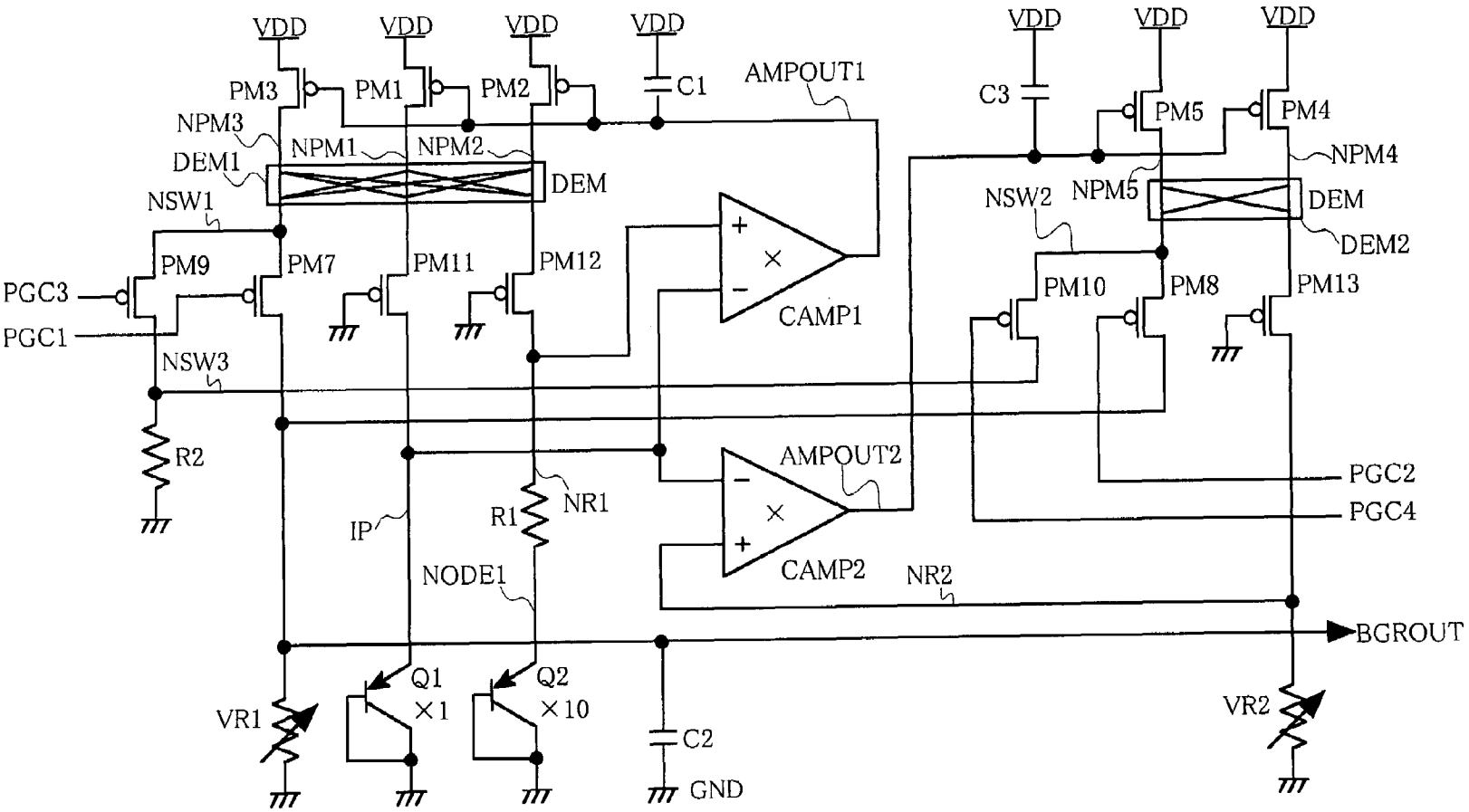
FIG. 18 is a circuit diagram showing a seventh embodiment of the reference voltage generation circuit of the present invention.

FIG. 18 shows a seventh embodiment of the present invention. The same reference symbols are used to designate the same elements as the elements described in the second embodiment, and detailed description thereof will be omitted. A reference voltage generation circuit of this embodiment is structured such that transistors PM11, PM12, and PM13 are added to the reference voltage generation circuit of the second embodiment. Further, the switches SW1-SW4 of the second embodiment are constituted of transistors PM7-PM10 respectively. Terminals PGC1-PGC4 are terminals receiving control signals for the transistors PM7-PM10. That is, the terminals PGC1-PGC4 work as switch control terminals receiving switch control signals. Further, nodes of the terminals PGC1-PGC4 are called nodes PGC1-PGC4.

The switch transistor PM7 is inserted in a path through which a current passes from a dynamic element matching circuit DEM1 to a variable resistor VR1. Accordingly, the transistors PM11 and PM12 are also disposed in paths through which currents are supplied from the dynamic element matching circuit DEM1 to transistors Q1 and Q2. The transistors PM11 and PM12 work to make currents flowing to the transistors Q1, Q2 and the variable resistor VR1 equal to one another with high accuracy. The transistors PM11 and PM12 need not be turned off. Therefore, gates of the transistors PM11 and PM12 are connected to a GND. Similarly, the transistor PM8 is disposed in a path through which a current is supplied from a dynamic element matching circuit DEM2 to the variable resistor VR1. Accordingly, the transistor PM13 is disposed also in a path through which a current is supplied from the dynamic element matching circuit DEM2 to a variable resistor VR2. A gate of the transistor PM13 is also connected to the GND.

Figure 19:
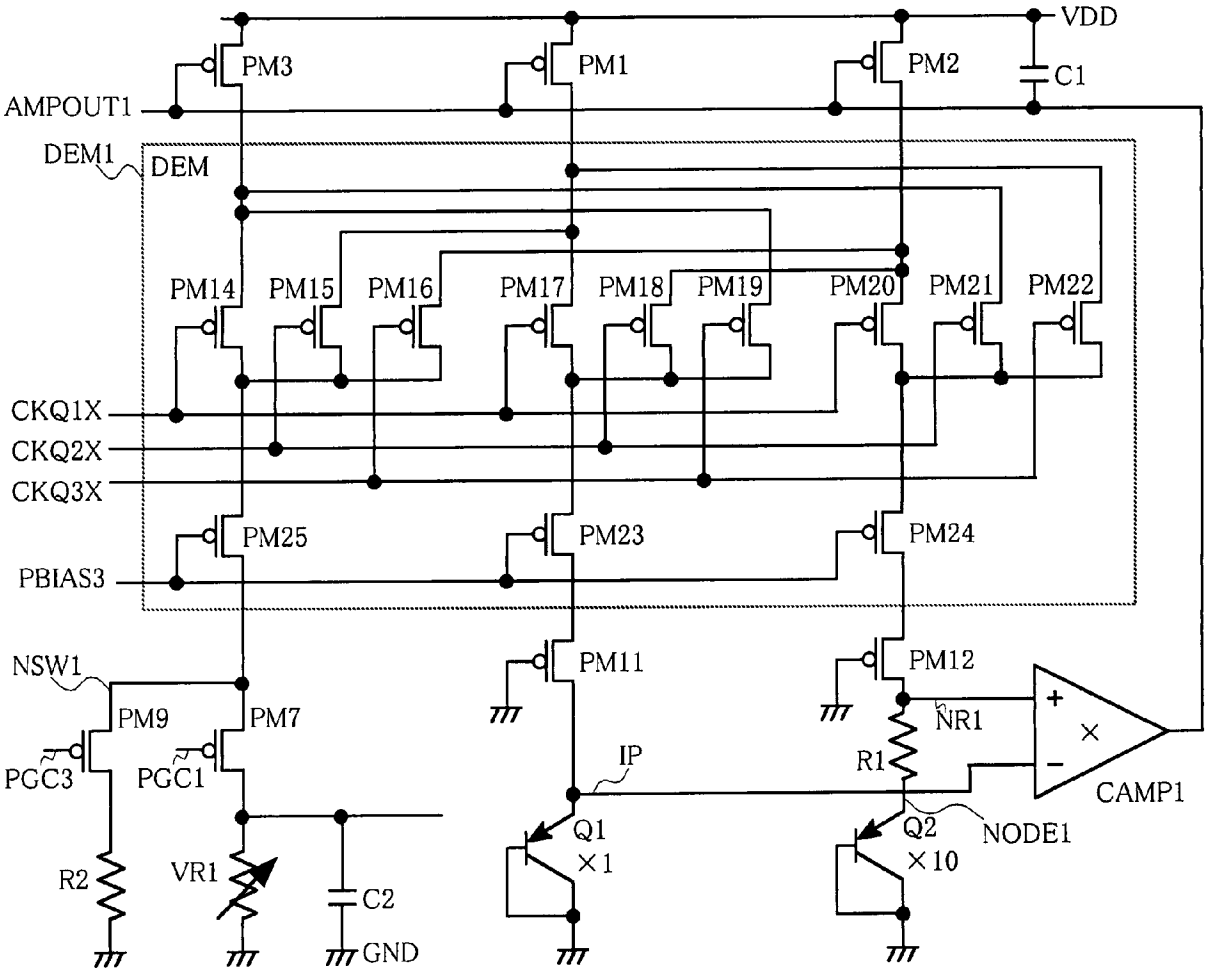
FIG. 19 is a circuit diagram of a dynamic element matching circuit DEM1 in FIG. 18.

FIG. 19 shows an example of a concrete circuit of the dynamic element matching circuit DEM1 of the reference voltage generation circuit shown in FIG. 18. The same reference symbols are used to designate the same elements as the elements described in FIG. 18, and detailed description thereof will be omitted. The dynamic element matching circuit DEM1 in FIG. 19 includes transistors PM14-PM22. Further, in order to improve accuracy of a current-mirror current, respective current sources are constituted of cascode circuits. Transistors PM23-PM25 work together with transistors PM1-PM3 as the cascode circuits. A bias voltage PBIAS3 is a bias voltage of the transistors PM23-PM25, terminals CKQ1X, CKQ2X, and CKQ3X are control terminals of the dynamic element matching circuit DEM1. The operational principle of the dynamic element matching circuit is previously described in FIG. 7(*a*) and FIG. 7(*b*), and therefore, detailed description thereof will be omitted.

Transistors PM14-PM22 work as switches. Further, the transistors PM14-PM22 correspond to the switches SW13*a*-SW21*a* in FIG. 7(*a*). More specifically, when the terminal CKQ1X connected to a gate of the transistor PM14 becomes L, a current of the transistor PM3 flows to the transistor PM25. Next, when the terminal CKQ2X connected to a gate of the transistor PM15 becomes L, a current of the transistor PM1 flows to the transistor PM25. Further, when the terminal CKQ3X connected to a gate of the transistor PM16 becomes L, a current of the transistor PM2 flows to the transistor PM25. Further, the terminals CKQ1X, CKQ2X, and CKQ3X are controlled so that one of the terminals is switched to L and the other two terminals are switched to H in turn. Consequently, a current of one transistor selected from the transistors PM1, PM2, and PM3 flows to the transistor PM25. That is, the currents of the transistors PM1, PM2, and PM3 flow in turn to the transistor PM25. The structure of the transistors PM17-PM22 is also the same. Therefore, the currents of the transistors PM1, PM2, and PM3 flow in turn to the transistors PM23 and PM24.

Figure 20:
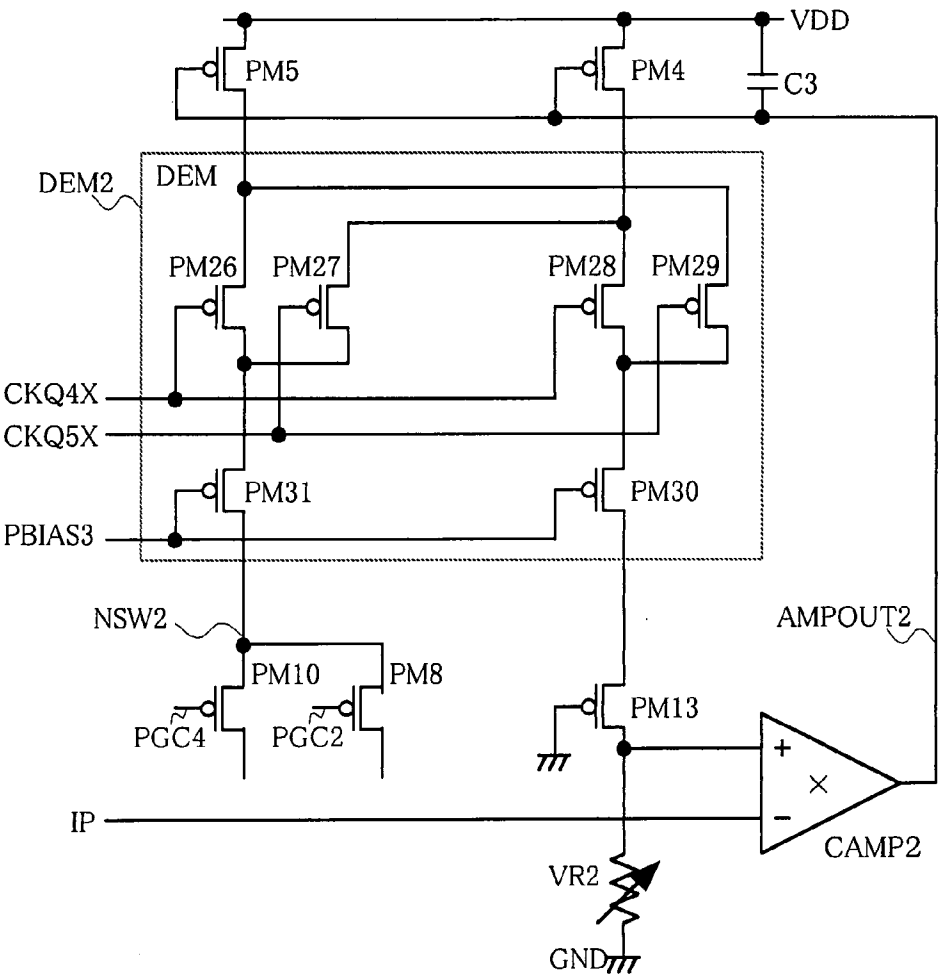
FIG. 20 is a circuit diagram of a dynamic element matching circuit DEM2 in FIG. 18.

FIG. 20 shows a concrete circuit example of the dynamic element matching circuit DEM2 of the reference voltage generation circuit shown in FIG. 18. The same reference symbols are used to designate the same elements as the elements described in FIG. 18, and detailed description thereof will be omitted. The dynamic element matching circuit DEM2 in FIG. 20 includes transistors PM26-PM29. Further, in order to improve accuracy of a current-mirror current, respective current sources are constituted of cascode circuits. Transistors PM30 and PM31 work together with transistors PM4 and PM5 as cascode circuits. A bias voltage PBIAS3 is a bias voltage of the transistors PM30 and PM31, and terminals CKQ4X and CKQ5X are control terminals of the dynamic element matching circuit DEM2. The transistors PM26-PM29 work as switches. The operation of the dynamic element matching circuit DEM2 is the same as that of the dynamic element matching circuit DEM1, and therefore, detailed description thereof will be omitted. The terminals CKQ4X and CKQ5X are controlled so that one of the terminals is switched to L and the other terminal is switched to H in turn. Consequently, currents of the transistors PM4 and PM5 flow in turn to the transistors PM30 and PM31.

Figure 21:
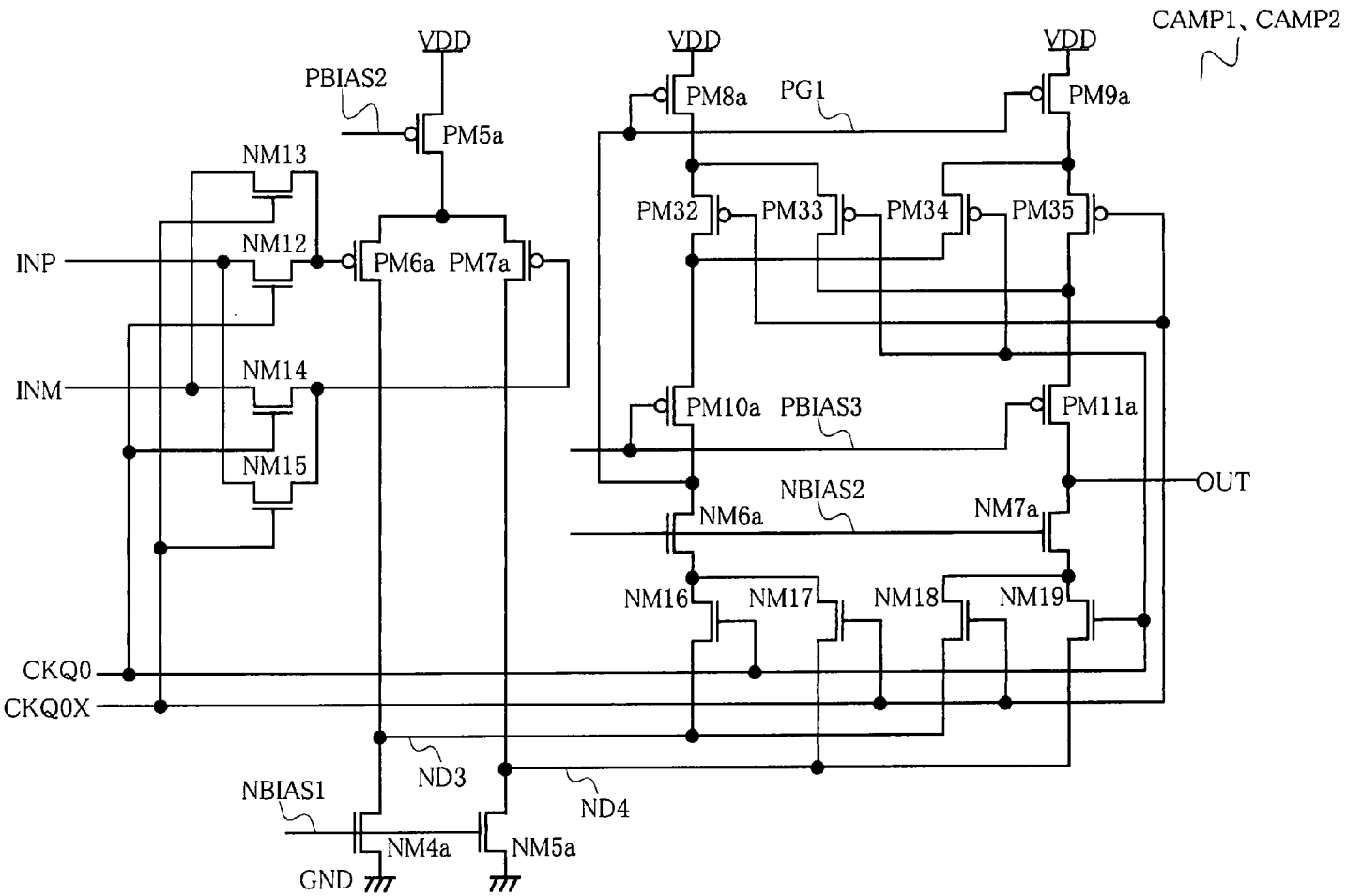
FIG. 21 is a circuit diagram of chopper amplifiers CAMP1 and CAMP2 in FIG. 18.

FIG. 21 shows a concrete circuit example of chopper amplifiers CAMP1 and CAMP2 of the reference voltage generation circuit shown in FIG. 18. The same reference symbols are used to designate the same elements as the elements described in FIG. 5(*a*) to FIG. 5(*c*), and detailed description thereof will be omitted. In the chopper amplifier in FIG. 21, the chopper part circuits CHS1-CHS3 of the chopper amplifier in FIG. 5(*a*) and FIG. 5(*b*) are constituted of transistors NM12-15, transistors PM32-PM35, and transistors NM16-19. Aterminal OUT is an output terminal, a bias voltage NBIAS1 is a bias voltage of transistors NM4*a* and NM5*a*, a bias voltage NBIAS2 is a bias voltage of transistors NM6*a* and NM7*a*, a bias voltage PBIAS2 is a bias voltage of a transistor PM5*a*, a bias voltage PBIAS3 is a bias voltage of transistors PM10*a* and PM11*a*, nodes ND3, ND4, and PG1 are internal nodes of the amplifier, a terminal INP is a + input terminal, a terminal INM is a − input terminal, terminals CKQ0 and CKQ0X are control terminals of the chopper amplifier. Each of the chopper part circuits is constituted of the nMOS switches or the PMOS switches, and accordingly, CKQ0 and CKQ0X are used as control signals for the switches. As in the chopper amplifier shown in FIG. 21, the switches can be constituted only by the PMOS transistors or only by the nMOS transistors according to voltages of parts where the switches are used.

Figure 22:
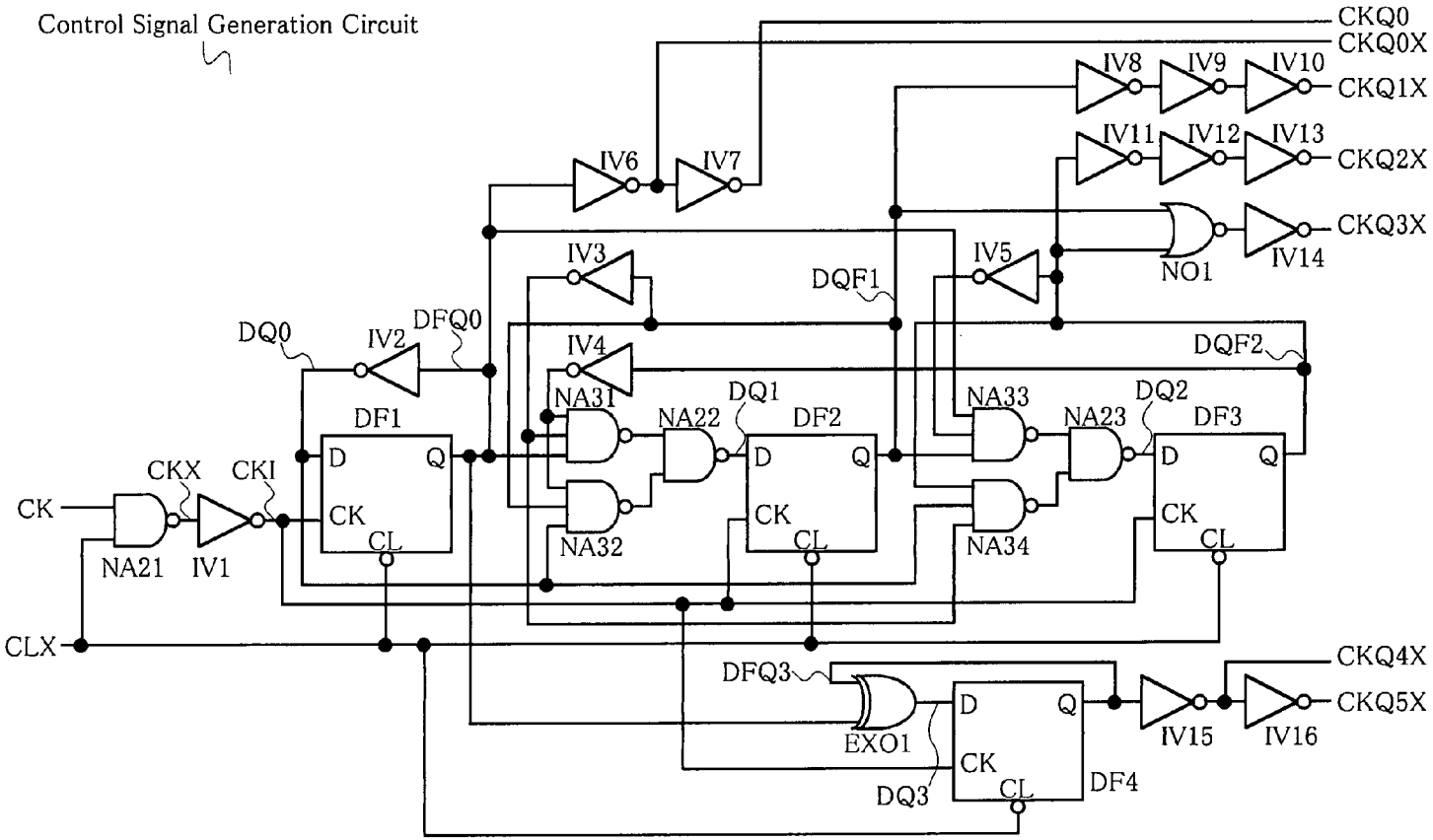
FIG. 22 is a circuit diagram of a control signal generation circuit for the DEM1, DEM2, CAMP1, and CAMP2 in FIG. 19 to FIG. 21.

The circuit in FIG. 22 shows an example of a control signal generation circuit generating control signals for the dynamic element matching circuits shown in FIG. 19 and FIG. 20 and control signals for the chopper amplifiers shown in FIG. 21. Further, FIG. 23 shows truth values of a counter circuit part in the control signal generation circuit shown in FIG. 22. Circuit elements, nodes, signals, biases, and so on corresponding to those of the circuits in FIG. 19, FIG. 20, and FIG. 21 are denoted by the same element names and node names.

In FIG. 22, a signal CLX is a control signal for power-down and initialization, a signal CK is a reference clock signal inputted to the control signal generation circuit, signals CKQ0X and CKQ0 are the control signals for the chopper amplifiers CAMP1, CAMP2, signals CKQ1X, CKQ2X, and CKQ3X are control signals for the dynamic element matching circuit DEM1, signals CKQ4X and CXQSX are control signals of the dynamic element matching circuit DEM2, inverters IV1-IV16 are inverter circuits, NANDs NA21-NA23 are two input NAND circuits, D flip-flop circuits DF1-DF4 are edge trigger D flip-flop circuits that clear the contents to 0 when CL is L, NOR NO1 is a two input NOR circuit, an exclusive-OR circuit EXO1 is a two input exclusive-OR circuit, and NANDs NA31-NA34 are three input NAND circuits. Further, nodes CKX, CKI, DQ0, DFQ0, DQ1, DFQ1, DQ2, DFQ2, DQ3, and DFQ3 are internal nodes (signals thereof are also denoted by CKX, CKI, DQ0, DFQ0, DQ1, DFQ1, DQ2, DFQ2, DQ3, and DFQ3).

The control signal generation circuit shown in FIG. 22 operates as follows. The signal CLX works as the control signal for initialization and power-down of an internal state of the control signal generation circuit. The signal CLX is set to H at a normal operation time. At a power-down time (when the circuit is to be stopped), the signal CLX is set to L. When the signal CLX is set to L, the D flip-flop circuits DF1, DF2, DF3, and DF4 are cleared (storage information becomes 0), and an output of the NAND NA21 is fixed to H. Consequently, the state of the control signal generation circuit does not change, and even if the signal CK is inputted, the control signal generation circuit does not operate. The D flip-flop circuits DF1, DF2, and DF3 constitute a senary counter. An overall operation thereof is represented by the truth values shown in FIG. 23. DFQ2(*n*), DFQ1(*n*), and DFQ0(*n*) in FIG. 23 represent values of the nodes DFQ2, DFQ1, and DFQ0 at a given instant (in FIG. 23, 1 corresponds to H level and 0 corresponds to L level). DFQ2(*n*+1), DFQ1(*n*+1), and DFQ0(*n*+1) in FIG. 23 represent values of the nodes DFQ2, DFQ1, and DFQ0 in FIG. 22 at a next instant (values after change at a next rising of the signal CK1 which is a clock of the D flip-flop circuits).

For example, if the signal "DFQ2, DFQ1, DFQ0" at a given instant is "000", the signal "DFQ2, DFQ1, DFQ0" changes to "001" at the next rising of the signal CK1. The value of the signal "DFQ2, DFQ1, DFQ0" increases in synchronization with the rising of the signal CK1 from "000" to "101", and thereafter returns to "000". The inputs DQ0, DQ1, and DQ2 of the D flip-flop circuits are structured so as to realize such an operation. For example, if the signal DFQ0 is 0(1) at an n instant, the signal DFQ0 is 1(0) at an n+1 instant, and therefore, the signal DQ0 becomes a signal that is the signal DFQ0 inverted by the inverter IV2. While the signal "DFQ2, DFQ1, DFQ0" changes from "000" to "101", the state of the signal "DFQ2, DFQ1, DFQ0" in which the signal DFQ1 has to be 1 at the next instant is "001" and "010", and therefore, the logic of the signal DQ1 is constructed so as to realize this. That is, when the signal "DFQ2, DFQ1, DFQ0" is "001", the NAND NA31 outputs L to the NAND NA22, and when the signal "DFQ2, DFQ1, DFQ0" is "010", the NAND NA32 outputs L to the NAND NA22. The NAND NA22 performs a NAND operation on the output of the NAND NA31 and the output of the NAND NA32, whereby the operation of the truth table in FIG. 23 is realized.

The signal DQ2 is also constructed based on the same concept. While the signal "DFQ2, DFQ1, DFQ0" changes from "000" to "101", the state of the signal DFQ2, DFQ1, DFQ0" in which the signal DFQ2 has to be 1 at the next instant is "011" and "100". The NAND NA33 outputs L to the NAND NA23 when the signal "DFQ2, DFQ1, DFQ0" is "011", and the NAND NA34 outputs L to the NAND NA23 when the signal "DFQ2, DFQ1, DFQ0" is "100". The NAND NA23 performs a NAND operation on the output of the NAND NA33 and the output of the NAND NA34, whereby the operation of the truth table in FIG. 23 is realized. When an initial value of the signal "DFQ2, DFQ1, DFQ0" is "110" and "111", the senary counter operation is started after the transition shown in FIG. 23.

If one of the control signals CKQ0, CKQ0X for the chopper amplifier shown in FIG. 21 is L, the other has to be H. In order to realize such a characteristic, in the control signal generation circuit in FIG. 22, the signal CKQ0 and the signal CKQ0X being an inversion signal of the signal CKQ0 are generated from the signal DFQ0 resulting from the frequency division of the signal CK.

As described in FIG. 19, the signals CKQ1X, CKQ2X, CKQ3X have to be clocks such that one of the signals CKQ1X, CKQ2X, CKQ3X becomes L in turn. Here, from the truth table in FIG. 23, each of the signals DFQ2 and DFQ1 becomes H during two-clock periods of the clock CK1 in the senary counter operation. Therefore, the signals DFQ2 and DFQ1 can be used as the signal CKQ1X, CKQ2X, or CKQ3X. In the control signal generation circuit in FIG. 22, the CKQ1X is generated as the inversion signal of the DFQ1, and the CKQ2X is generated as the inversion signal of the DFQ2.

The circuit may be configured such that the signal CKQ3X becomes L when the signals CKQ1X and CKQ2X are both H. This relates to points to be noted in the control of the dynamic element matching circuit DEM1. For example, when a situation occurs in which the currents of the transistors PM1, PM2, and PM3 do not flow to the transistors Q1, Q2 at the start-up time of the circuit or the like due to the state of the control of the dynamic element matching circuit DEM1, the feedback circuit by the chopper amplifier CAMP1 may possibly lower the voltage of a node AMPOUT1 to the GND voltage in order to make voltages of nodes IP and NR1 equal to each other. In order to prevent this, the circuit has to be configured so that one of the signals CKQ1X, CKQ2X, and CKQ3X surely becomes L. As shown in FIG. 22, the signal CKQ3X is realized by a logical sum of the inversion signal of the signal CKQ1X and the inversion signal of the signal CKQ2X. Consequently, even when the signals CKQ1X and CKQ2X both become H, the signal CKQ3X asynchronously becomes L irrespective of the clock CKI. Therefore, one of the signals CKQ1X, CKQ2X, and CKQ3X surely becomes L. Consequently, the dynamic element matching circuit DEM1 of the reference voltage generation circuit shown in FIG. 18 surely passes the currents to the transistors Q1 and Q2. Consequently, it is ensued that the voltage of the node AMPOUT1 is fixed to a voltage lower than the VDD by about 1 V, which makes it possible to reduce withstand voltage of a capacitor C1. This allows the use of an element whose capacitance per unit area is large, which realizes an area reduction of the capacitor C1.

Further, the dynamic element matching circuit DEM2 supplies the currents of the transistors PM4 and PM5 to the variable resistors VR1 and VR2 alternately. Therefore, as shown in FIG. 22, it is possible to control the dynamic element matching circuit DEM2 by the signal resulting from the ½ frequency division of the signal DFQ0 and the inversion signal of this signal. In the control signal generation circuit in FIG. 22, the exclusive-OR circuit EXO1 frequency-divides the signal DFQ0 to generate the signals CKQ4 and CKQ5.

Figure 24:
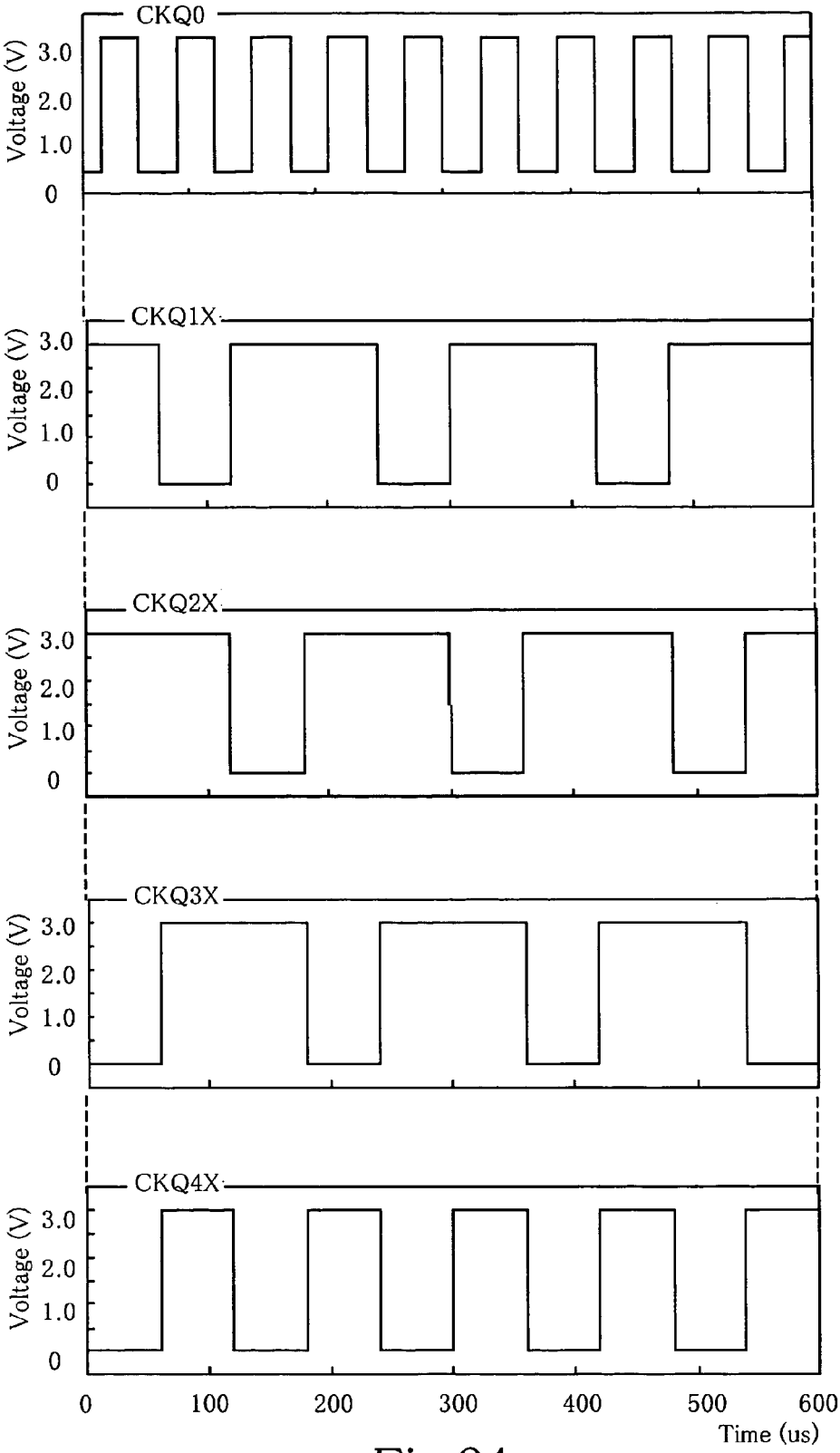
FIG. 24 is an explanatory chart of waveforms of control signals generated in the control signal generation circuit shown in FIG. 22.

FIG. 24 shows an example of waveforms of the control signals generated by the control signal generation circuit shown in FIG. 22. Though not shown, the input clock CK whose frequency is twice as high as that of the signal CKQ0 is inputted to the control signal generation circuit in FIG. 22. Further, the signal CLX is H. By configuring the control signal generation circuit in FIG. 22, the operations in the waveform example of the signals CKQ1X, CKQ2X, CKQ3X, and CKQ4X shown in FIG. 24 can be realized. Further, though not shown in FIG. 24, the waveform of the signal CKQ5X is the inversion of the waveform of the signal CKQ4X.

In the seventh embodiment described above, the switches are constituted of the pMOS transistors, and for the purpose of preventing the difference in current values due to on-resistances thereof, the transistors PM11-PM13 are provided. Consequently, it is possible to make the currents flowing to the transistors Q1, Q2 and the variable resistor VR1 equal to one another with enhanced accuracy. Moreover, the currents flowing to the variable resistors VR1 and VR2 are also made equal to each other with enhanced accuracy. Further, the dynamic element matching circuits and the chopper amplifiers receive the control signals for stable operation from the control signal generation circuit. Adding the transistors PM11-PM13 makes it possible to obtain an effect of further improving accuracy of the matching of the currents flowing to the variable resistor VR1, the transistors Q1, Q2, and so on and an effect of further improving the output reference voltage, in addition to the effects of the other embodiments.

Figure 25:
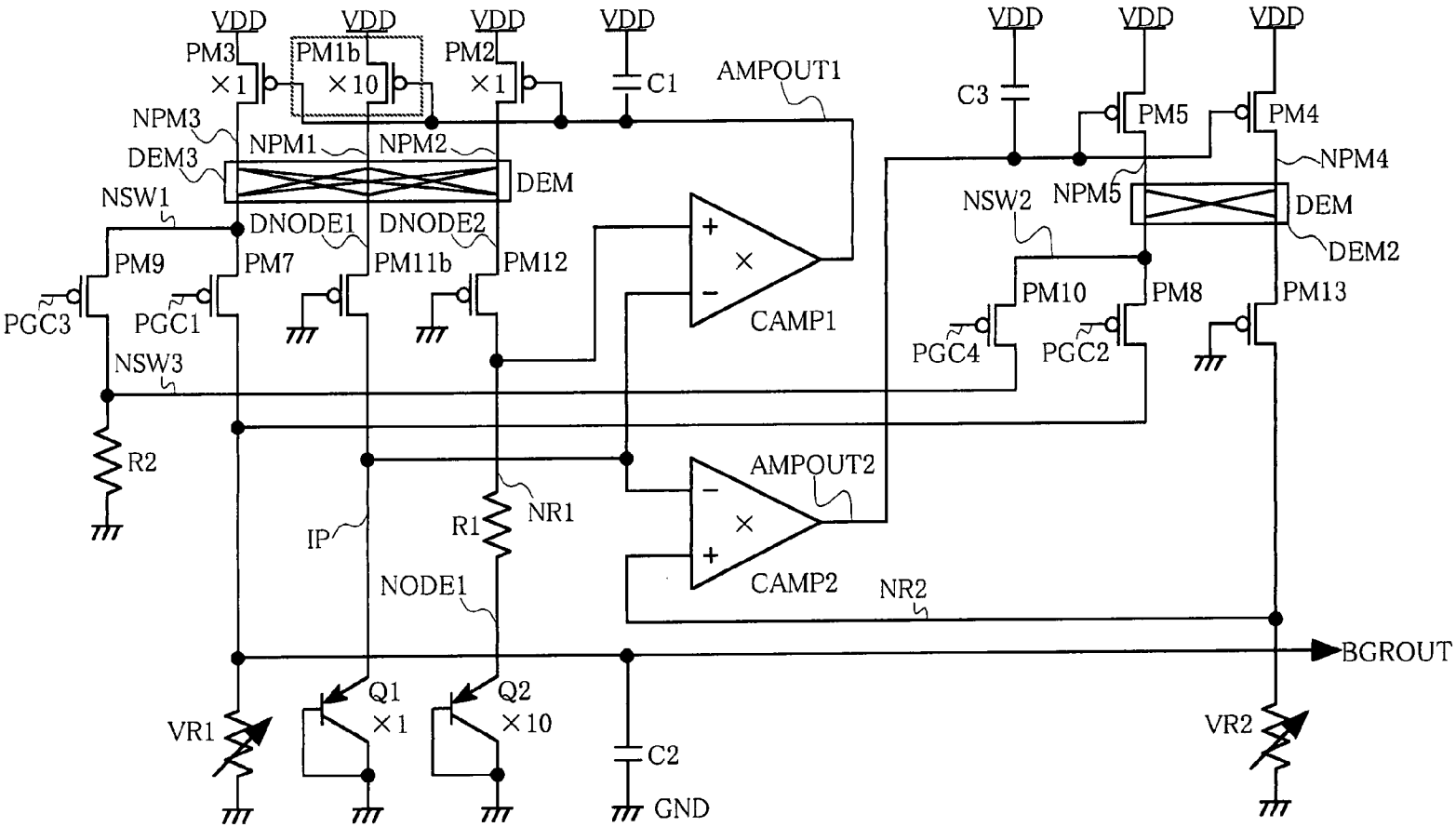
FIG. 25 is a circuit diagram showing an eighth embodiment of the reference voltage generation circuit of the present invention.

FIG. 25 shows an eighth embodiment of the present invention. The same reference symbols are used to designate the same elements as the elements described in the seventh embodiment, and detailed description thereof will be omitted. A reference voltage generation circuit of this embodiment is structured such that the dynamic element matching circuit DEM1 and the transistors PM1 and PM11 of the reference voltage generation circuit of the seventh embodiment are replaced by a dynamic element matching circuit DEM3 and transistors PM1*b* and PM11*b*. In the seventh embodiment, the transistors PM1, PM2, and PM3 are equal in the ratio W/L of the gate width W and the gate length L, and the currents with the same value are supplied to the transistors Q1, Q2 and the variable resistor VR1. On the other hand, in this embodiment, ratios W/L of a gate width W and a gate length L of the transistors PM1*b*, PM2, and PM3 are 10:1:1. That is, currents supplied to transistors Q1, Q2 and a variable resistor VR1 are 10:1:1. Further, since the ratios W/L of the gate width W and the gate length L of the transistors PM1*b*, PM2, and PM3 are changed to 10:1:1, the dynamic element matching circuit DEM1 of the seventh embodiment is also replaced by the dynamic element matching circuit DEM3. A ratio W/L of a gate width W and a gate length L of the transistor PM11*b* is also changed so as to allow the passage of a current ten times as large. Nodes DNODE1, DNODE2 are internal nodes.

For example, in a case where an emitter area ratio of the transistors Q1 and Q2 is 1:10, if the current of the transistor Q1 is ten times as large as the current of the transistor Q2, a current density ratio of the transistors Q1 and Q2 is 100:1. By thus increasing the current density ratio, it is possible to increase a voltage given to the resistor R1 (see the expressions (3)-(6)). A PTAT voltage being a component of a reference voltage is obtained by amplifying the voltage of the resistor R1. Therefore, if the voltage given to the resistor R1 can be increased, an amplification factor of a voltage for generating the PTAT voltage can be reduced. Consequently, the influence of an offset voltage of an operational amplifier can be reduced. In this embodiment, since a chopper amplifier CAMP1 is used, ideally, the offset voltage of the operational amplifier does not influence a reference voltage BGROUT. However, an AC signal generated in the chopper amplifier CAMP1 is amplified with the same amplification factor as that of the voltage of the resistor R1. Consequently, with the same offset voltage, the amplitude of the AC signal increases as the amplification factor of the voltage of the resistor R1 increases. Therefore, it is necessary to increase an attenuation factor of a low-pass filter LPF. Or, compared with other cases using the same low-pass filter LPF (for example, a capacitor C2), a ripple of an output signal appearing in the output BGROUT becomes large. In this viewpoint, when the chopper amplifier CAMP1 is used, it is also desirable to make the voltage across both ends of the resistor R1 (namely, ΔVbe) as high as possible. For this purpose, the circuit in this embodiment is configured such that the current supplied to the transistor Q1 is ten times as large as the current supplied to the transistor Q2. Consequently, the current density ratio of the transistors Q1 and Q2 is as large as 100:1, so that the voltage across the both ends of the resistor R1 can be made high. Therefore, the reference voltage generation circuit of this embodiment can reduce the ripple of the output BGROUT.

Figure 26:
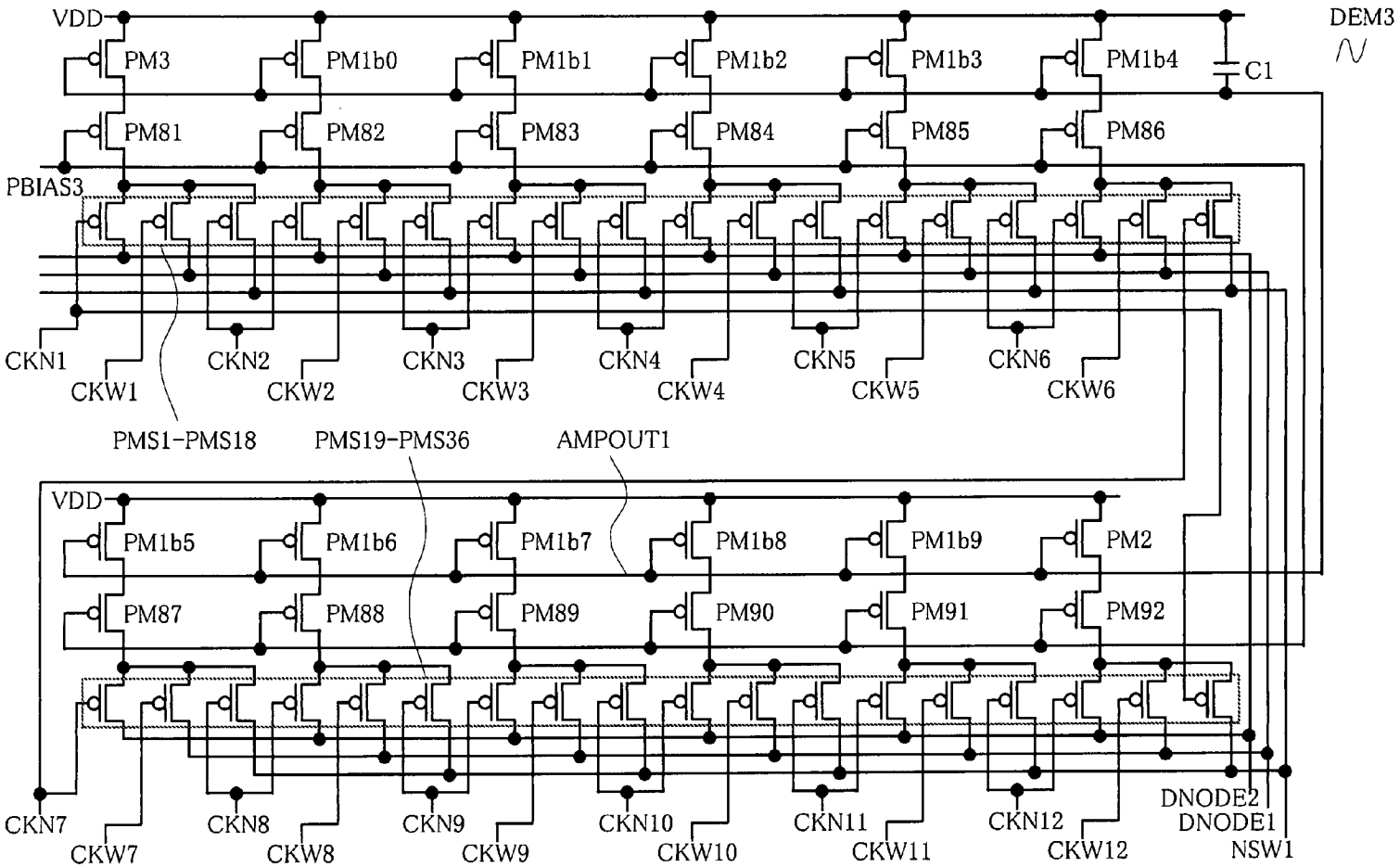
FIG. 26 is a circuit diagram of a dynamic element matching circuit DEM3 in FIG. 25.

FIG. 26 shows an example of the dynamic element matching circuit DEM3 of the reference voltage generation circuit shown in FIG. 25. The same element names and node names are given to parts corresponding to those of the circuit in FIG. 25. The dynamic element matching circuit DEM3 has transistors PM2, PM3, PM1*b*0-PM1*b*9 constituting current sources, PM81-PM92, and transistors PMS1-PMS36 constituting switches. In FIG. 26, nodes DNODE1, DNODE2 and NSW1 are internal nodes, and signals CKN1-CKN12, CKW1-CKW12 are control clock signals.

The transistors PM1*b*0-PM1*b*9 in FIG. 26 correspond to the transistor PM1*b* in FIG. 25. In FIG. 25, the transistor PM1*b* is the pMOS transistor through which the current ten times as large as the current of the transistor PM1 shown in FIG. 18 flows. On the other hand, in FIG. 26, the transistors PM1*b*0-PM1*b*9 are pMOS transistors with the ratio W/L of the gate width W and the gate length L of each being the same as that of the transistor PM1 shown in FIG. 18. The transistors PM2 and PM3 in FIG. 26 are elements corresponding to the transistors PM2 and PM3 in FIG. 25. The transistors PM81 to PM92 are supplied at gates thereof with a bias voltage PBIAS3 for cascode circuits, and work with the transistors PM3, PM1*b*0-PM1*b*9, and PM2 as cascode circuits.

The circuit in FIG. 26 works as a circuit passing 12 substantially equal currents of the transistors PM2, PM1*b*0-PM1*b*9, and PM3 to the nodes DNODE2, DNODE1 and NSW1 at a ratio of 1:10:1. As in the dynamic element matching circuit DEM1 in FIG. 19, by switching on/off of the transistors PMS1-PMS36 in turn, the current of one of the 12 pMOS transistors is supplied to the node DNODE2, the currents of ten of them are supplied to the node DNODE1, and the current of the remaining one of them is supplied to the node NSW1. By switching the currents generated from the transistors PM2, PM1*b*0-PM1*b*9, and PM3 in turn, a ratio of average currents becomes 1:10:1 even if values of the currents of the PMOS transistors slightly differ. That is, the dynamic element matching circuit DEM3 can improve effective accuracy of a current ratio.

Figure 27:
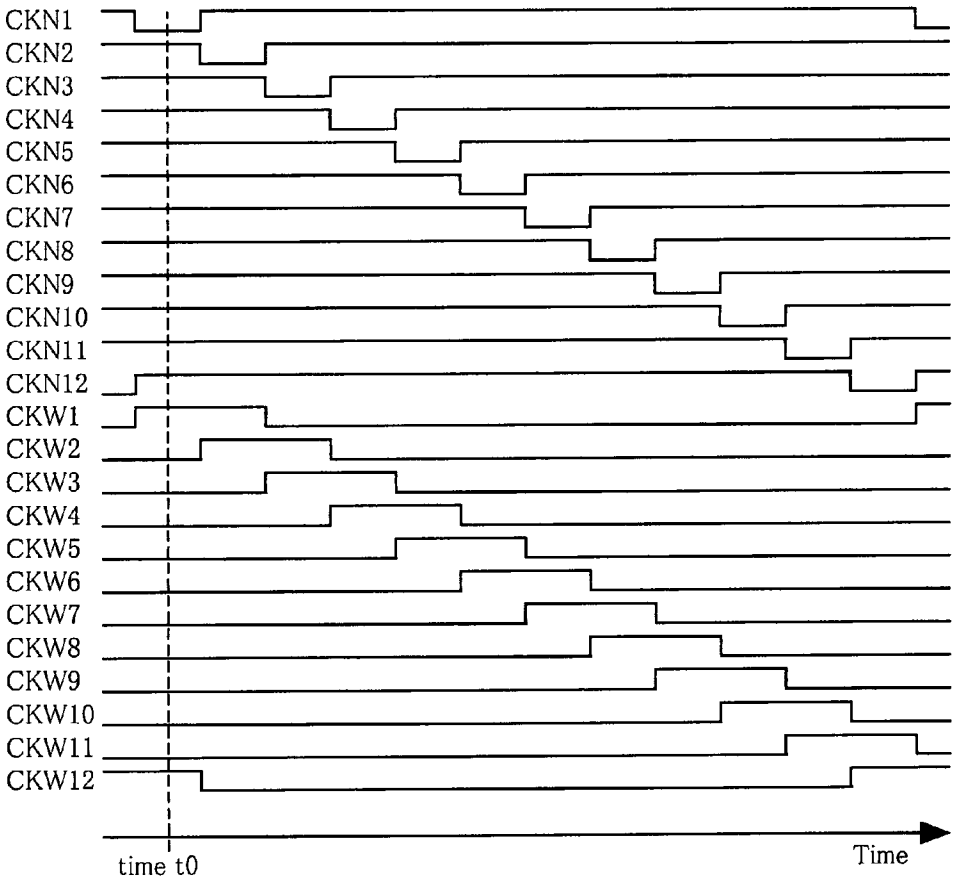
FIG. 27 is a timing chart showing control over the dynamic element matching circuit DEM3.

FIG. 27 shows timings of control signals for the dynamic element matching circuit DEM3 shown in FIG. 26. The operation of the dynamic element matching circuit DEM3 will be described in detail, using the timing chart of the control clocks CKN1-CKN12 and CKW1-CKW12. One of the 12 current sources constituted of the transistors PM2, PM1*b*0-PM1*b*9, and PM3 respectively is connected to the node DNODE2. To describe based on the example of the waveforms of the clock signals in FIG. 27, since at a time t0 (time t0 in FIG. 27), only the signal CKN1 out of the signals CKN1 to CKN12 is L, the current of the transistor PM3 is supplied to the node DNODE2. At the same time, the current of the transistor PM2 is supplied to the node NSW1.

When the signal CKN1 changes from L to H, the signal CKN2 becomes L as shown in FIG. 27. The signals CKN3, CKN4, CKN5, CKN6, CKN7, CKN8, CKN9, CKN10, CKN11, and CKN12 become L in turn and when the signal CKN12 returns from L to H, the signal CKN1 becomes L, and this is repeated. Accordingly, the currents of the transistors PM3, PM1*b*0-PM1*b*9 and PM2 are supplied to the node DNODE2 in turn. The currents of the PM2, PM3 and PM1*b*0-PM1*b*9 are supplied to the node NSW1 in turn.

The signal CKW1 becomes L when the signals CKN1 and CKN2 are both H as shown in FIG. 27. The signal CKW2 becomes Lwhen the signals CKN2 and CKN3 are both H. The signal CKW3 becomes L when the signals CKN3 and CKN4 are both H. The signal CKW4 becomes L when the signals CKN4 and CKN5 are both H. The signal CKW5 becomes L when the signals CKN5 and CKN6 are both H. The signal CKW6 becomes L when the signals CKN6 and CKN7 are both H. The signal CKW7 becomes L when the signals CKN7 and CKN8 are both H. The signal CKW8 becomes L when the signals CKN8 and CKN9 are both H. The signal CKW9 becomes Lwhen the signals CKN9 and CKN10 are both H. The signal CKW10 becomes L when the signals CKN10 and CKN11 are both H. The signal CKW11 becomes L when the signals CKN11 and CKN12 are both H. The signal CKW12 becomes L when the signals CKN12 and CKN1 are both H. In this manner, by controlling the signals CKW1-CKW12, the currents of the ten transistors PM1*b*0-PM1*b*9 not including the transistors PM3 and PM2 are supplied to the node DNODE1 at the time t0. In the next period, the transistor PM3 and PM1*b*0 are pMOS transistors excluded from the 12 pMOS transistors, and the currents of the current sources consisting of the 10 pMOS transistors are supplied to the node DNODE1, with two PMOS transistors being excluded in turn.

FIG. 28 shows an example of truth values of a counter part for generating the control signals shown in FIG. 27. The truth table in FIG. 28 represents the operation of a duodecimal counter. Based on the same concept as the concept of the circuit shown in FIG. 22, a counter circuit realizing the operation of the truth values in FIG. 28 can be configured. Therefore, detailed circuit description of the counter circuit part will be omitted.

Figure 29:
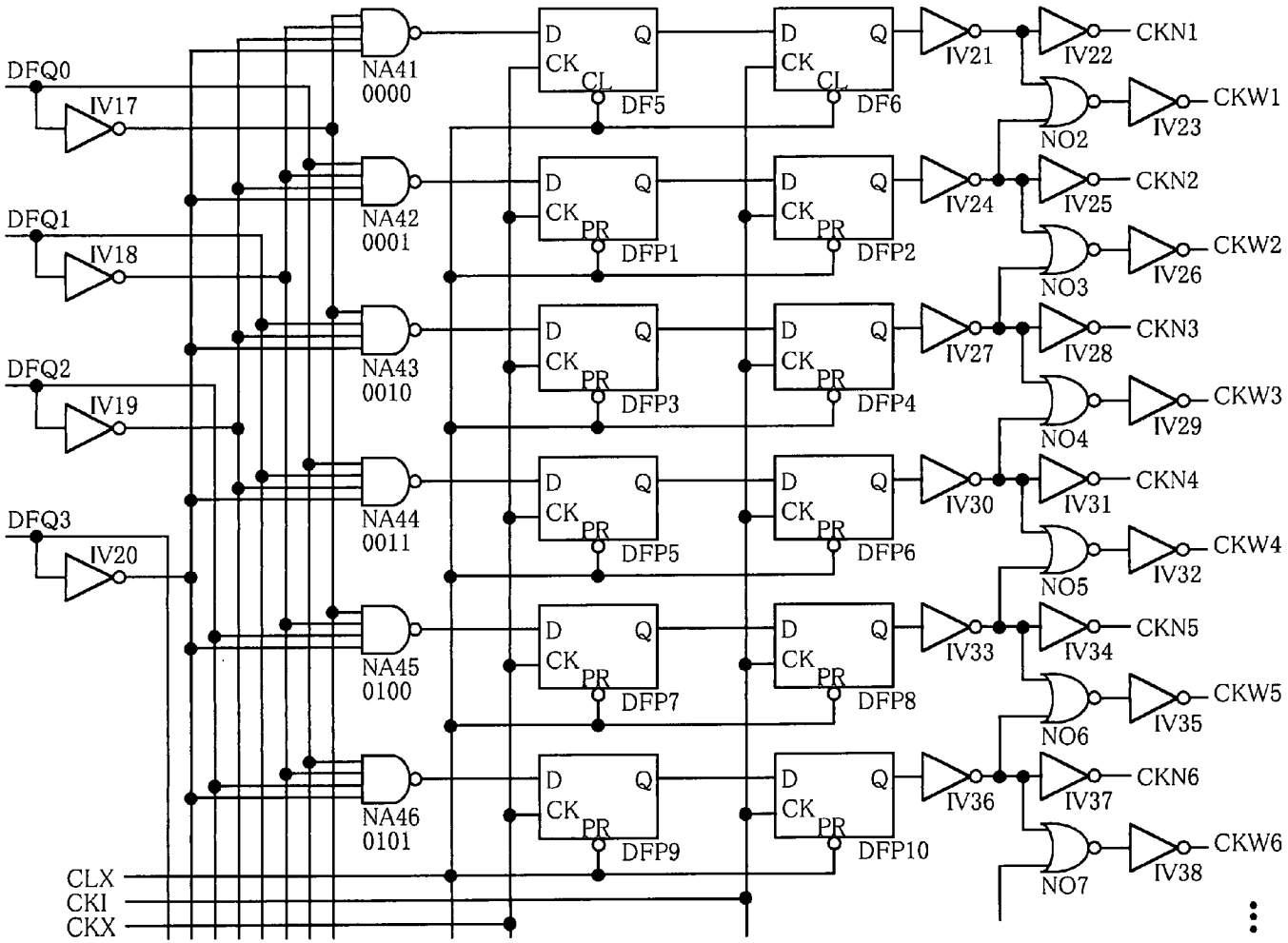
FIG. 29 is a circuit diagram showing a circuit generating control signals for the dynamic element matching circuit DEM3.

FIG. 29 shows an example of a control signal generation circuit for the dynamic element matching circuit DEM3 shown in FIG. 26. For example, the clock waveforms shown in FIG. 27 can be generated by the counter circuit realizing the operation in FIG. 28 and the circuit shown in FIG. 29. In FIG. 29, inverters IV17-IV38 are inverter circuits, NANDs NA41-NA46 are four input NAND circuits, D flip-flop circuits DF5, DF6 are edge trigger D flip-flop circuits that clear the contents to 0 when CL is L, NOR NO2-NO7 are two input NOR circuits, D flip-flop circuits DFP1-DFP10 are edge trigger D flip-flop circuits that set the contents to 1 when PR is L, signals DFQ0-DFQ3 are outputs of the duodecimal counter circuit part, a sighal CLX is a control signal for power-down or initialization, and signals CKN1-CKN6, CKW1-CKW6 are the clock signals shown in FIG. 27. Further, signals CKX and CKI are internal clocks generated from a signal CK, similarly to the signals CKI and CKX in FIG. 22.

The signals DFQ3, DFQ2, DFQ1, DFQ0 (the signals in FIG. 28 or signals similar to those in FIG. 22) generated in a synchronous duodecimal counter are processed in the circuit shown in FIG. 29, whereby the clock signals shown in FIG. 27 are generated. A method of generating the signals CKN1-CKN12 will be described. As described in FIG. 26, among the signals CKN1-CKN12, one of the signals CKN1-CKN12 becomes L and the others become H. Further, the signals CKN1-CKN12 become L in turn and this is repeated. Such an operation is realized by, for example, decoding the signals DFQ3, DFQ2, DFQ1, DFQ0 which are outputs of the duodecimal counter. For example, when the signal "DFQ3, DFQ2, DFQ1, DFQ0" is "0000", the signal CKN1 needs to be L. The signal CKN2 is set to L when the signal "DFQ3, DFQ2, DFQ1, DFQ0" is "0001". Then, in a similar manner, the signal CKN3 is set to Lwhen the signal "DFQ3, DFQ2, DFQ1, DFQ0" is "0010". The signal CKN4 is set to L when the signal "DFQ3, DFQ2, DFQ1, DFQ0" is "0011". The signal CKN5 is set to L when the signal "DFQ3, DFQ2, DFQ1, DFQ0" is "0100". The signal CKN6 is set to L when the signal "DFQ3, DFQ2, DFQ1, DFQ0" is "0101". The signal CNK7 is set to L when the signal "DFQ3, DFQ2, DFQ1, DFQ0" is "0110". The signal CKN8 is setto Lwhen the signal "DFQ3, DFQ2, DFQ1, DFQ0" is "0111". The signal CKN9 is set to L when the signal "DFQ3, DFQ2, DFQ1, DFQ0" is "1000". The signal CKN10 is set to L when the signal "DFQ3, DFQ2, DFQ1, DFQ0" is "1001". The signal CKN11 is set to Lwhen the signal "DFQ3, DFQ2, DFQ1, DFQ0" is "1010". The signal CKN12 is set to L when the signal "DFQ3, DFQ2, DFQ1, DFQ0" is "1011". "0000" accompanying the NAND NA41 in FIG. 29 indicates that the signal CKN1 thus becomes Lwhen the signal "DFQ3, DFQ2, DFQ1, DFQ0" is "0000". Similarly, the four-digit numerals accompanying the NANDs NA42-NA46 also indicate conditions of the signal "DFQ3, DFQ2, DFQ1, DFQ0" under which the signals CKN2-CKN6 become L. The NAND NA41 decodes the signals DFQ3, DFQ2, DFQ1, DFQ0, and the decoding results are stored in the D flip-flop circuits DF5 and DF6 for timing adjustment. The contents of the D flip-flop circuit DF6 are buffered in the inverters IV21 and IV22 to be outputted as the signal CKN1.

The circuit diagram in FIG. 29 shows only part of these decoding circuits for easier understanding of the diagram, but based on the above-described concept, the signal CKN1 to the signal CKN12 can be generated. However, as D flip-flop circuits adjusting the timings of the signals CKN7-CKN12, circuits of the same type as the D flip-flip circuits used for the signals CKN2-CKN6 (the edge trigger flip-flop circuits that set the contents to 1 when PR is L) are used.

Further, as described also in FIG. 22, under the control by the dynamic element matching circuit, the currents surely flow to the transistors Q1, Q2 in FIG. 25 under all the conditions. Consequently, it is possible to limit the voltage given to a capacitor C1 in FIG. 25. If it is ensured that the power-supply voltage is not given to the capacitor C1, it is possible to use an element whose capacitance per unit area is large, which realizes an area reduction. The D flip-flop circuits DF5, DF6, DFP1-DFP10 in FIG. 29 and the not-shown D-flip-flop circuits for the signals CKN7-CKN12 also work as elements that control the signals CKN1-CKN12 so as to surely cause one of them to become L. At a normal operation time, one of the signals CKN1-CKN12 becomes L as described above. For example, in a case where values of the D flip-flop circuits DF5, DF6 and DFP1-DFP10 are unstable at an initial stage of the circuit operation, the signals CKN1-CKN6 may possibly all become H. Further, since the signals CKN7-CKN12 are also generated by the same structure as the structure by which the signals CKN2-CKN6 are generated, all of them may possibly become H. If all of the signals CKN1-CKN12 become H, no current is supplied to the transistor Q2 in FIG. 25, and consequently, the chopper amplifier CAMP1 sets a voltage of a node AMPOUT1 to a GND voltage in an effort to raise a voltage of a node NR1. The D flip-flop circuits DF5, DF6, DFP1-DFP10 set Initial values of the circuits so as to prevent such an unfavorable situation. When the signal CLX becomes L, the contents of the D flip-flop circuit DF6 become L. When the signal CLX is set to L to initialize the circuit, the contents of the D flip-flop circuits DEP1-DEP10 become H. Owing to the initialization of the D flip-flops, it is ensured that one of the signals CKN1-CKN12 becomes L and the others become H.

The concept of the generation of the signals CKW1-CKW12 will be described. As described in FIG. 26, the signal CKW1 is set to L when the signals CKN1 and CKN2 are both H.

The signal CKW2 is set to L when the signals CKN2 and CKN3 are both H. The signal CKW3 is set to L when the signals CKN3 and CKN4 are both H. The signal CKW4 is set to L when the signals CKN4 and CKN5 are both H. The signal CKW5 is set to L when the signals CKN5 and CKN6 are both H. The signal CKW6 is set to L when the signals CKN6 and CKN7 are both H. The signal CKW7 is set to L when the signals CKN7 and CKN8 are both H. The signal CKW8 is set to L when the signals CKN8 and CKN9 are both H. The signal CKW9 is set to L when the signals CKN9 and CKN10 are both H. The signal CKW10 is set to L when the signals CKN10 and CKN11 are both H. The signal CKW11 is set to L when the signals CKN1 and CKN12 are both H. The signal CKW12 is set to Lwhen the signals CKN12 and CKN1 are both H. By realizing this condition by a logic circuit, the circuit in FIG. 29 is obtained. If inversion signals of the signals CKN1 and CKN2 are inputted to an OR circuit (configured by the NOR NO2 and the inverter IV23 in FIG. 29), the characteristic that the signal CKW1 becomes L when the signals CKN1 and CKN2 are both H is realized. The signals CKW2-CKW12 can be also generated based on the same concept.

Figure 30:
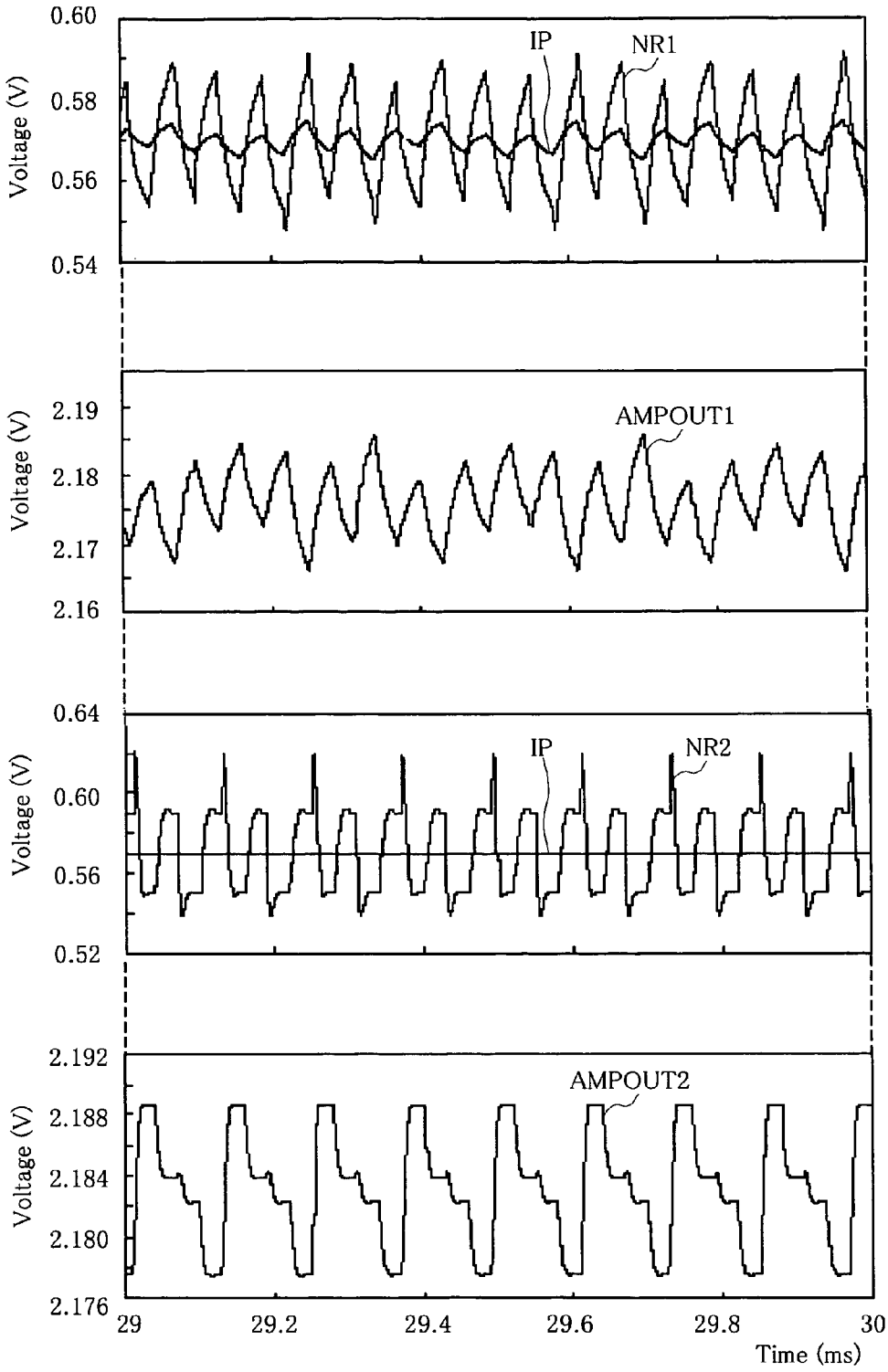
FIG. 30 is an explanatory chart of operational waveforms of some of nodes of the reference voltage generation circuit of the eighth embodiment.

FIG. 30 shows an example of operational waveforms of some of the nodes of the reference voltage generation circuit of the eighth embodiment. The waveforms on the top in FIG. 30 are time waveforms of a node IP and the node NR1. When circuit simulation is executed, an offset voltage is given to the chopper amplifier CAMP1. In the chopper amplifier, since the + and − relation of inputs is changed at a certain cycle, a state is repeated in which the voltage of the node IP becomes larger than the voltage of the node NR1 by the offset voltage and becomes smaller in the next cycle. The simulation shows that the circuit is operating so as to remove the influence of this offset voltage. Further, not only due to the offset of the chopper amplifier CAMP1, but also due to the dynamic element matching DEM3, the currents supplied to the transistors Q1, Q2 and the variable resistor VR1 change cyclically. For easier understanding of the operation of the dynamic element matching, the example in FIG. 30 shows the simulation result under the condition that the pMOS transistors as the current sources shown in FIG. 25 are PMOS transistors different in the ratio W/L of the gate width W and the gate length L and thus there is a mismatch. Reflecting the offset voltage of the chopper amplifier CAMP1 and the cyclical change of the currents, the voltages of the node IP and the node NR1 also change cyclically while the mutual relation is interchanged. Further, they also reflect the operation of the dynamic element matching to cyclically change.

The second waveform in FIG. 30 is a waveform of the output AMPOUT1 of the chopper amplifier CAMP1. The waveform of the output AMPOUT1 also becomes a time waveform reflecting the offset voltage of the chopper amplifier CAMP1 and the cyclic current change due to the dynamic element matching, similarly to the waveforms of the nodes IP and NR1.

The third waveforms in FIG. 30 are time waveforms of the nodes IP and NR2 being inputs of a chopper amplifier CAMP2 of the CTAT current generation part. The results for the chopper amplifier CAMP2 are also the results of the simulation in which an offset voltage is given and mismatch is given between transistors PM4, PM5 being current sources. Similarly to the time change of the voltages of the nodes IP and NR1 and the time change of the voltage of the output AMPOUT1, the time waveform of the voltage of the node NR2 also reflects the offset voltage of the chopper amplifier CAMP2 and a cyclic current change due to the dynamic element matching.

The bottom waveform in FIG. 30 is a time waveform of an output AMPOUT2 of the chopper amplifier CAMP2. Similarly to the waveform of the output AMPOUT1, this time waveform also reflects an offset voltage of the chopper amplifier CAMP2 and a cyclic current change due to the dynamic element matching.

Figure 31A:
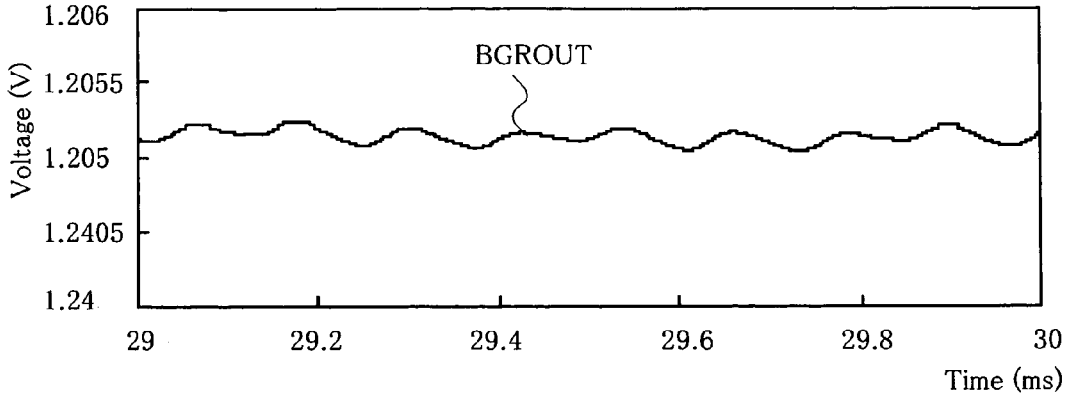
FIG. 31(*a*) and FIG. 31(*b*) are explanatory charts of operational waveforms of another node of the reference voltage generation circuit of the eighth embodiment.
Figure 31B:
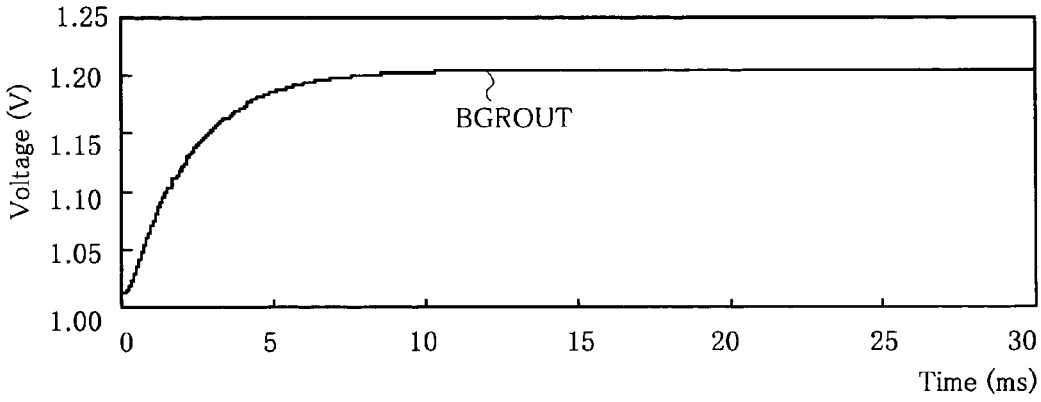

FIG. 31(*a*) and FIG. 31(*b*) show examples of operational waveforms of another node of the reference voltage generation circuit of the eighth embodiment. The waveform in FIG. 31(*a*) is a time waveform of a voltage of the output BGROUT whose AC components are attenuated by a filter. By removing the AC components by the filter, a ripple of the reference voltage (voltage of the output BGROUT) is attenuated to about 0.5 mV.

The waveform in FIG. 31(*b*) is a time waveform of the voltage of the output BGROUT in a longer display time (30 ms from the start of the simulation). At an instant when the chopper amplifies CAMP1, CAMP2 and the dynamic element matching circuits DEM3 and DEM2 start operating, an offset error and an error due to the mismatch of the current sources have not been converted to AC components. Therefore, the reference voltage generation circuit operates in the same manner as that of a reference voltage generation circuit not using the chopper amplifiers CAMP1, CAMP2 and the dynamic element matching circuits DEM3 and DEM2. Therefore, the offset error and the error due to the mismatch of the current sources directly influence a value of the reference voltage. In this simulation example, the value of the reference voltage is about 1010 mV, while an ideal bandgap reference voltage is about 1200 mV. In practice, the error is not so large as this error, but for easier understanding of the operation, in executing the simulation, the offset voltage and the mismatch of the current sources are made large. When the reference voltage generation circuit starts operating, the error components are converted to the AC components by the chopper amplifiers CAMP1, CAMP2 and the dynamic element matching circuits DEM3 and DEM2. The error components converted to the AC components are removed by the low-pass filter LPF. Consequently, the voltage of the output BGROUT comes to approximate the final value. In this example, the voltage of the output BGROUT is about 1205 mV.

FIG. 32 shows an example of the correlation between the reference voltage BGROUT of the reference voltage generation circuit of the eighth embodiment and temperature. The simulation conditions are set to an ideal state in which the offset voltages of the chopper amplifiers CAMP1 and CAMP2 are 0 with no mismatch of the current sources, a state in which the control clocks for the chopper amplifiers CAMP1 and CAMP2 are stopped and thus the chopper amplifiers CAMP1 and CAMP2 are not in use, and a state in which the control clocks for the dynamic element matching circuits DEM3 and DEM2 are stopped and thus the dynamic element matching circuits DEM3 and DEM2 are not in use. That is, FIG. 32 shows the correlation between the voltage of the output BGROUT and temperature when the reference voltage generation circuit is operated in the same manner as that when it has a circuit configuration not using the chopper amplifiers and the dynamic element matching circuit.

The reference voltage generation circuit of this embodiment is a linear bandgap circuit that linearly approximates temperature characteristics of the base-emitter voltages Vbe of the transistors Q1 and Q2 to cancel out temperature dependency thereof. Therefore, as shown in FIG. 32, the temperature dependency of the voltage of the output BGROUT exhibits a characteristic of reaching the maximum value at a certain temperature. By changing a ratio of the PTAT current and the CTAT current, it is possible to set the temperature at which the voltage of the output BGROUT becomes the highest. In the characteristic in FIG. 32, the maximum value of the voltage of the output BGROUT is about 1203 mv. On the other hand, in the characteristic in FIG. 31(*a*) and FIG. 31(*b*), the voltage of the output BGROUT is about 1205 mV. This difference indicates an offset voltage newly generated due to the introduction of the chopper amplifier or the dynamic element matching circuit. Or, it indicates errors due to the offset voltage that cannot be removed by the chopper amplifiers CAMP1, CAMP2 and the dynamic element matching circuits DEM3 and DEM2.

In the circuit of the eighth embodiment described above, the transistor Q1 is supplied with a current ten times as large as a current of the transistor Q2. Consequently, the current density ratio of the transistor Q1 and Q2 is as large as 100:1, so that the voltage across the both ends of the resistor R1 can be made large. Accordingly, the amplitude of an AC signal generated in the chopper amplifier CAMP1 can be made small. That is, compared with other cases using the same low-pass filter LPF (for example, the capacitor C2), the ripple of the output signal appearing in the output BGROUT becomes smaller.

Figure 33:
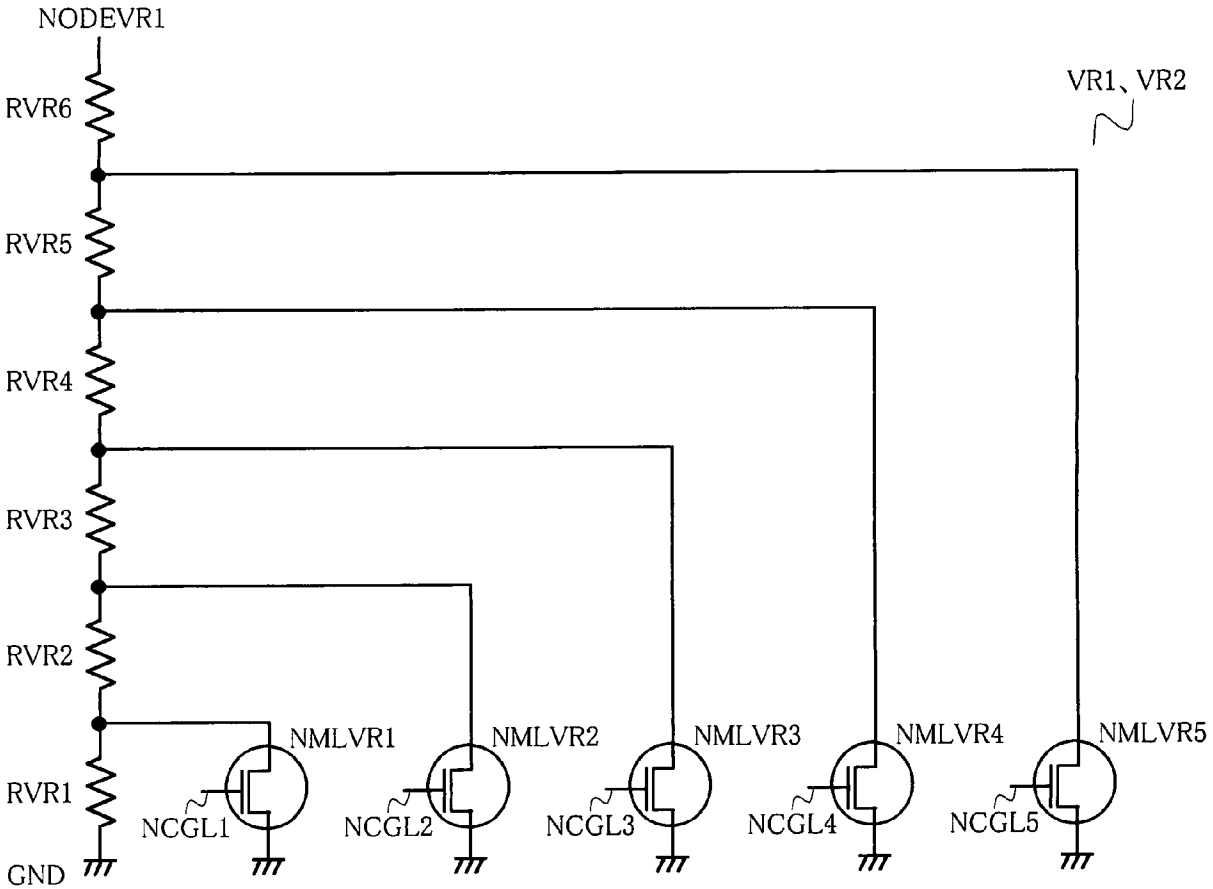
FIG. 33 is another circuit diagram of the variable resistors VR1, VR2 in FIG. 9(*a*)

The above first embodiment has described the example where the variable resistors VR1 and VR2 have the circuit configuration shown in FIG. 10. The present invention is not limited to such an embodiment. For example, switch transistors NMLVR1-NMLVR5 may be nMOS transistors for 1.8 V power supply as shown in FIG. 33. The transistors NMLVR1-NMLVR5 in FIG. 33 are nMOS transistors for 1.8 V power supply. If variable resistors with the same area are compared, those in this case can be smaller in on-resistance since they are constituted of the switch MOS transistors small in channel length L and in gate oxide thickness. Or, if variable resistors constituted of the MOS transistors with the same on-resistance are compared, those in this case can be smaller in area. Consequently, a variable resistor circuit with a small area can be realized. Therefore, it is possible to adjust the output reference voltage accurately at low cost.

The above fourth embodiment has described the example where the PTAT voltage is used for temperature detection. The present invention is not limited to such an embodiment. For example, various modifications can be made, for example, the CTAT voltage may be used, so far as the voltage serving the purpose of temperature detection is used. In this case, the same effects as those of the above-described fourth embodiment can be also obtained.

The above fifth embodiment has described the example of the configuration of the filter for removing the AC error components ascribable to the chopper amplifiers and the dynamic element matching. The present invention is not limited to such an embodiment. For example, the configuration of the filter may be modified in various ways so far as the filter serves the purpose of removing the AC error components ascribable to the chopper amplifiers and the dynamic element matching. In this case, the same effects as those of the fifth embodiment can be also obtained.

Figure 34:
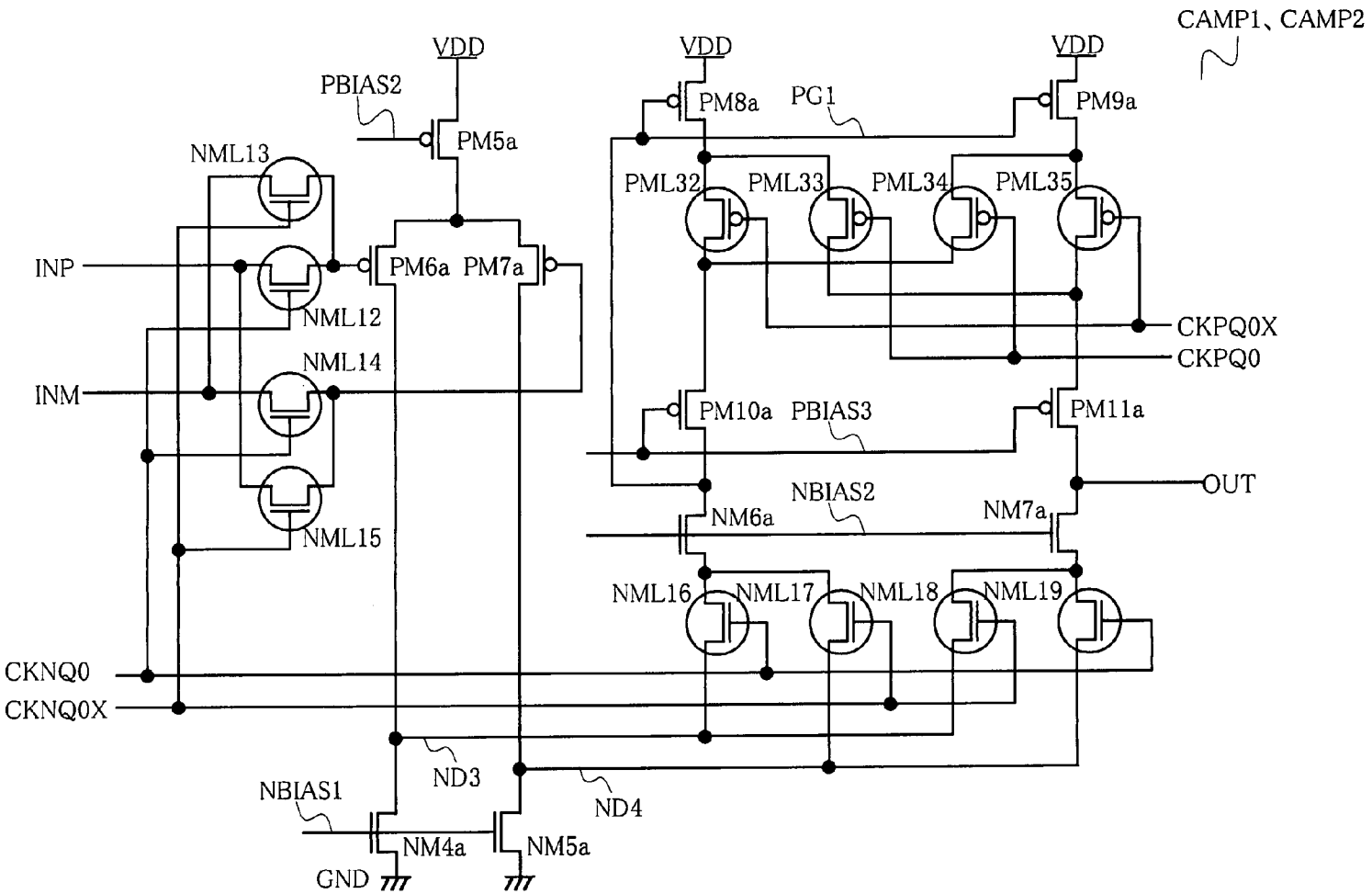
FIG. 34 is another circuit diagram of the chopper amplifiers CAMP1, CAMP2 in FIG. 18.
Figure 35:
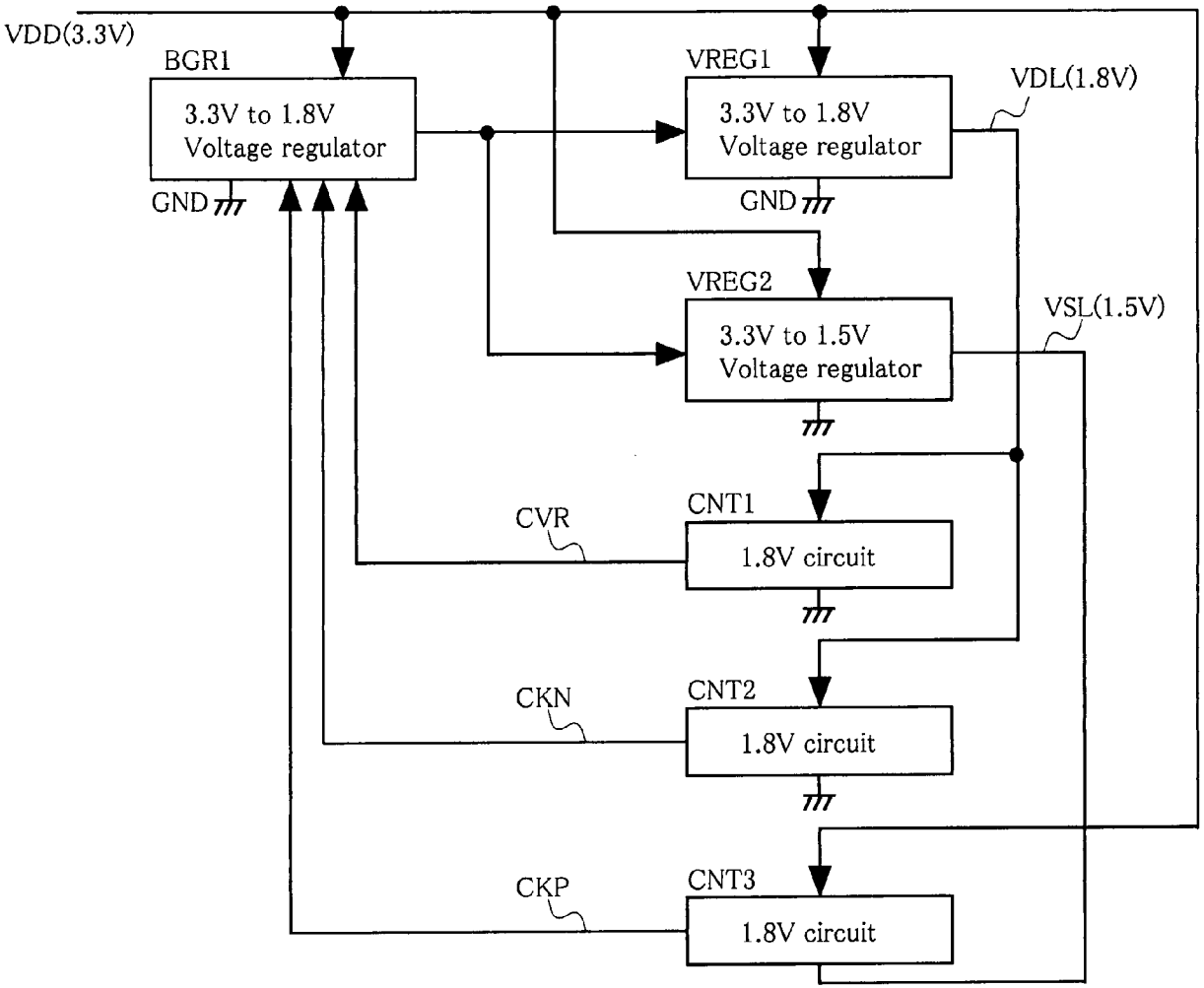
FIG. 35 is a circuit diagram of a signal level conversion circuit.

The above seventh embodiment has described the example where the chopper amplifiers CAMP1 and CAMP2 have the circuit configuration shown in FIG. 21. The present invention is not limited to such an embodiment. For example, as shown in FIG. 34, switch transistors NML12-NML19 and transistors PML32-PML35 may be MOS transistors for 1.8 V power supply. In FIG. 34, the transistors NML13-NML19 are nMOS transistors for 1.8 V power supply, and the transistors PML32-PML35 are pMOS transistors for 1.8 V power supply. The circuit in FIG. 35 shows a concept of the conversion of signal level for the circuit shown in FIG. 34, for instance. The use of, for example, the circuit shown in FIG. 35 enables the control of the MOS transistors for 1.8 V power supply. A power-supply circuit VREG1 in FIG. 35 generates a 1.8 V power supply VDL, and a power-supply circuit VREG2 generates a 1.5 V power supply VSL. Based on these power supplies, control signals CVR, CKN, and CKP for the MOS transistors for 1.8 power supply are generated.

The circuit shown in FIG. 35 includes a reference voltage generation circuit BGR1, the power-supply circuits VREG1, VREG2, and control circuits CNT1, CNT2, CNT3. The reference voltage generation circuit BGR1 is, for example, the reference voltage generation circuit shown in FIG. 18, FIG. 25, or the like. The power-supply circuit VREG1 generates, for example, an internal 1.8 V power supply VDL from a 3.3 V power-supply voltage VDD. The power-supply circuit VREG2 generates an internal 1.5 V power supply VSL from the 3.3 V power-supply voltage VDD. The control circuits CNT1, CNT2, CNT3 generate the control signals CVR, CKN, CKP respectively.

For example, in FIG. 35, VDD is a 3.3 V power supply, GND is a GND terminal (0 V), a power supply VDL is a 1.8 V internal power supply generated from the GND, a power supply VSL is an internal power supply that is lower than the VDD by 1.8 V, the control signal CVR is a control signal for the variable resistors each constituted of, for example, the circuit shown in FIG. 33, the control signal CKN is a control signal for the NMOS transistors for 1.8 V power supply, such as, for example, control signals CKNQ0, CKNQ0X in FIG. 34, and the control signal CKP is a control signal for the PMOS transistors for 1.8 V power supply, such as control signals CKPQO, CKPQ0X in FIG. 34. The above NMOS transistors and PMOS transistors for 1.8 V power supply mean NMOS transistors and PMOS transistors for low-voltage power supply, and are not limited to the transistors for 1.8 V power supply.

In order to control a variable resistor circuit, for example, the circuit shown in FIG. 33, H level and L level of voltages of control signals therefor are 1.8 V and 0 V respectively. Similarly, H level and L level of the control signals CKNQ0, CKNQ0X for the circuit shown in FIG. 34 are 1.8 V and 0 V respectively. These circuits are driven by the control circuits CNT1, CNT2 that are adapted to these signal levels. H level and L level of the control signals CKPQO, CKPQ0X in FIG. 34 are 3.3 V and 1.5 V respectively. These circuits are driven by the control circuit CNT3 adapted to these signal levels. The internal 1.8 V power supply VDL can be generated by the power-supply circuit VREG1. Further, the internal 1.5 V power supply VSL (3.3 V−1.8 V) can be generated from the 3.3 V power-supply voltage VDD by the power-supply circuit VREG2.

Figure 36:
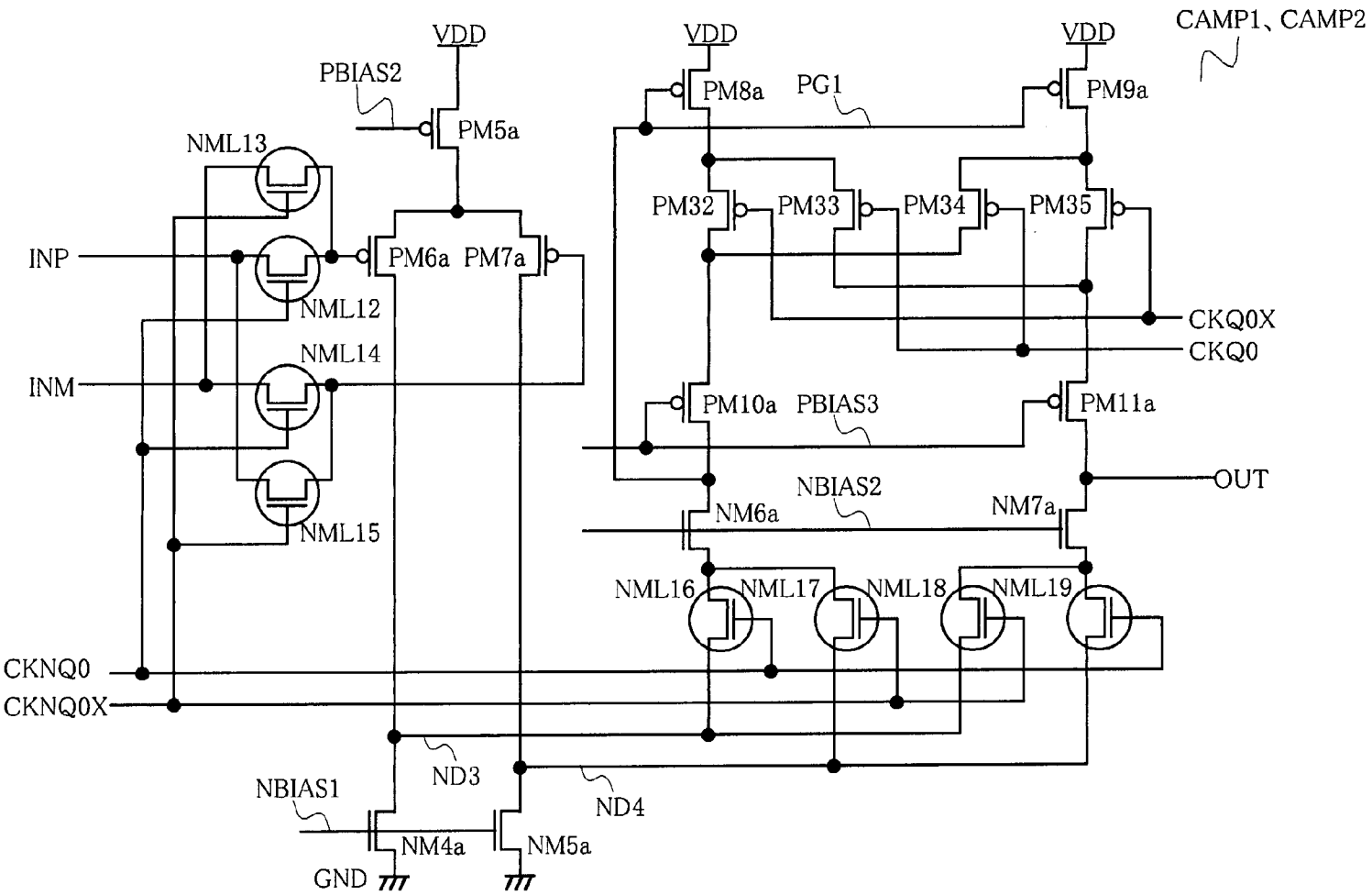
FIG. 36 is another circuit diagram of the chopper amplifiers CAMP1, CAMP2 in FIG. 18.

A possible configuration in a case where the 1.5 V power supply VSL is not provided is such that only the switch nMOS transistors NML12-NML19 are the MOS transistors for 1.8 V power supply as shown in FIG. 36. The use of the MOS transistors for 1.8 V power supply results in a reduction in gate capacitances of the switch MOS transistors. Therefore, a charge injection amount from the switches becomes small. Since the gate capacitances of the switch MOS transistors decrease, a residual offset ascribable to mismatch of the charges injected from the switches can be reduced. Therefore, it is possible to accurately adjust the output reference voltage at low cost.

The above seventh embodiment has described the example of the circuit configuration of the dynamic element matching circuits DEM1 and DEM2. The present invention is not limited to such an embodiment. For example, the switch transistors PM14-PM22 of the dynamic element matching circuit DEM1 shown in FIG. 19 may be disposed between the transistors PM23-PM25 and the transistors PM7, PM11, PM12. In this case, it is also possible to obtain the same effects as those of the above-described seventh embodiment.

The above seventh embodiment has mainly described how the switches, the dynamic element matching circuits, and the chopper amplifiers are combined to realize the reference voltage generation circuit. A bias circuit/startup circuit suitable for the present invention will be shown below. The bias generation and start up are enabled by, for example, a circuit shown in FIG. 37.

Figure 37:
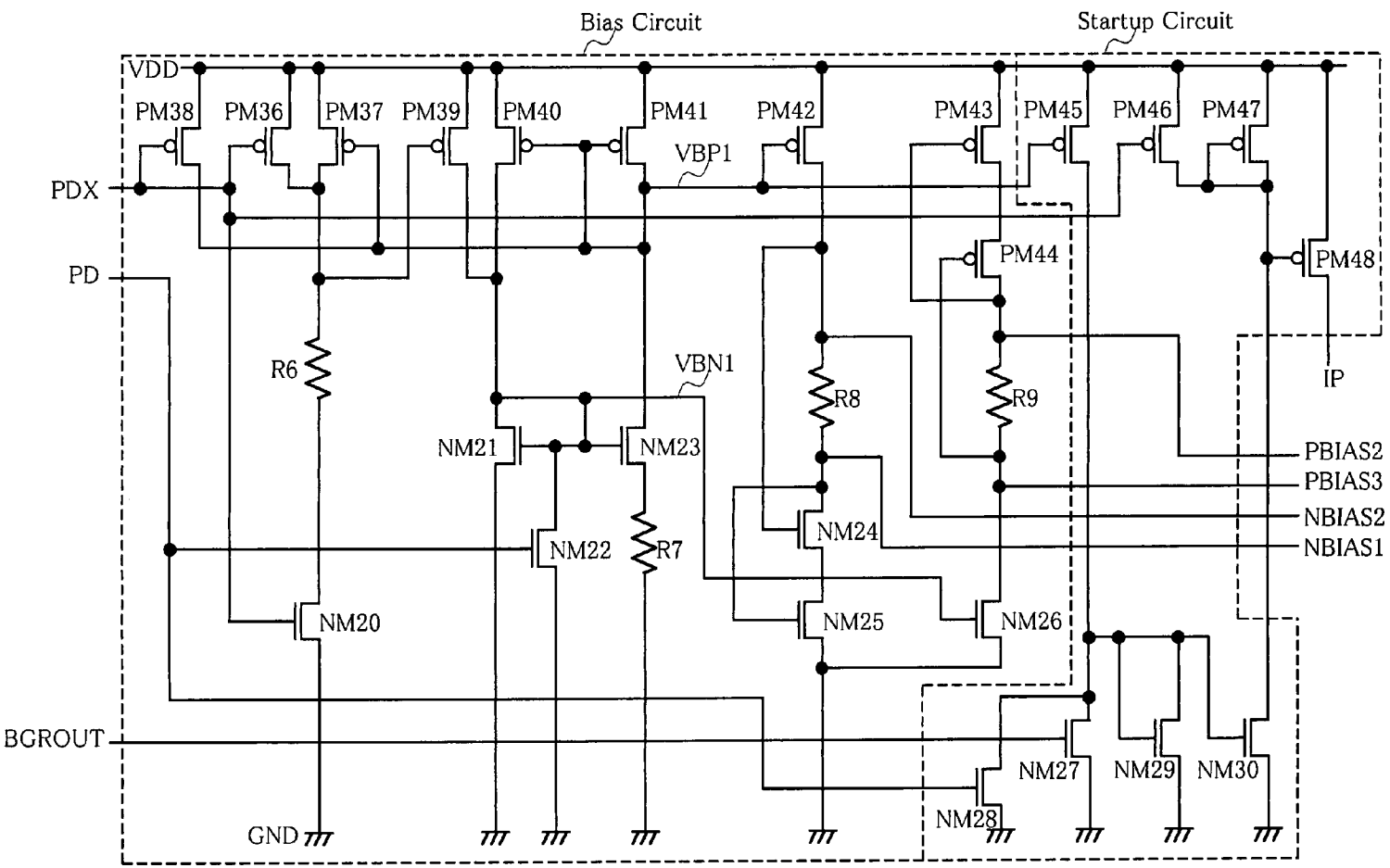
FIG. 37 is a circuit diagram showing a bias circuit and a startup circuit in FIG. 18.

FIG. 37 shows an example of a bias circuit generating a bias voltage and a startup circuit stably operating the operational amplifiers of the reference voltage generation circuit of the present invention. The circuit shown in FIG. 37 includes pMOS transistors PM36-PM48, nMOS transistors NM20-NM30, and resistors R6-R9. VDD is a power-supply voltage, GND is a GND voltage, bias voltages NBIAS1, NBIAS2 are bias voltages of the nMOS transistors, bias voltages PBIAS2, PBIAS3 are bias voltages of the pMOS transistors, nodes VBP1, VBN1 are internal nodes of the bias circuit, and signals PD, PDX are control signals for power-down.

The bias circuit shown in FIG. 37 is a circuit similar to a typical bias circuit, and therefore, detailed description of the circuit operation will be omitted. The transistors PM40, PM41, NM21, NM23 and the resistor R7 work as a loop determining an operating point of the bias circuit. The transistors PM36-PM39, NM20 and the resistor R6 work as the startup circuit of the bias circuit. A difference in gate-source voltage between the transistor NM21 and the transistor NM23 is given to the resistor R7 to determine a bias current. At a normal operation time, the signal PD is set to L (0 V) and the signal PDX is set to H (voltage of VDD). For stopping the circuit to make a current 0, the signal PD is set to H and the signal PDX is set to L.

The bias current determined here is transmitted to other circuit parts as gate voltages (voltages of nodes VBP1, VBN1) of the nMOS transistors and the PMOS transistors. The transistor PM42 supplies a current to the transistors NM24, NM25 constituting a cascode circuit. Consequently, the bias voltages NBIAS2, NBIAS1 which are gate voltages of the transistors NM24, NM25 are generated. For example, the bias voltage NBIAS2 is set to a voltage whose level is shifted from that of the bias voltage NBIAS1 by the resistor R8 as in the bias circuit shown in FIG. 37. Further, the transistor NM26 supplies a current to the transistors PM43, PM44 constituting a cascode circuit. Consequently, the bias voltages PBIAS2, PBIAS3 which are gate voltages of the transistors PM43, PM44 are generated. For example, the bias voltage PBIAS3 is set to avoltage whose level is shifted from that of the bias voltage PBIAS2 by the resistor R9 as in the bias circuit shown in FIG. 37. The aforesaid bias voltages NBIAS1, NBIAS2, PBIAS2, PBIAS3 can be utilized as bias voltages of, for example, the circuits shown in FIG. 19-FIG. 21. Any bias circuit other than the bias circuit shown in FIG. 37 is usable providing that it serves the purpose of generating and supplying the bias voltages.

The startup circuit shown in FIG. 37 shows an example of the circuit configuration suitable for the reference voltage generation circuits shown in FIG. 9(*a*), FIG. 11, FIG. 14-FIG. 18, FIG. 25, and so on. For example, in the reference voltage generation circuit shown in FIG. 18, the chopper amplifier CAMP1 controls the voltage of the node AMPOUT1 so that the voltages of the node IP and the node NR1 become equal to each other, thereby generating the PTAT current. However, when no current flows to the transistors Q1, Q2 and thus the voltages of the node IP, NR1 both become the GND voltage, this balancing condition is also satisfied. That is, the reference voltage generation circuit shown in FIG. 18 and so on have a problem that an undesirable stabilizing point (operating point) exits, namely, the circuit reaches the stabilizing point also when the currents of the transistors Q1, Q2 are 0. In order to prevent the circuit from being stabilized at the operating point at which the currents of the transistors Q1, Q2 become 0, a circuit called a startup circuit shown in FIG. 37 is used, for instance.

A voltage BGROUT is a reference voltage output of the reference voltage generation circuit (the reference voltage output BGROUT of the reference voltage generation circuit shown in FIG. 9(*a*), FIG. 11, FIG. 14-FIG. 18, FIG. 25, or the like), a node IP is a node IP of the reference voltage generation circuit (the node IP of the reference voltage generation circuit shown in FIG. 9(*a*), FIG. 11, FIG. 14-FIG. 18, FIG. 25, or the like). The purpose of the startup circuit is to control a negative-feedback circuit so that the negative-feedback circuit is not stabilized at an operating point, for example, when the voltages of the node IP and the node NR1 connected to inputs of the chopper amplifiers both become the GND voltage. When the voltages of the node IP and the node NR1 shown in FIG. 18 are both the GND voltage, the PTAT current becomes 0 and the voltage of the node AMPOUT1 becomes the VDD voltage. Since the voltage of the node IP shown in FIG. 18 becomes the GND voltage, the voltage of the node NR2 also becomes the GND voltage and the CTAT current also becomes 0. Since the CTAT current and the PTAT current both become 0, the voltage of the reference voltage output BGROUT of the reference voltage generation circuit also becomes 0 V. When the voltage BGROUT shown in FIG. 37 becomes 0 V, the transistor NM27 turns off. Consequently, the current flowing from the transistor PM45 flows to the transistor NM29. Further, since the current flows to the transistor NM29, the current flows to the transistors NM30, PM47. Accordingly, a current also flows to the transistor PM48 constituting a current-mirror with the transistor PM47. Since the current of the transistor PM48 flows to the node IP shown in FIG. 18, the voltage of the node IP rises.

In accordance with the voltage rise of the node IP, the negative-feedback circuit constituted of the chopper amplifier CAMP1 shown in FIG. 18 operates. The chopper amplifier CAMP1 drops the voltage of the node AMPOUT1 in order to make the voltages of the nodes IP, NR1 equal to each other. Consequently, currents flow to the transistors Q1, Q2, so that the generation of the PTAT current and the CTAT current is started. The PTAT current and the CTAT current flow to the variable resistor VR1, resulting in the rise of the voltage BGROUT. In accordance with the rise of the voltage BGROUT, the transistor NM27 turns on. Consequently, the current supplied from the transistor PM45 flows to the transistor NM27. Accordingly, substantially no current flows to the transistor NM29, and no current flows to the transistors NM30, PM47, PM48 either. In this manner, the startup circuit shown in FIG. 37 eliminates the influence to the voltage of the node IP. That is, the startup circuit shown in FIG. 37 is structured to supply the current to the node IP when the voltages of the node IP and the node NR1 are 0 V so that the circuit escapes an undesirable stabilizing point, and to almost completely eliminate the influence to the voltages of the nodes IP, NR1 and the voltage BGROUT after the voltage BGROUT rises. Any of various kinds of circuits other than the startup circuit shown in FIG. 37 is usable providing that it is a circuit realizing the purpose of the startup circuit. In this case, it is also possible to obtain the same effects as those of the above-described seventh embodiment.

The above eighth embodiment has described the example where the dynamic element matching circuit DEM3 has the configuration shown in FIG. 26. The present invention is not limited to such an embodiment. For example, the switch transistors PMS1-PMS36 of the dynamic element matching circuit DEM3 may be disposed between the transistors PM3, PM1*b*0-PM1*b*9, PM2 and the transistors PM81-PM92. Another possible structure is to constitute a switch group by 12 MOS transistors and connect the switch group to the transistors PM3, PM1*b*0-PM1*b*9, PM2. In this case, it is also possible to obtain the same effects as those of the above-described eighth embodiment.

The invention is not limited to the above embodiments and various modifications may be made without departing from the spirit and scope of the invention. Any improvement may be made in part or all of the components.

What is claimed is:

1. A reference voltage generation circuit comprising:

a first current source and a first transistor connected in series between a first power-supply line and a second power-supply line;

a second current source, a first resistor, and a second transistor connected in series between said first power-supply line and said second power-supply line;

a third current source, a first switch, and a first variable resistor connected in series between said first power-supply line and said second power-supply line;

a first operational amplifier circuit having inputs connected to a first resistance node and an emitter of said first transistor respectively, and an output connected to control terminals of said first, second, and third current sources, thereby equating a voltage of the first resistance node and a voltage of the emitter of said first transistor, the first resistance node being a connection node of said second current source and said first resistor;

a fourth current source and a second variable resistor connected in series between said first power-supply line and said second power-supply line;

a fifth current source and a second switch connected in series between an output node and said first power-supply line, the output node being a connection node of said first switch and said first variable resistor; and a second operational amplifier having inputs connected to a second resistance node and the emitter of said first transistor respectively, and an output connected to control terminals of said fourth and fifth current sources, thereby equating a voltage of the second resistance node and the voltage of the emitter of said first transistor, the second resistance node being a connection node of said fourth current source and said second variable resistor, wherein:

said first transistor has a base and a collector connected to said second power-supply line;

said second transistor has a base and a collector connected to said second power-supply line and operates with a current density different from a current density of said first transistor;

said first switch is on in a first operation mode and a third operation mode and is off in a second operation mode; and said second switch is on in the first operation mode and the second operation mode and is off in the third operation mode.

2. The reference voltage generation circuit according to claim 1, further comprising:

a third switch and a second resistor connected in series between a first switch node and said second power-supply line, the third switch turning off when said first switch is on and turning on when said first switch is off, the first switch node being a connection node of said third current source and said first switch; and a fourth switch connected between a second switch node and a third switch node and turning off when said second switch is on and turning on when said second switch is off, the second switch node being a connection node of said fifth current source and said second switch, the third switch node being a connection node of said third switch and said second resistor.

3. The reference voltage generation circuit according to claim 1 further comprising:

a first dynamic element matching circuit that is disposed between said first, second, and third current sources, and said first transistor, first resistor and first switch, in order to switch nodes to which outputs of said first, second, and third current sources are connected respectively; and a second dynamic element matching circuit that is disposed between said fourth and fifth current sources, and said second variable resistor and second switch, in order to switch nodes to which outputs of said fourth and fifth current sources are connected respectively.

4. The reference voltage generation circuit according to claim 3, further comprising a first filter disposed between the emitter of said first transistor and an input terminal of said second operational amplifier circuit.

5. The reference voltage generation circuit according to claim 3, wherein:

each of said first, second, and third current sources includes at least one MOS transistor or more to generate a current, the MOS transistors having sources connected to said first power-supply line, gates connected to a control line, and drains connected to one another;

a ratio W/L of a gate width W and a gate length L of the MOS transistor generating the current of said first current source is larger than a ratio W/L of a gate width W and a gate length L of the MOS transistor generating the current of said second current source; and said first dynamic element matching circuit switches the nodes to which the outputs of said first, second, and third current sources are connected respectively, in order to equate a ratio of current values of said first, second, and third current sources a ratio of the ratios W/L of said first, second, and the third current sources.

6. The reference voltage generation circuit according to claim 1, wherein at least one of said first and second operational amplifier circuits is constituted of a chopper-stabilized operational amplifier.

7. The reference voltage generation circuit according to claim 6, further comprising a capacitor connected to at least one of the inputs of said first and second operational amplifier circuits.

8. The reference voltage generation circuit according to claim 1, wherein at least one of said first and second variable resistors includes:

a plurality of switch MOS transistors whose sources are connected to said second power-supply line; and a plurality of unit resistors whose terminals on one side are connected to drains of said switch MOS transistors.

9. The reference voltage generation circuit according to claim 1, further comprising an output buffer amplifier outputting a voltage generated at said output node to an exterior of the reference voltage generation circuit.

10. The reference voltage generation circuit according to claim 9, wherein said output buffer amplifier is constituted of a chopper-stabilized operational amplifier.

11. The reference voltage generation circuit according to claim 1, further comprising a temperature detecting unit that detects temperature of a semiconductor substrate on which the reference voltage generation circuit is formed and outputs temperature information indicating the detected temperature.

12. The reference voltage generation circuit according to claim 1, further comprising a switch control terminal that is connected to control terminals of said first and second switches and receives a switch control signal supplied from an exterior of the reference voltage generation circuit.

* * * * *